US008610635B2

(12) United States Patent
Huang et al.

(10) Patent No.: US 8,610,635 B2
(45) Date of Patent: Dec. 17, 2013

(54) BALANCED METAMATERIAL ANTENNA DEVICE

(76) Inventors: Wei Huang, San Diego, CA (US); Vladimir Penev, San Diego, CA (US); Vaneet Pathak, San Diego, CA (US); Gregory Poilasne, El Cajon, CA (US)

( * ) Notice: Subject to any disclaimer, the term of this patent is extended or adjusted under 35 U.S.C. 154(b) by 622 days.

(21) Appl. No.: 12/716,852

(22) Filed: Mar. 3, 2010

(65) Prior Publication Data

US 2010/0225554 A1 Sep. 9, 2010

Related U.S. Application Data

(60) Provisional application No. 61/157,132, filed on Mar. 3, 2009, provisional application No. 61/223,911, filed on Jul. 8, 2009.

(51) Int. Cl.
*H01Q 9/16* (2006.01)

(52) U.S. Cl.
USPC ..... 343/821; 343/700 MS; 343/859

(58) Field of Classification Search
USPC ..... 343/700 MS, 793, 795, 821, 859
See application file for complete search history.

(56) References Cited

U.S. PATENT DOCUMENTS

| | | | | |
|---|---|---|---|---|
| 7,592,957 | B2 | 9/2009 | Achour et al. | |
| 2007/0176827 | A1 | 8/2007 | Itoh et al. | |
| 2008/0258978 | A1* | 10/2008 | Stuart | 343/700 MS |
| 2008/0258981 | A1 | 10/2008 | Achour et al. | |
| 2008/0258993 | A1 | 10/2008 | Gummalla et al. | |
| 2009/0135087 | A1 | 5/2009 | Gummalla et al. | |
| 2009/0295660 | A1 | 12/2009 | Xu et al. | |
| 2010/0045554 | A1 | 2/2010 | Xu et al. | |

FOREIGN PATENT DOCUMENTS

| | | | |
|---|---|---|---|
| EP | 1376759 | A2 | 1/2004 |
| JP | 2006014157 | A | 1/2006 |

OTHER PUBLICATIONS

Heideo, Left Handed Dipole Antennas and Their Implementations, IEEE Transactions on Antennas and Propagation, vol. 55, No. 5, May 2007, pp. 1246-1253.*

"International Application Serial No. PCT/US2010/026099, International Search Report mailed Oct. 12, 2010", 4 pgs.

Caloz and Itoh, "Electromagnetic Metamaterials: Transmission Line Theory and Microwave Applications," John Wiley & Sons (2006).

Tatsuo Itoh in "Invited paper: Prospects for Metamaterials," Electronics Letters, vol. 40, No. 16, pp. 972-973. (Aug. 2004).

Balanis, Constitine A. "Antenna Theory Analysis and Design," Chapter 2. 2nd Edition John Wiley & Sons (1997), Gopsons Papers, Noida, India.

(Continued)

*Primary Examiner* — Dieu H Duong

(57) ABSTRACT

This document describes designs and techniques for directly feeding an unbalanced transmission line with a balanced antenna using Composite Right and Left Handed (CRLH) and balun structures. According to various examples, first and second radiating elements, first and second antenna structures, or first and second portions of an antenna structure can provide a left-handed (LH) mode resonance and a right-handed (RH) mode resonance. A feed port can provide an unbalanced signal, and a balun structure can be coupled to the first and second radiating elements, first and second antenna structures, or first and second portions of an antenna structure, to adapt the unbalanced signal from the feed port to a balanced signal for coupling to the first and second radiating elements, first and second antenna structures, or first and second portions of an antenna structure.

43 Claims, 52 Drawing Sheets

(56) References Cited

OTHER PUBLICATIONS

"Chinese Application Serial No. 201080019526.4, Office Action mailed Jul. 22, 2013", (w/English Translation), 12 pgs.

Zhu, Yuxiao, et al., "Design of Miniaturized Planar Spiral Antenna and Its Wideband Balun", (w/English Abstract), *Journal of Shanghai University (Natural Science)*, vol. 14 No. 6, (Dec. 2008), 581-584.

* cited by examiner

BALANCED METAMATERIAL ANTENNA DEVICE

PRIORITY CLAIMS AND RELATED APPLICATIONS

This application claims the benefits of U.S. Provisional Patent Applications Ser. No. 61/157,132 entitled "BALANCED METAMATERIAL ANTENNA DEVICE" and filed on Mar. 3, 2009 and Ser. No. 61/223,911 entitled "VIRTUAL GROUND BALANCED METAMATERIAL ANTENNA DEVICE" and filed on Jul. 8, 2009.

The disclosures of the above applications are hereby incorporated by reference as part of the specification of this application.

BACKGROUND

A balanced line in a wireless communication system may include a pair of conductive transmission lines, each of which are structurally symmetrical and have equal but opposite current along their respective lengths. Therefore, due to cancellation effects in the balanced line, no radiation occurs along the transmission lines, making it ideal for rejecting external noise. One implementation of the balanced line in a wireless system includes dipole antennas, for example.

In contrast, unbalanced lines, such as coaxial cable, which is designed to have its return conductor connected to ground, or circuits whose return conductor actually is ground, may have current differences within the coaxial cable, causing the transmission line to radiate.

A balun device may be used to achieve impedance compatibility between balanced line and unbalanced line. In addition, the balun may serve as an interface between a source and a device, which each have different impedance characteristics. In radio frequency (RF) applications, for example, balun devices may be used to achieve compatibility between balanced systems, such as a balanced antenna, and unbalanced systems, such as the coaxial cable. A variety of configurations exist to implement balun devices in antenna device applications.

Figure 1:
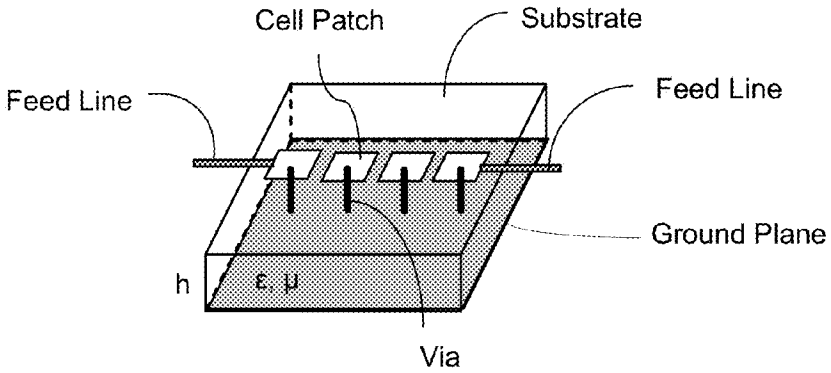
FIGS. 1-3 illustrate examples of one dimensional composite right and left handed metamaterial transmission lines based on four unit cells, according to example embodiments.

In the appended figures, similar components and/or features may have the same reference numeral. Further, various components of the same type are distinguished by a second label following the reference numeral. If only the first reference numeral is used in the specification, the description is applicable to any one of the similar components having the same first reference numeral irrespective of the second reference numeral.

DETAILED DESCRIPTION

Recent growth in the use of Wireless Wide Area Networks (WWAN), the adoption of broadband Wireless Local Area Networks (WLAN), coupled with consumer demand for seamless global access has pushed the wireless industry to support most broadband wireless standards in different geographical areas by supporting multi-band and multi-mode operations in cellular handsets, access points, laptops, and client cards. This has created a great challenge for engineers in RF and antenna design to develop 1) multi-band, 2) low-profile, 3) small, 4) better performing (including Multiple Input-Multiple Output (MIMO)), 5) accelerating time to market, 6) low cost, and 7) easy to integrate in devices listed above. Conventional antenna technologies satisfy a subset of these seven criteria, however, they hardly satisfy all of them. A novel solution is described herein that applies a metamaterial-based RF design to print penta-band handset antennas directly on the Printed Circuit Board (PCB), as well as to development of balanced-antennas for WiFi Access Points. Full active and passive performance is described herein, including key benefits of MTM antennas. Further disclosed are detailed analysis of antenna operation while focusing on the main Left-Handed (LH) mode that enables antenna size reduction and the ability to print them directly on a PCB.

Metamaterials are manmade composite materials engineered to produce desired electromagnetic propagation behavior not found in natural media. The term "metamaterial" refers to many variations of these man-made structures, including Transmission-Lines (TL) based on Composite Right and Left-Hand (CRLH) propagation. A practical implementation of a pure Left-Handed (LH) TL includes Right-Hand (RH) propagation inherited from the lump elemental electrical parameters. This composition including LH and RH propagation or modes, results in unprecedented improvements in air interface integration, Over-The-Air (OTA) performance and miniaturization while simultaneously reducing bill of materials (BOM) costs and SAR values. MTMs enable physically small but electrically large air interface components, with minimal coupling among closely spaced devices. MTM antenna structures in some embodiments are copper printed directly on the dielectric substrate and can be fabricated using a conventional FR-4 substrate or a Flexible Printed Circuit (FPC) board.

A metamaterial structure may be a periodic structure with N identical unit cells cascading together where each cell is much smaller than one wavelength at the operational frequency. A metamaterial structure as used herein may be any RF structure to which is applied capacitive coupling at the feed and inductive loading to ground. In this sense, the composition of one metamaterial unit cell is described by an equivalent lumped circuit model having a series inductor ($L_R$), a series capacitor ($C_L$), shunt inductor ($L_L$) and shunt capacitor ($C_R$) where $L_L$ and $C_L$ determine the LH mode propagation properties while $L_R$ and $C_R$ determine the RH mode propagation properties. The behaviors of both LH and RH mode propagation at different frequencies can be easily addressed in a simple dispersion diagram such as described herein below with respect to FIGS. 7A and 7B. In such a dispersion curve, $\beta>0$ identifies the RH mode while $\beta<0$ identifies the LH mode. An MTM device exhibits a negative phase velocity depending on the operating frequency.

The electrical size of a conventional transmission line is related to its physical dimension, thus reducing device size usually means increasing the range of operational frequencies. Conversely, the dispersion curve of a metamaterial structure depends mainly on the value of the four CRLH parameters, $C_L$, $L_L$, $C_R$, $L_R$. As a result, manipulating the dispersion relations of the CRLH parameters enables a small physical RF circuit having electrically large RF signals. This concept has been adopted successfully in small antenna designs.

Balanced antennas, such as dipole antennas have been recognized as one of the most popular solutions for wireless communication systems because of their broadband characteristics and simple structure. They are seen on wireless routers, cellular telephones, automobiles, buildings, ships, aircraft, spacecraft, etc. The dipole device has two mirror-imaged parts and a center feed coupled to a feeding network, and thus structurally called "balanced." The radiation pattern of a dipole antenna is nondirectional in the azimuth plane and directional in the elevation plane. The dipole antenna has a "donut" shaped radiation pattern along the dipole axis and is omnidirectional in the azimuth plane. A balun is typically used to convert signals at a two portions of a balanced antenna to signals at an unbalanced feed port and vice versa. For wireless access points or routers, antennas have omnidirectional radiation patterns and are able to provide increased coverage for existing IEEE 802.11 networks. The omnidirectional antenna offers 360° of expanded coverage, effectively improving data at farther distances. It also helps improve signal quality and reduce dead spots in the wireless coverage, making it ideal for WLAN applications. Typically, however, in small portable devices, such as wireless routers, the relative position between the compact antenna elements and the surrounding ground plane influences the radiation pattern significantly. Antennas without balanced structures, such as, patch antennas or the inverted F planar antenna (PIFA), even though they are compact in terms of size, the surrounding ground planes can easily distort their omnidirectionality. More and more WLAN devices using MIMO technology require multiple antennas, so that the signals from different antennas can be combined to exploit the multipath in the wireless channel and enable higher capacity, better coverage and increased reliability. At the same time, consumer devices continue to shrink in size, which requires the antenna to be designed in a very small dimension. For the conventional dipole antennas or printed dipole antennas, antenna size is dependent on the operational frequency, thus making size reduction a challenging task.

In one embodiment, a compact printed balanced antenna design based on CRLH MTM structures is elaborated using Rayspan MTM-B technology. With CRLH MTM technology embedded, a balanced antenna has a small size, increased efficiency and omni-directionality. The balanced antenna exhibits an omnidirectional radiation pattern in the azimuth plane with or without the presence of the ground plane. Various balanced antenna designs may be printed on a PCB as ultra compact-size antenna structures using a convenient integration solution. Furthermore, these structures may be easily fabricated on a PCB using high volume PCB manufacturing rules. The balanced antenna may be used in a WLAN system line.

In one example, a rectangular-shaped MTM cell patch having a length L (e.g., 8.46 mm) and width W (e.g., 4.3 mm) is capacitively coupled to the launch pad via a coupling gap. The coupling provides the series capacitor or LH capacitor to generate a left hand mode. A metallic via connects the MTM cell patch on the top layer to a thin via line on the bottom layer and finally leads to the bottom ground plane, which provides parallel inductance or LH inductance. The via lines at both portions together form a 180° line to keep the balance of the structure.

In some applications, metamaterial (MTM) and Composite Right and Left Handed (CRLH) structures and components are based on a technology which applies the concept of Left-handed (LH) structures. As used herein, the terms "metamaterial," "MTM," "CRLH," and "CRLH MTM" refer to composite LH and RH structures engineered using conventional dielectric and conductive materials to produce unique electromagnetic properties, wherein such a composite unit cell is much smaller than the free space wavelength of the propagating electromagnetic waves.

Metamaterial technology, as used herein, includes technical means, methods, devices, inventions and engineering works which allow compact devices composed of conductive and dielectric parts and are used to receive and transmit electromagnetic waves. Using MTM technology, antennas and RF components may be made very compactly in comparison to competing methods and may be very closely spaced to each other or to other nearby components while at the same time minimizing undesirable interference and electromagnetic coupling. Such antennas and RF components further exhibit useful and unique electromagnetic behavior that results from one or more of a variety of structures to design, integrate, and optimize antennas and RF components inside wireless communications devices CRLH structures are structures that behave as structures exhibiting simultaneous negative permittivity ($\in$) and negative permeability ($\mu$) in a frequency range and simultaneous positive $\in$ and positive $\mu$ in another frequency range. Transmission-Line (TL) based CRLH structure are structures that enable TL propagation and behave as structures exhibiting simultaneous negative permittivity ($\in$) and negative permeability ($\mu$) in a frequency range and simultaneous positive $\in$ and positive $\mu$ in another frequency range. The CRLH based antennas and TLs may be designed and implemented with and without conventional RF design structures.

Antennas, RF components and other devices made of conventional conductive and dielectric parts may be referred to as "MTM antennas," "MTM components," and so forth, when they are designed to behave as an MTM structure. MTM components may be easily fabricated using conventional conductive and insulating materials and standard manufacturing technologies including but not limited to: printing, etching, and subtracting conductive layers on substrates such as FR4, ceramics, LTCC, MMICC, flexible films, plastic or even paper.

In one embodiment, an innovative metamaterial antenna design emulates the properties of a dipole balanced antenna without requiring the half-wavelength size associated with a dipole antenna. Such an MTM balanced antenna is not only small but also independent of the device ground plane, making it a very attractive solution to use in various devices without changing the basic structure of the antenna device. Such a balanced antenna is applicable to MIMO applications since no coupling occurs at the ground-plane level. Balanced antennas, such as dipole antennas have been recognized as one of the most popular solutions for wireless communication systems because of their broadband characteristics and simple structure. They are seen on wireless routers, cellular telephones, automobiles, buildings, ships, aircraft, spacecraft, etc. The dipole has two mirror-imaged parts and is normally center-fed by a feeding network, thus the structure is referred to as "balanced." The radiation pattern of a dipole antenna is nondirectional in the azimuth plane and directional in the elevation plane.

An example of a conventional antenna includes a monopole antenna, which is a ground plane dependent antenna having a single-ended feed. The length of a monopole conductive trace (a radiating arm) primarily determines the resonant frequency of the antenna. The gain of the antenna varies depending on parameters such as the distance to a ground plane and the size of the ground plane.

Another example of a conventional antenna includes a dipole antenna, which can be regarded as a combination of two mirror-imaged monopoles placed back to back. The dipole antenna is a type of balanced antenna design, and typically has a center-fed element which is driven by a feeding network; and thus a dipole antenna is structurally symmetrical. The radiation pattern has a toroidal shape (doughnut shape) with an axis centering about the dipole, and thus it is approximately omnidirectional in the azimuthal plane. One of the key parameters determining the omnidirectionality of a dipole antenna is the length of the dipole. The toroidal shape radiation pattern is achieved when the length of the dipole is half a wavelength. A dipole antenna can be directly fed with a coaxial cable (coax). However, a coax is not a balanced feeder due to the connection of the coax to different potentials at opposite ends. When a balanced antenna such as the dipole antenna is fed with an unbalanced feeder, common mode currents may cause the feed line to radiate, thereby asymmetrically distorting the radiation pattern, causing RF interferences and reducing antenna efficiency. This problem can be circumvented by using a balun, which converts signals that are balanced about a ground (differential) to signals that are unbalanced (single ended) and vice versa. The size of the dipole antenna is normally large, e.g., half a wavelength, requiring a large amount of allocated space for today's wireless communication systems. Additionally, cross polarization associated with the dipole antenna is inversely related to the size of the dipole antenna. In this way, the cross polarization increases as the size of the dipole decreases, thus limiting the potential size reduction in the area used to support the dipole antenna in a wireless device. Furthermore, when the dipole antenna is placed close to a large ground plane, the radiation pattern is distorted. The radiation pattern and gain of the dipole antenna depend on the size of a ground plane and the distance between the dipole antenna and the ground plane. Thus, there may also be limitations on the proximity of the dipole antenna to a ground plane. A similar scenario may hold true with monopole antennas.

Many conventional printed antennas are smaller than half a wavelength; thus, the size of the ground plane plays an important role in determining their impedance matching and radiation patterns. Furthermore, these antennas may have strong cross polarization components depending on the shape of the ground plane.

In some conventional wireless antenna applications such as wireless access points or routers, antennas exhibit omnidirectional radiation patterns and are able to provide increased coverage for existing IEEE 802.11 networks. The omnidirectional antenna offers 360° of expanded coverage, effectively improving data at farther distances. It also helps improve signal quality and reduce dead spots in the wireless coverage, making it ideal for Wireless Local Area Network (WLAN) applications. Typically however, in small portable devices, such as wireless routers, the relative position between the compact antenna elements and the surrounding ground plane influences the radiation pattern significantly. Antennas without balanced structures, such as, patch antennas or the Planar Inverted F Antenna (PIFA), even though they are compact in terms of size, the surrounding ground planes can easily distort their omnidirectionality.

More and more WLAN devices using MIMO technology require multiple antennas, so that the signals from different antennas can be combined to exploit the multipath in the wireless channel and enable higher capacity, better coverage and increased reliability. At the same time, consumer devices continue to shrink in size, which requires the antenna to be designed in a very small dimension. For the conventional dipole antennas or printed dipole antennas, antenna size is strongly dependent on the operational frequency, thus making the size reduction a challenging task.

CRLH structures can be used to construct antennas, transmission lines and other RF components and devices, allowing for a wide range of technology advancements such as functionality enhancements, size reduction and performance improvements. Unlike conventional antennas, the MTM antenna resonances are affected by the presence of the Left-Handed (LH) mode. In general, the LH mode helps excite and better match the low frequency resonances as well as improves the matching of high frequency resonances. These MTM antenna structures can be fabricated by using a conventional FR-4 Printed Circuit Board (PCB) or a Flexible Printed Circuit (FPC) board. Examples of other fabrication techniques include thin film fabrication technique, System On Chip (SOC) technique, Low Temperature Co-fired Ceramic (LTCC) technique, and Monolithic Microwave Integrated Circuit (MMIC) technique.

In view of the above problems associated with certain balanced antennas using dipoles or conventional printed antennas, this application provides several balanced antenna devices, based on CRLH structures, that generates substantially omnidirectional radiation patterns with a small size and small cross polarizations, and are relatively unaffected by the presence of a ground plane.

CRLH Metamaterial Structures

The basic structural elements of a CRLH MTM antenna is provided in this disclosure as a review and serve to describe fundamental aspects of CRLH antenna structures used in a balanced MTM antenna device. For example, the one or more antennas in the above and other antenna devices described in this document may be in various antenna structures, including right-handed (RH) antenna structures and CRLH structures. In a right-handed (RH) antenna structure, the propagation of electromagnetic waves obeys the right-hand rule for the (E, H, β) vector fields, considering the electrical field E, the magnetic field H, and the wave vector β (or propagation constant). The phase velocity direction is the same as the direction of the signal energy propagation (group velocity) and the refractive index is a positive number. Such materials are referred to as Right Handed (RH) materials. Most natural materials are RH materials. Artificial materials can also be RH materials.

A metamaterial may be an artificial structure or, as detailed hereinabove, an MTM component may be designed to behave as an artificial structure. In other words, the equivalent circuit describing the behavior and electrical composition of the component is consistent with that of an MTM. When designed with a structural average unit cell size ρ much smaller than the wavelength λ of the electromagnetic energy guided by the metamaterial, the metamaterial can behave like a homogeneous medium to the guided electromagnetic energy. Unlike RH materials, a metamaterial can exhibit a negative refractive index, and the phase velocity direction may be opposite to the direction of the signal energy propagation wherein the relative directions of the (E, H, β) vector fields follow the left-hand rule. Metamaterials having a negative index of refraction and have simultaneous negative permittivity ∈ and permeability μ are referred to as pure Left Handed (LH) metamaterials.

Many metamaterials are mixtures of LH metamaterials and RH materials and thus are CRLH metamaterials. A CRLH metamaterial can behave like an LH metamaterial at low frequencies and an RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials may be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

Metamaterial structures may be used to construct antennas, transmission lines and other RF components and devices, allowing for a wide range of technology advancements such as functionality enhancements, size reduction and performance improvements. An MTM structure has one or more MTM unit cells. As discussed above, the lumped circuit model equivalent circuit for an MTM unit cell includes an RH series inductance $L_R$, an RH shunt capacitance $C_R$, an LH series capacitance $C_L$, and an LH shunt inductance $L_L$. The MTM-based components and devices can be designed based on these CRLH MTM unit cells that can be implemented by using distributed circuit elements, lumped circuit elements or a combination of both. Unlike conventional antennas, the MTM antenna resonances are affected by the presence of the LH mode. In general, the LH mode helps excite and better match the low frequency resonances as well as improves the matching of high frequency resonances. The MTM antenna structures can be configured to support multiple frequency bands including a "low band" and a "high band." The low band includes at least one LH mode resonance and the high band includes at least one RH mode resonance associated with the antenna signal.

Some examples and implementations of MTM antenna structures are described in the U.S. patent application Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. These MTM antenna structures may be fabricated by using a conventional FR-4 Printed Circuit Board (PCB) or a Flexible Printed Circuit (FPC) board.

One type of MTM antenna structure is a Single-Layer Metallization (SLM) MTM antenna structure, wherein the conductive portions of the MTM structure are positioned in a single metallization layer formed on one side of a substrate. In this way, the CRLH components of the antenna are printed onto one surface or layer of the substrate. For a SLM device, the capacitively coupled portion and the inductive load portions are both printed onto a same side of the substrate.

A Two-Layer Metallization Via-Less (TLM-VL) MTM antenna structure is another type of MTM antenna structure having two metallization layers on two parallel surfaces of a substrate. A TLM-VL does not have conductive vias connecting conductive portions of one metallization layer to conductive portions of the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008, the disclosure of which is incorporated herein by reference.

FIG. 1 illustrates an example of a 1-dimensional (1D) CRLH MTM transmission line (TL) based on four unit cells. One unit cell includes a cell patch and a via, and is a building block for constructing a desired MTM structure. The illustrated TL example includes four unit cells formed in two conductive metallization layers of a substrate where four conductive cell patches are formed on the top conductive metallization layer of the substrate and the other side of the substrate has a metallization layer as the ground electrode. Four centered conductive vias are formed to penetrate through the substrate to connect the four cell patches to the ground plane, respectively. The unit cell patch on the left side is electromagnetically coupled to a first feed line and the unit cell patch on the right side is electromagnetically coupled to a second feed line. In some implementations, each unit cell patch is electromagnetically coupled to an adjacent unit cell patch without being directly in contact with the adjacent unit cell. This structure forms the MTM transmission line to receive an RF signal from one feed line and to output the RF signal at the other feed line.

Figure 2:
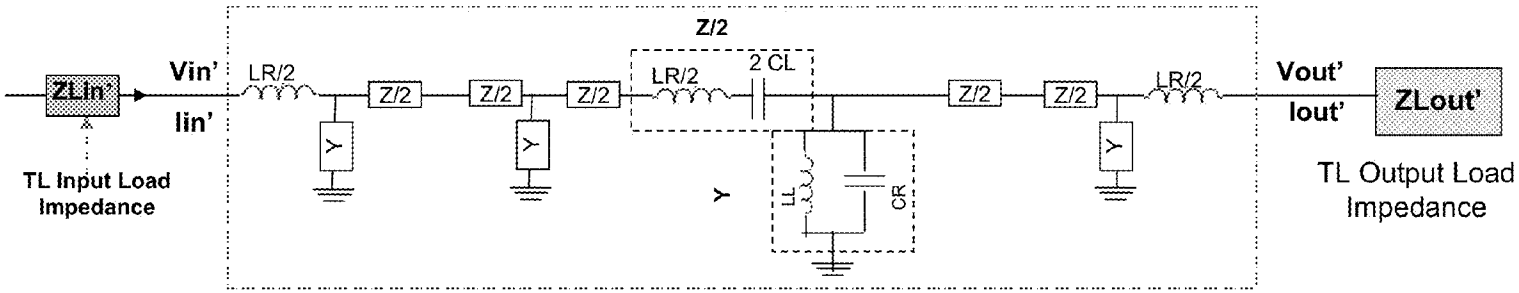

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. $L_R$ is due to the cell patch and the first feed line on the dielectric substrate, and $C_R$ is due to the dielectric substrate being sandwiched between the cell patch and the ground plane. $C_L$ is due to the presence of two adjacent cell patches, and the via induces $L_L$.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of $L_L$ and $C_R$. The relationships among these parameters are expressed as follows:

$$\omega_{SH} = \frac{1}{\sqrt{L_L\ C_R}};\ \omega_{SE} = \frac{1}{\sqrt{L_R\ C_L}};$$

$$\omega_R = \frac{1}{\sqrt{L_R\ C_R}};\ \omega_L = \frac{1}{\sqrt{L_L\ C_L}}$$

where, $$Z = j\omega L_R + \frac{1}{j\omega C_L} \text{ and } Y = j\omega C_R + \frac{1}{j\omega L_L}. \quad \text{Eq. (1)}$$

The two unit cells at the input/output edges in FIG. 1 do not include $C_L$, since $C_L$ represents the capacitance between two adjacent cell patches and is missing at these input/output edges. The absence of the $C_L$ portion at the edge unit cells prevents $\omega_{SE}$ frequency from resonating. Therefore, only $\omega_{SH}$ appears as an m=0 resonance frequency.

Figure 3:
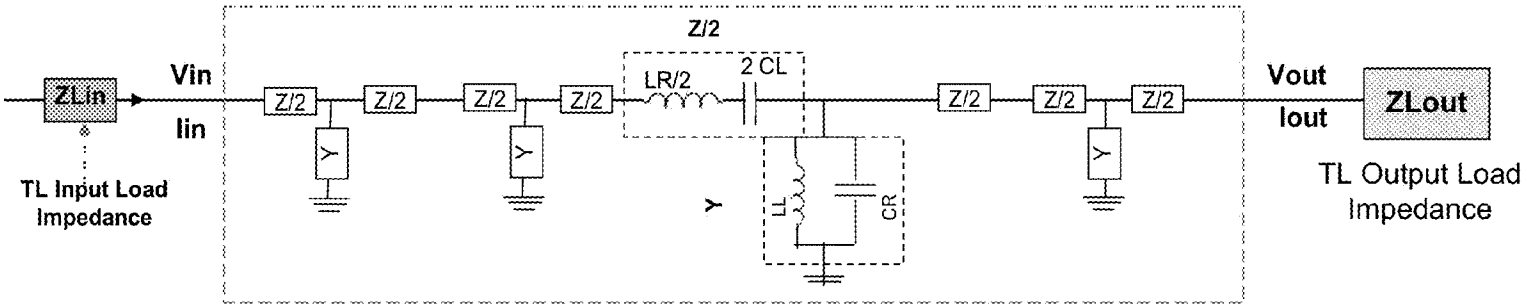

To simplify the computational analysis, a portion of the ZLin' and ZLout' series capacitor is included to compensate for the missing $C_L$ portion, and the remaining input and output load impedances are denoted as ZLin and ZLout, respectively, as seen in FIG. 3. Under this condition, ideally the unit cells have identical parameters as represented by two series Z/2 blocks and one shunt Y block in FIG. 3, where the Z/2 block includes a series combination of $L_R/2$ and $2C_L$, and the Y block includes a parallel combination of $L_L$ and $C_R$.

Figure 4A:
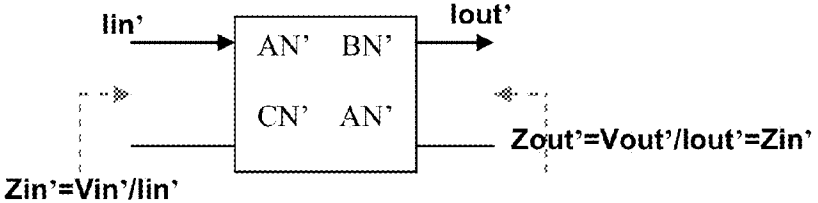
FIG. 4A illustrates a two-port network matrix representation for a one dimensional composite right and left handed metamaterial transmission line equivalent circuit as in FIG. 2, according to an example embodiment.
Figure 4B:
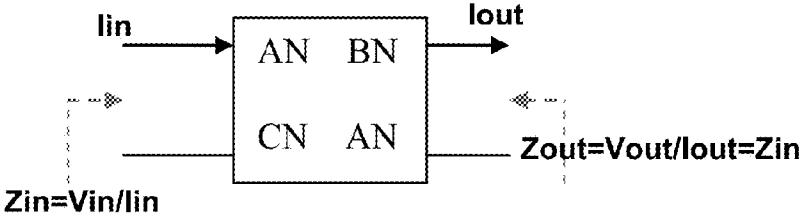
FIG. 4B illustrates a two-port network matrix representation for a one dimensional composite right and left handed metamaterial transmission line equivalent circuit as in FIG. 3, according to an example embodiment.

FIG. 4A and FIG. 4B illustrate a two-port network matrix representation for TL circuits without the load impedances as shown in FIG. 2 and FIG. 3, respectively. The matrix coefficients describing the input-output relationship are provided.

Figure 5:
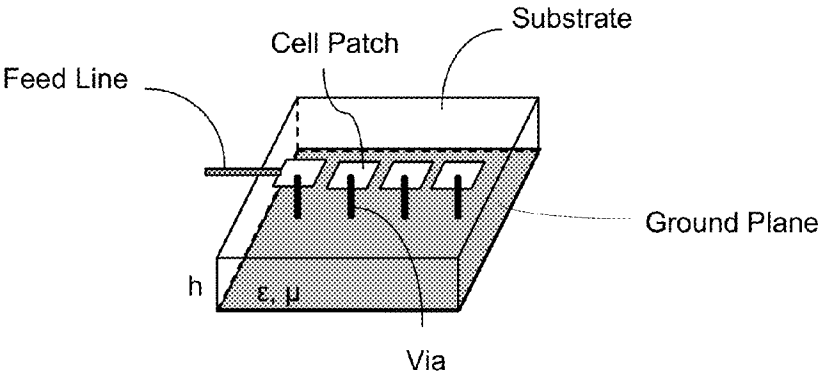
FIG. 5 illustrates a one dimensional composite right and left handed metamaterial antenna based on four unit cells, according to an example embodiment.

FIG. 5 illustrates an example of a 1D CRLH MTM antenna based on four unit cells. Different from the 1D CRLH MTM TL in FIG. 1, the antenna in FIG. 5 couples the unit cell on the left side to a feed line to connect the antenna to a antenna circuit and the unit cell on the right side is an open circuit so that the four cells interface with the air to transmit or receive an RF signal.

Figure 6A:
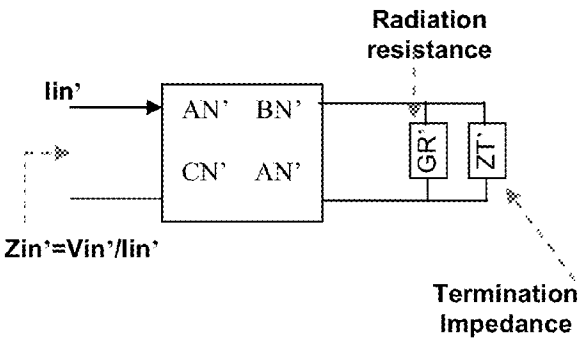
FIG. 6A illustrates a two-port network matrix representation for a one dimensional composite right and left handed metamaterial antenna equivalent circuit analogous to a transmission line case as in FIG. 4A, according to an example embodiment.
Figure 6B:
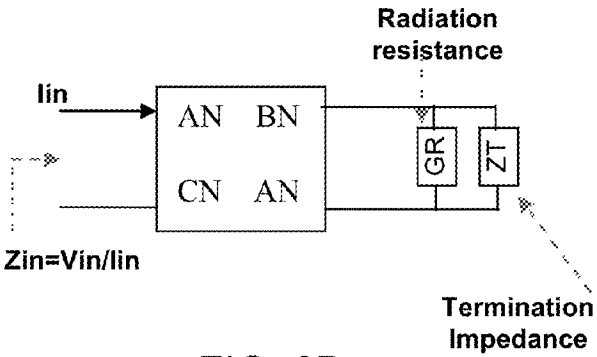
FIG. 6B illustrates a two-port network matrix representation for a one dimensional composite right and left handed metamaterial antenna equivalent circuit analogous to a TL case as in FIG. 4B, according to an example embodiment.

FIG. 6A shows a two-port network matrix representation for the antenna circuit in FIG. 5. FIG. 6B shows a two-port network matrix representation for the antenna circuit in FIG. 5 with the modification at the edges to account for the missing $C_L$ portion to have all the unit cells identical. FIGS. 6A and 6B are analogous to the TL circuits shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix}, \quad \text{Eq. (2)}$$

where AN=DN because the CRLH MTM TL circuit in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional $2C_L$ as expressed below:

$$ZLin' = ZLin + \frac{2}{j\omega CL},$$

$$ZLout' = ZLout + \frac{2}{j\omega CL}, \quad \text{Eq. (3)}$$

$$ZT' = ZT + \frac{2}{j\omega CL}.$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (1) are valid for the circuit in FIG. 2 with the modified values AN', BN', and CN', which reflect the missing $C_L$ portion at the two edges.

The frequency bands can be determined from the dispersion equation derived by letting the N CRLH cell structure resonate with $n\pi$ propagation phase length, where n=0, ±1, ±2, . . . ±N. Here, each of the N CRLH cells is represented by Z and Y in Eq. (1), which is different from the structure shown in FIG. 2, where $C_L$ is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N),\ \Rightarrow |A_N| \le 1 \Rightarrow -\le \chi = -ZY \le 4\forall N \\ \text{where } A_N = 1 \text{ at even resonances } |n| = 2m \in \left\{0, 2, 4, \ldots\ 2\times \text{Int}\left(\frac{N-1}{2}\right)\right\} \\ \text{and } A_N = -1 \text{ at odd resonances } |n| = 2m+1 \in \left\{1, 3, \ldots\ \left(2\times \text{Int}\left(\frac{N}{2}\right)-1\right)^5\right\}, \end{cases} \quad \text{Eq. (4)}$$

where Z and Y are given in Eq. (1), AN is derived from the linear cascade of N identical CRLH unit cells as in FIG. 3, and p is the cell size. Odd n=(2m+1) and even n=2m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of $C_L$ at the end cells, regardless of the number of cells. Higher-order frequencies are given by the following equations for the different values of $\chi$ specified in Table 1:

For $n > 0$, Eq. (5)

$$\omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 + \chi\omega_R^2}{2}\right)^2 - \omega_{SH}^2\omega_{SE}^2}.$$

Table 1 provides $\chi$ values for N=1, 2, 3, and 4. It should be noted that the higher-order resonances |n|>0 are the same regardless if the full $C_L$ is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as stated in Eq. (4).

TABLE 1

Resonances for N = 1, 2, 3 and 4 cells

| N | Modes \|n\| = 0 | \|n\| = 1 | \|n\| = 2 | \|n\| = 3 |
|---|---|---|---|---|
| N = 1 | $\chi_{(1,0)} = 0$; $\omega_0 = \omega_{SH}$ | | | |
| N = 2 | $\chi_{(2,0)} = 0$; $\omega_0 = \omega_{SH}$ | $\chi_{(2,1)} = 2$ | | |
| N = 3 | $\chi_{(3,0)} = 0$; $\omega_0 = \omega_{SH}$ | $\chi_{(3,1)} = 1$ | $\chi_{(3,2)} = 3$ | |
| N = 4 | $\chi_{(4,0)} = 0$; $\omega_0 = \omega_{SH}$ | $\chi_{(4,1)} = 2 - \sqrt{2}$ | $\chi_{(4,2)} = 2$ | |

Figure 7A:
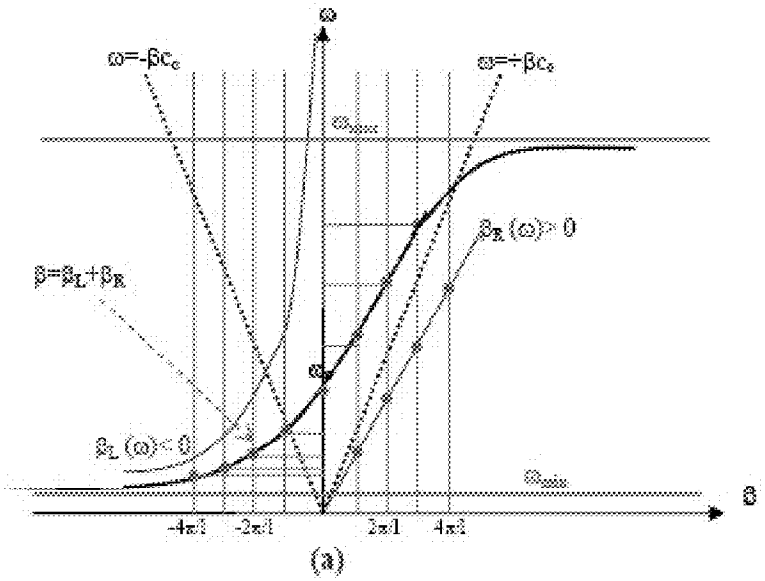
FIGS. 7A and 7B are dispersion curves of a unit cell as in FIG. 2 considering balanced and unbalanced cases, respectively, according to an example embodiment.
Figure 7B:
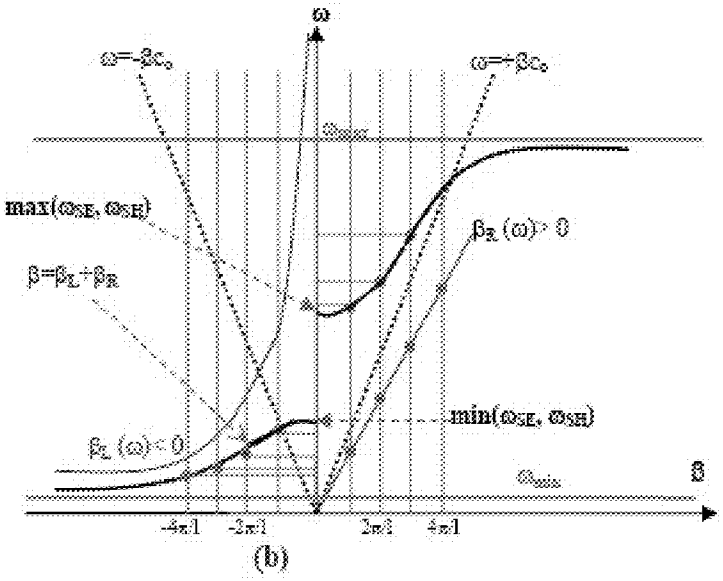

The CRLH dispersion curve $\beta$ for a unit cell as a function of frequency $\omega$ is illustrated in FIGS. 7A and 7B for the $\omega_{SE}=\omega_{SE}$ (balanced, i.e., $L_R C_L = L_L C_R$) and $\omega_{SE}\neq\omega_{SH}$ (unbalanced) cases, respectively. In the latter case, there is a frequency gap between min($\omega_{SE}$, $\omega_{SH}$) and max ($\omega_{SE}$, $\omega_{SH}$). The limiting frequencies $\omega_{min}$ and $\omega_{max}$ values are given by the same resonance equations in Eq. (5) with $\chi$ reaching its upper bound $\chi$=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \tag{6}$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}\,.$$

In addition, FIGS. 7A and 7B provide examples of the resonance position along the dispersion curves. In the RH region (n>0) the structure size 1=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper. Thus, the first condition to obtain broadbands, $1^{st}$ BB condition, can be expressed as follows:

$$COND1\text{: } 1^{st}BB \text{ condition } \left|\frac{d\beta}{d\omega}\right|_{res} = \tag{Eq. (7)}$$

$$\left|-\frac{\frac{d(AN)}{d\omega}}{\sqrt{(1-AN^2)}}\right|_{res} << 1 \text{ near } \omega = \omega_{res} = \omega_0, \omega_{\pm1}, \omega_{\pm2} \ldots \Rightarrow$$

$$\left|\frac{d\beta}{d\omega}\right| = \left|\frac{\frac{d\chi}{d\omega}}{2p\sqrt{\chi\left(1-\frac{\chi}{4}\right)}}\right|_{res} << 1 \text{ with } p =$$

$$\text{cell size and } \left.\frac{d\chi}{d\omega}\right|_{res} = \frac{2\omega_{\pm n}}{\omega_R^2}\left(1 - \frac{\omega_{SE}^2\omega_{SH}^2}{\omega_{\pm n}^4}\right),$$

where $\chi$ is given in Eq. (4) and $\omega_R$ is defined in Eq. (1). The dispersion relation in Eq. (4) indicates that resonances occur when |AN|=1, which leads to a zero denominator in the $1^{st}$ BB condition (COND1) of Eq. (7). As a reminder, AN is the first transmission matrix entry of the N identical unit cells (FIG. 4B and FIG. 6B). The calculation shows that COND1 is indeed independent of N and given by the second equation in Eq. (7). It is the values of the numerator and $\chi$ at resonances, which are shown in Table 1, that define the slopes of the dispersion curves, and hence possible bandwidths. Targeted structures are at most Np=$\lambda$/40 in size with the bandwidth exceeding 4%. For structures with small cell sizes p, Eq. (7) indicates that high $\omega_R$ values satisfy COND1, i.e., low $C_R$ and $L_R$ values, since for n<0 resonances occur at $\chi$ values near 4 in Table 1, in other terms ($1-\chi/4\rightarrow 0$).

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL circuit in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1 - \frac{\chi}{4}\right), \tag{Eq. (8)}$$

which has only positive real values. One reason that B1/C1 is greater than zero is due to the condition of |AN|≤1 in Eq. (4), which leads to the following impedance condition:

$$0 \leq -ZY = \chi \leq 4.$$

The $2^{nd}$ broadband (BB) condition is for Zin to slightly vary with frequency near resonances in order to maintain constant matching. Remember that the real input impedance Zin' includes a contribution from the $C_L$ series capacitance as stated in Eq. (3). The $2^{nd}$ BB condition is given below:

$$COND2\text{: } 2^{ed}BB \text{ condition near resonances, } \left.\frac{dZin}{d\omega}\right|_{near\ res} << 1. \tag{Eq. (9)}$$

Different from the transmission line example in FIG. 2 and FIG. 3, antenna designs have an open-ended side with an infinite impedance which poorly matches the structure edge impedance. The capacitance termination is given by the equation below:

$$Z_T = \frac{AN}{CN}, \tag{Eq. (10)}$$

which depends on N and is purely imaginary. Since LH resonances are typically narrower than RH resonances, selected matching values are closer to the ones derived in the n<0 region than the n>0 region.

One method to increase the bandwidth of LH resonances is to reduce the shunt capacitor CR. This reduction can lead to higher $\omega_R$ values of steeper dispersion curves as explained in Eq. (7). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The MTM TL and antenna structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground electrode outside the footprint of the cell patch. This truncated ground approach may be implemented in various configurations to achieve broadband resonances.

Figure 8:
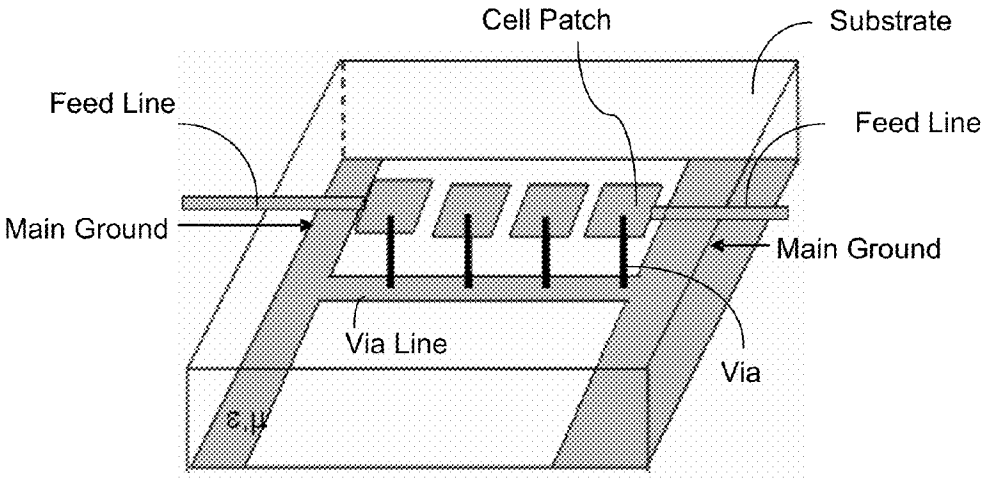
FIG. 8 illustrates a one dimensional composite right and left handed metamaterial transmission line with a truncated ground based on four unit cells, according to an example embodiment.
Figure 9:
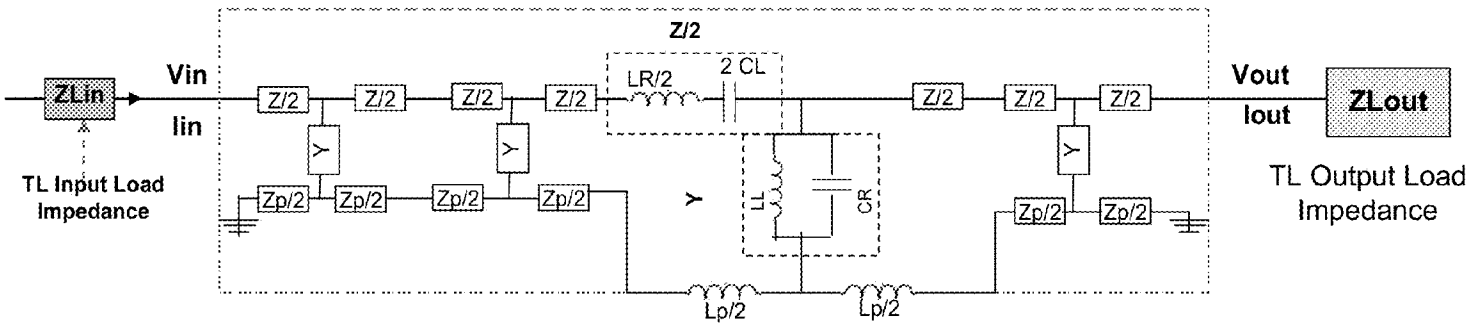
FIG. 9 illustrates an equivalent circuit of a one dimensional composite right and left handed metamaterial transmission line with the truncated ground as in FIG. 8, according to an example embodiment.
Figure 10:
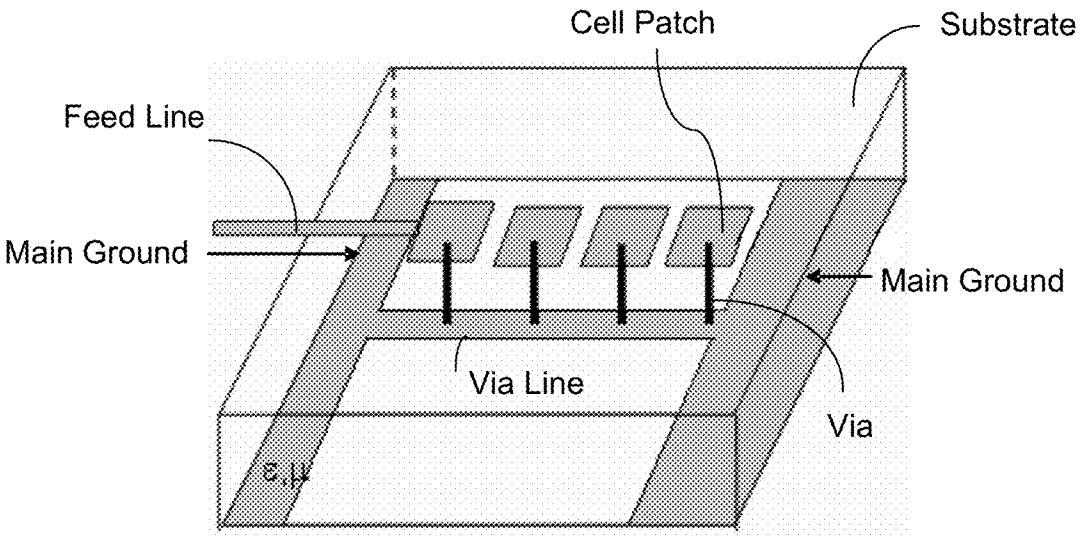
FIG. 10 illustrates an example of a one dimensional composite right and left handed metamaterial antenna with a truncated ground based on four unit cells, according to an example embodiment.

FIG. 8 illustrates one example of a truncated ground electrode for a four-cell MTM transmission line where the ground electrode has a dimension that is less than the cell patch along one direction underneath the cell patch. The ground conductive layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

Figure 11:
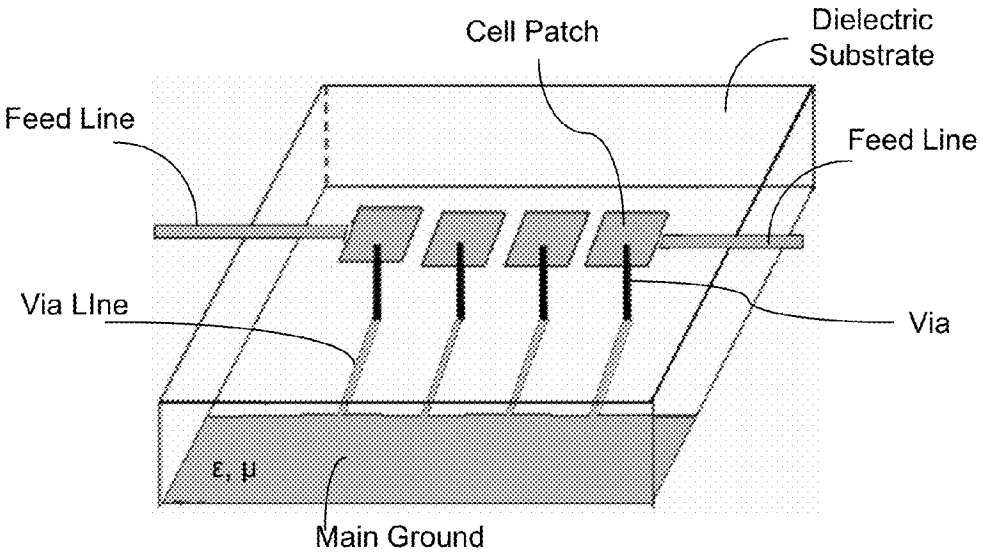
FIG. 11 illustrates another example of a one dimensional composite right and left handed metamaterial transmission line with a truncated ground based on four unit cells, according to an example embodiment.

FIG. 11 illustrates another example of a MTM antenna having a truncated ground structure. In this example, the ground conductive layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, the shunt capacitance $C_R$ becomes small, and the resonances follow the same equations as in Eqs. (1), (5) and (6) and Table 1. Two approaches are presented. FIGS. 8 and 9 represent the first approach, Approach 1, wherein the resonances are the same as in Eqs. (1), (5) and (6) and Table 1 after replacing $L_R$ by (LR+Lp). For $|n|\neq 0$, each mode has two resonances corresponding to (1) $\omega\pm n$ for $L_R$ being replaced by ($L_R$+Lp) and (2) $\omega\pm n$ for $L_R$ being replaced by ($L_R$+Lp/N) where N is the number of unit cells. Under this Approach 1, the impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \quad \text{Eq. (11)}$$

$$\text{where } \chi = -YZ \text{ and } \chi = -YZ_P,$$

where Zp=jωLp and Z, Y are defined in Eq. (2). The impedance equation in Eq. (11) provides that the two resonances ω and ω' have low and high impedances, respectively. Thus, it is easy to tune near the ω resonance in most cases.

Figure 12:
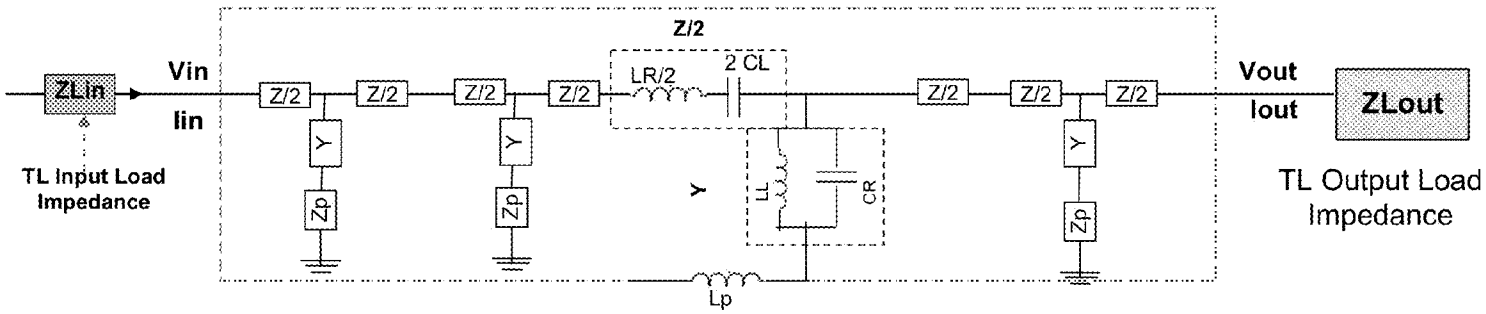
FIG. 12 illustrates an equivalent circuit of the one dimensional composite right and left handed metamaterial transmission line with the truncated ground as in FIG. 11, according to an example embodiment.

The second approach, Approach 2, is illustrated in FIGS. 11 and 12 and the resonances are the same as in Eqs. (1), (5), and (6) and Table 1 after replacing $L_L$ by ($L_L$+Lp). In the second approach, the combined shunt inductor ($L_L$+Lp) increases while the shunt capacitor $C_R$ decreases, which leads to lower LH frequencies.

The above exemplary MTM structures are formed on two metallization layers and one of the two metallization layers is used as the ground electrode and is connected to the other metallization layer through a conductive via. Such two-layer CRLH MTM TLs and antennas with a via can be constructed with a full ground electrode as shown in FIGS. 1 and 5 or a truncated ground electrode as shown in FIGS. 8 and 10.

In one embodiment, an SLM MTM structure includes a substrate having a first substrate surface and an opposite substrate surface, a metallization layer formed on the first substrate surface and patterned to have two or more conductive portions to form the SLM MTM structure without a conductive via penetrating the dielectric substrate. The conductive portions in the metallization layer include a cell patch of the SLM MTM structure, a ground that is spatially separated from the cell patch, a via line that interconnects the ground and the cell patch, and a feed line that is capacitively coupled to the cell patch without being directly in contact with the cell patch. The LH series capacitance $C_L$ is generated by the capacitive coupling through the gap between the feed line and the cell patch. The RH series inductance $L_R$ is mainly generated in the feed line and the cell patch. There is no dielectric material vertically sandwiched between the two conductive portions in this SLM MTM structure. As a result, the RH shunt capacitance $C_R$ of the SLM MTM structure may be designed to be negligibly small. A small RH shunt capacitance $C_R$ can still be induced between the cell patch and the ground, both of which are in the single metallization layer. The LH shunt inductance $L_L$ in the SLM MTM structure is negligible due to the absence of the via penetrating the substrate, but the via line connected to the ground can generate inductance equivalent to the LH shunt inductance $L_L$. A TLM-VL MTM antenna structure may have the feed line and the cell patch positioned in two different layers to generate vertical capacitive coupling.

Different from the SLM and TLM-VL MTM antenna structures, a multilayer MTM antenna structure has conductive portions in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008, the disclosure of which is incorporated herein by reference. These multiple metallization layers are patterned to have multiple conductive portions based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures may implement at least one conductive via to connect one conductive portion in one metallization layer to another conductive portion in another metallization layer. This allows connection of one conductive portion in one metallization layer to another conductive portion in the other metallization layer.

An implementation of a double-layer MTM antenna structure with a via includes a substrate having a first substrate surface and a second substrate surface opposite to the first surface, a first metallization layer formed on the first substrate surface, and a second metallization layer formed on the second substrate surface, where the two metallization layers are patterned to have two or more conductive portions with at least one conductive via connecting one conductive portion in the first metallization layer to another conductive portion in the second metallization layer. A truncated ground can be formed in the first metallization layer, leaving part of the surface exposed. The conductive portions in the second metallization layer can include a cell patch of the MTM structure and a feed line, the distal end of which is located close to and capacitively coupled to the cell patch to transmit an antenna signal to and from the cell patch. The cell patch is formed in parallel with at least a portion of the exposed surface. The conductive portions in the first metallization layer include a via line that connects the truncated ground in the first metallization layer and the cell patch in the second metallization layer through a via formed in the substrate. The LH series capacitance $C_L$ is generated by the capacitive coupling through the gap between the feed line and the cell patch. The RH series inductance $L_R$ is mainly generated in the feed line and the cell patch. The LH shunt inductance $L_L$ is mainly induced by the via and the via line. The RH shunt capacitance $C_R$ is mainly induced between the cell patch in the second metallization layer and a portion of the via line in the footprint of the cell patch projected onto the first metallization layer. An additional conductive line, such as a meander line, can be attached to the feed line to induce an RH monopole resonance to support a broadband or multiband antenna operation.

Examples of various frequency bands that can be supported by MTM antennas include frequency bands for cell phone and mobile device applications, WiFi applications, WiMax applications and other wireless communication applications. Examples of the frequency bands for cell phone and mobile device applications are: the cellular band (824-960 MHz) which includes two bands, CDMA (824-894 MHz) and GSM (880-960 MHz) bands; and the PCS/DCS band (1710-2170 MHz) which includes three bands, DCS (1710-1880 MHz), PCS (1850-1990 MHz) and AWS/WCDMA (2110-2170 MHz) bands.

A CRLH structure can be specifically tailored to comply with requirements of an application, such as PCB spatial constraints and layout factors, device performance requirements and other specifications. The cell patch in the CRLH structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. The distal end of the feed line can be modified to form a launch pad to modify the capacitive coupling. Other capacitive coupling techniques may include forming a vertical coupling gap between the cell patch and the launch pad. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad in which this additional conductive line can have a variety of geometrical shapes and dimensions, including, for example, rectangular, irregular, zigzag, planar spiral, vertical spiral, meander, or combinations of different shapes. The additional conductive line can be placed in the top, mid or bottom layer, or a few millimeters above the substrate.

Another type of MTM antenna includes non-planar MTM antennas. Such non-planar MTM antenna structures arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device. For example, one or more antenna sections of the MTM antenna can be located on a dielectric substrate while placing one or more other antenna sections of the MTM antenna on another dielectric substrate so that the antenna sections of the MTM antenna are spatially distributed in a non-planar configuration such as an L-shaped antenna configuration. In various applications, antenna portions of an MTM antenna can be arranged to accommodate various parts in parallel or non-parallel layers in a three-dimensional (3D) substrate structure. Such non-planar MTM antenna structures may be wrapped inside or around a product enclosure. The antenna sections in a non-planar MTM antenna structure can be arranged to engage to an enclosure, housing walls, an antenna carrier, or other packaging structures to save space. In some implementations, at least one antenna section of the non-planar MTM antenna structure is placed substantially parallel with and in proximity to a nearby surface of such a packaging structure, where the antenna section can be inside or outside of the packaging structure. In some other implementations, the MTM antenna structure can be made conformal to the internal wall of a housing of a product, the outer surface of an antenna carrier or the contour of a device package. Such non-planar MTM antenna structures can have a smaller footprint than that of a similar MTM antenna in a planar configuration and thus can be fit into a limited space available in a portable communication device such as a cellular phone. In some non-planar MTM antenna designs, a swivel mechanism or a sliding mechanism can be incorporated so that a portion or the whole of the MTM antenna can be folded or slid in to save space while unused. Additionally, stacked substrates may be used with or without a dielectric spacer to support different antenna sections of the MTM antenna and incorporate a mechanical and electrical contact between the stacked substrates to utilize the space above the main board.

Non-planar, 3D MTM antennas can be implemented in various configurations. For example, the MTM cell segments described herein may be arranged in non-planar, 3D configurations for implementing a design having tuning elements formed near various MTM structures. U.S. patent application Ser. No. 12/465,571 filed on May 13, 2009 and entitled "Non-Planar Metamaterial Antenna Structures", for example, discloses 3D antennas structure that can implement tuning elements near MTM structures. The entire disclosure of the application Ser. No. 12/465,571 is incorporated by reference as part of the disclosure of this document.

In one aspect, the application Ser. No. 12/465,571 discloses an antenna device to include a device housing comprising walls forming an enclosure and a first antenna part located inside the device housing and positioned closer to a first wall than other walls, and a second antenna part. The first antenna part includes one or more first antenna components arranged in a first plane close to the first wall. The second antenna part includes one or more second antenna components arranged in a second plane different from the first plane. This device includes a joint antenna part connecting the first and second antenna parts so that the one or more first antenna components of the first antenna section and the one or more second antenna components of the second antenna part are electromagnetically coupled to form a CRLH MTM antenna supporting at least one resonance frequency in an antenna signal and having a dimension less than one half of one wavelength of the resonance frequency. In another aspect, the application Ser. No. 12/465,571 discloses an antenna device structured to engage a packaging structure. This antenna device includes a first antenna section configured to be in proximity to a first planar section of the packaging structure and the first antenna section includes a first planar substrate, and at least one first conductive portion associated with the first planar substrate. A second antenna section is provided in this device and is configured to be in proximity to a second planar section of the packaging structure. The second antenna section includes a second planar substrate, and at least one second conductive portion associated with the second planar substrate. This device also includes a joint antenna section connecting the first and second antenna sections. The at least one first conductive portion, the at least one second conductive portion and the joint antenna section collectively form a CRLH MTM structure to support at least one frequency resonance in an antenna signal. In yet another aspect, the application Ser. No. 12/465,571 discloses an antenna device structured to engage to an packaging structure and including a substrate having a flexible dielectric material and two or more conductive portions associated with the substrate to form a CRLH MTM structure configured to support at least one frequency resonance in an antenna signal. The CRLH MTM structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

Single Band Balanced MTM Antenna with Via Line Connected to a Ground

Certain balanced antenna devices, based on CRLH structures, may be built to form a compact antenna having a balanced structure and approximately omnidirectional characteristics. In terms of antenna performance, these devices can be structured to perform substantially independent of signal interference caused by a proximate ground plane. As described above, conventional antennas, such as the dipole antenna, based on simple wire designs may be used in balanced antenna designs. Dipole antennas whose length is half the wavelength of the signal are called half-wave dipoles, and are typically more efficient than other at other fractional wavelengths. The half-wave dipole antenna has a physical length that is inversely proportional to the center frequency, making it smaller at higher frequency or larger at lower frequencies. Thus, smaller dipole antenna designs at the lower frequencies are often difficult to achieve. In addition, the cross polarization associated with the dipole antenna typically increases as the size of the antenna decreases, limiting the performance of the dipole antenna. In other antenna designs, small antenna devices can be formed using conventional antenna designs without balanced structures, e.g., a patch antenna or a PIFA. However, when these types of antennas are placed close to a ground plane, the resulting radiation patterns are typically distorted and influenced by the size of the ground plane and the distance between the antenna and the ground plane. Thus, there may be a limitation on how close the conventional patch antenna or PIFA can be placed to a ground plane and the size of the ground plane itself without affecting the performance of these smaller types of conventional antennas. Unlike the conventional dipole, monopole, patch or PIFA antennas, balanced MTM antenna devices may be designed smaller and have omnidirectional radiation patterns that are substantially independent of a nearby ground plane. This document describes several balanced MTM antenna devices which include antennas based on CRLH structures and incorporating balun devices. In addition, antenna performance results are provided for various balanced MTM antenna device configurations including, for example, various ground plane conditions and antenna orientations.

Figures 13A, 13B:
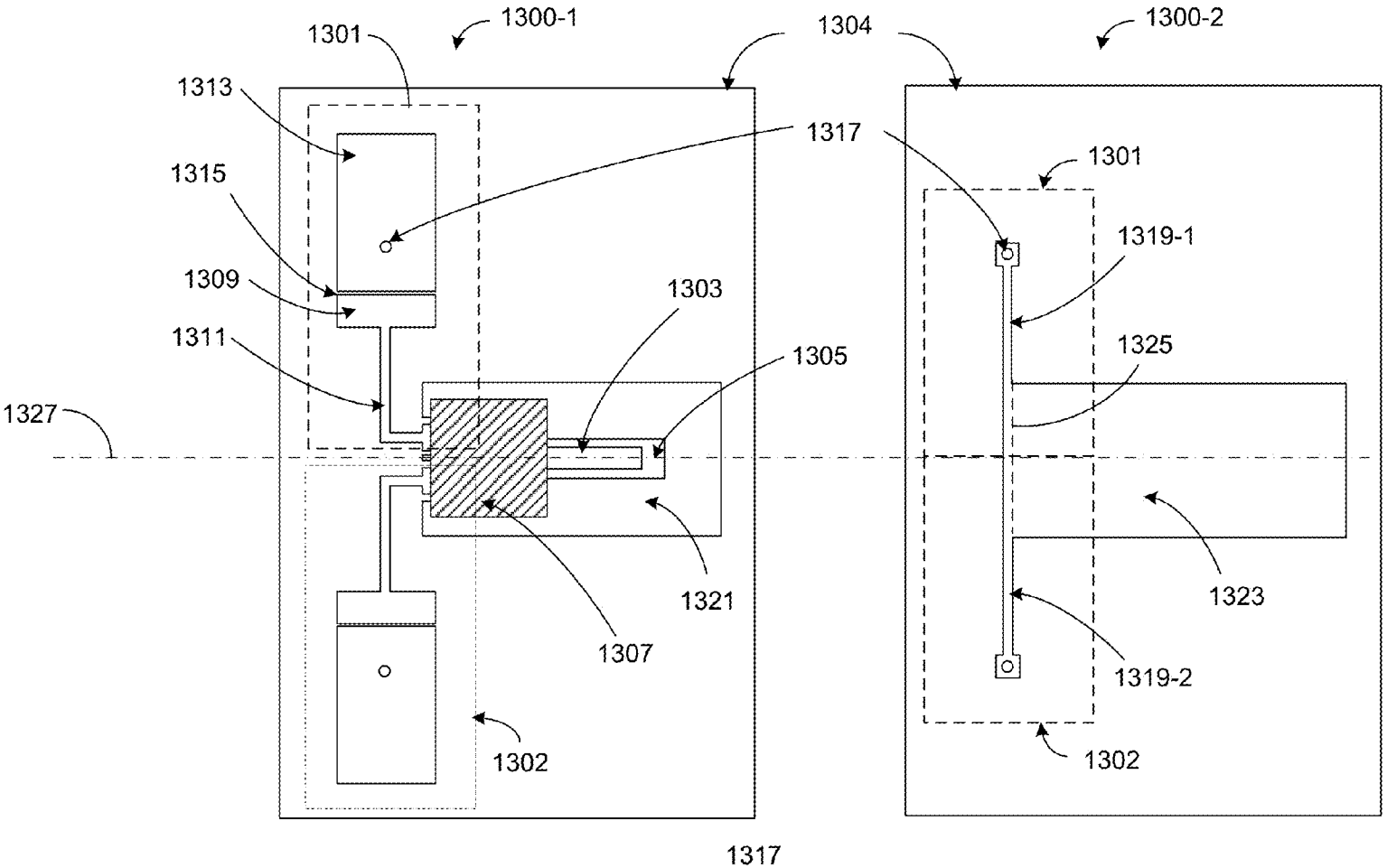
FIGS. 13A and 13B respectively illustrate a top view of a top layer and a top view of a bottom layer of an balanced MTM antenna device, according to an example embodiment.

One embodiment of a balanced MTM antenna device 1300 is provided in FIGS. 13A and 13B, which respectively illustrates a top view of a top layer 1300-1 and a top view of a bottom layer 1300-2 of the antenna device 1300. The antenna device 1300 may be include conductive elements formed in the top layer 1300-1 of the top surface of a substrate 1304, such as FR-4, and conductive elements formed in the bottom layer 1300-2 of the bottom surface of the substrate 1304. In order to feed power to the antenna device 1300, the antenna device 1300 may be connected to a transmission line such as a coax cable. The current distribution along an antenna portion of the antenna device 1300 is generally determined by its shape and size. Depending on the geometry of the antenna, current can be essentially zero at the end of the antenna portion and the current may take on a sinusoidal distribution along the lengthwise portion of the antenna. In a balanced antenna design, two antennas may be engineered and configured to be symmetric and center fed so that the current on both antennas has the same magnitude, but in opposite directions, hence the term balanced is used.

Referring to FIG. 13A, the antenna device 1300 includes two radiating CRLH antenna portions, ANT1 1301 and ANT2 1302, which are based on CRLH structures and include conductive elements that are symmetric to one another along an axis 1327 (dash-dotted line) and configured to be balanced, a CPW feed 1303 connected to a feed port 1305, and a balun 1307 coupling the balanced pair of CRLH antenna portions 1301, 1302 and the unbalanced feed port 1305. Each CRLH antenna portion, ANT1 1301 and ANT2 1302, includes a feed line 1311 having one end that is connected to the balun 1307; a launch pad 1309 connected to the other end of the feed line 1311; a cell patch 1313 capacitively coupled to the launch pad 1309 by a coupling gap 1315; and a via 1317 formed in the substrate to connect the cell patch 1313 in the top layer 1300-1 and a via line 1319 in the bottom layer 1300-2. In FIG. 13A, the balun 1307, CPW feed 1303, and feed port 1305 are symmetric along the axis 1327 (dash-dotted line) and accommodated within a top ground 1321. In this balanced antenna design, the placement of the CPW feed 1303 and feed port 1305 along the axis 1327 are structured as to center feed the CRLH antenna portions 1301, 1302. Referring to FIG. 13B, the other end of each via line 1319 is connected to a bottom ground 1323 in the bottom layer 1300-2 at a connecting section 1325 (dashed line). The top ground 1321 may be connected to the bottom ground 1323 by an array of vias (not shown).

According to one implementation, the via line 1319-1 of ANT1 1301 and the via line 1319-2 of ANT2 1302 may be symmetric along the axis 1327 (dash-dotted line) and linear, such as a 180° line, to keep the structural balance of the antenna device. In FIG. 14A, for example, the via lines

1319-1 and 1319-2 together form a common conductive line along a path 1401 between the two vias 1317 associated with ANT1 1301 and ANT2 1302. In operation, the 180° via lines 1319-1 and 1319-2 may provide an effective current that are equivalent and thus electrically balanced.

According to another implementation, via lines 1319-1 and 1319-2 may be structured to be non-linear, such as a meandered line, a zig-zag line, or a sinusoidal line, that may or may not be physically symmetric.

Figure 14B:
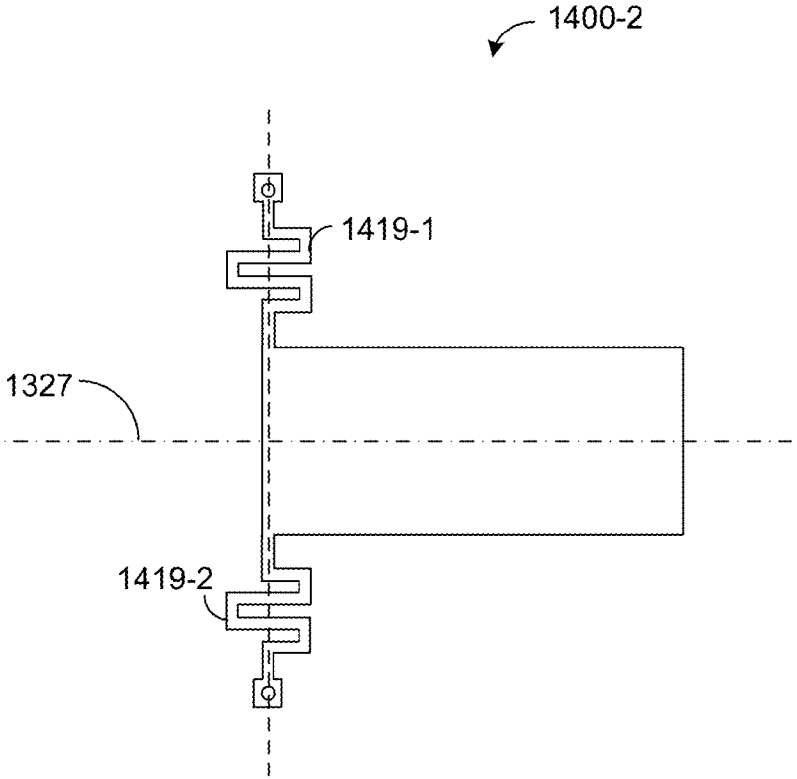
FIG. 14B illustrates a meandered via line configuration of the balanced MTM antenna device shown in FIGS. 13A-13B, according to an example embodiment.
Figure 14A:
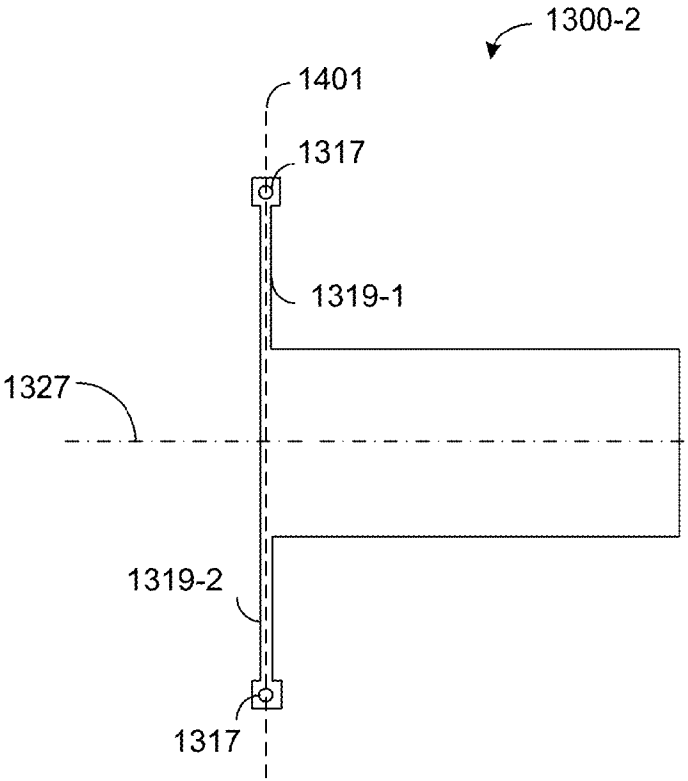
FIG. 14A illustrates via line orientation of the balanced MTM antenna device shown in FIGS. 13A-13B, according to an example embodiment.
Figure 14C:
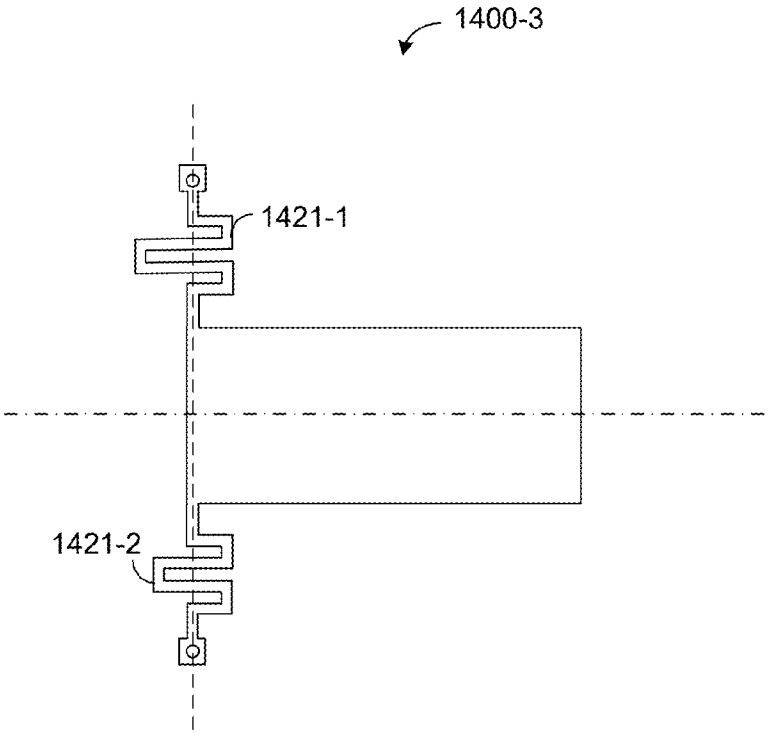
FIG. 14C illustrates a via line in the form of an asymmetric meandered line of the balanced MTM antenna device shown in FIGS. 13A-13B, according to an example embodiment.

In FIG. 14B, according to one example, each via line 1419-1 and 1419-2 associated with a bottom layer 1400-2 of the antenna device 1300 may form a meandered line and are symmetric along axis 1327 to maintain a structural and an electrical balance. In another example shown in FIG. 14C, each via line 1421-1 and 1421-2 associated with a bottom layer 1400-3 of the antenna device 1300 may form an asymmetric meandered line. However, the via lines 1421-1 and 1421-2 in FIG. 14C may be engineered and configured to produce an effective current that are equivalent and thus maintain an electrical balance.

Figure 15:
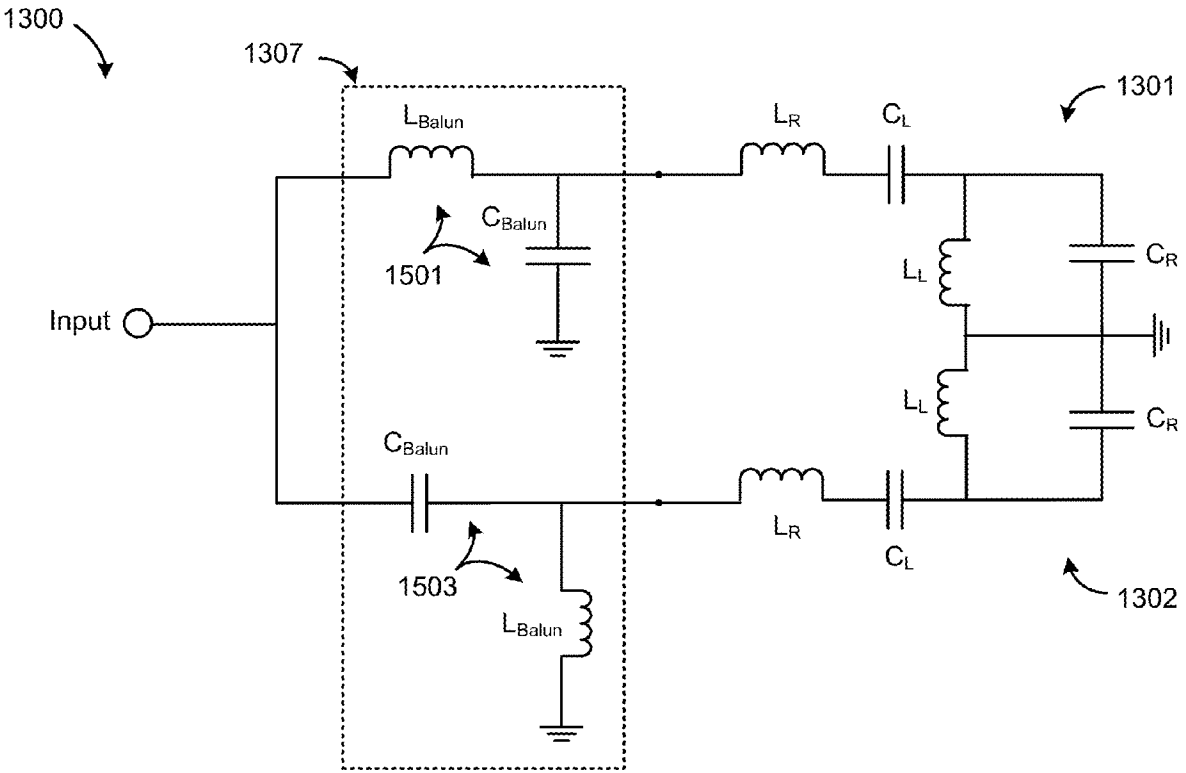
FIG. 15 illustrates an equivalent circuit schematic of the balanced MTM antenna device shown in FIGS. 13A-13B, according to an example embodiment.

FIG. 15 illustrates an equivalent circuit schematic of the antenna device 1300 depicted in FIGS. 13A-13B. The schematic of the balun device 1307 may be represented by an upper branch 1501 and a lower branch 1503, each branch having an inductor $L_{Balun}$ and a capacitor $C_{Balun}$. The upper branch 1501 may be configured to form a low pass filter providing a −90° phase shift, whereas the lower branch 1503 forms a high pass filter providing a +90° phase shift, in which the upper branch 1501 and the lower branch 1503 are respectively connected to ANT1 1301 and ANT2 1302. Due to the equal and opposite phase shift provided by each filter, the balun device 1307 can provide a resulting phase shift of 180° and serve to cancel reflection between ANT1 1301 to ANT2 1302, and thus improve the overall radiation performance of the balanced antenna device 1300.

The schematic of the CRLH antenna portions ANT1 1301 and ANT2 1302 are also depicted in FIG. 15. Each CRLH antenna portion may include a series inductor $L_R$, series capacitor $C_L$, shunt inductor $L_L$ and shunt capacitor $C_R$ where $L_L$ and $C_L$ determine the LH mode propagation properties and the $L_R$ and $C_R$ determine the RH mode propagation properties. For each CRLH antenna portion, certain structural elements contribute to forming the electrical characteristics $L_R$, $C_R$, $L_L$, and $C_L$ that govern the LH and RH modes. For example, capacitive coupling through the gap between the launch pad 1315 and the cell patch 1313 may generate the series capacitance $C_L$; the via line 1311 may produce the shunt inductance $L_L$, while the series inductance $L_R$ may be attributed to the cell patch 1313 and the feed line on the substrate, and $C_R$ is due to the substrate 1304 being sandwiched between the cell patch 1313 and the ground 1323.

Figure 16B:
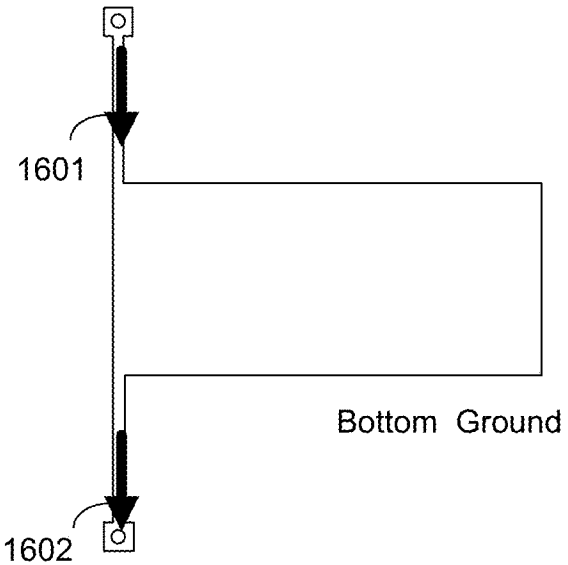
FIGS. 16A and 16B illustrate a current flow diagram of the top and bottom layers associated with the balanced MTM antenna device depicted in FIGS. 13A and 13B, respectively, according to an example embodiment.
Figure 16A:
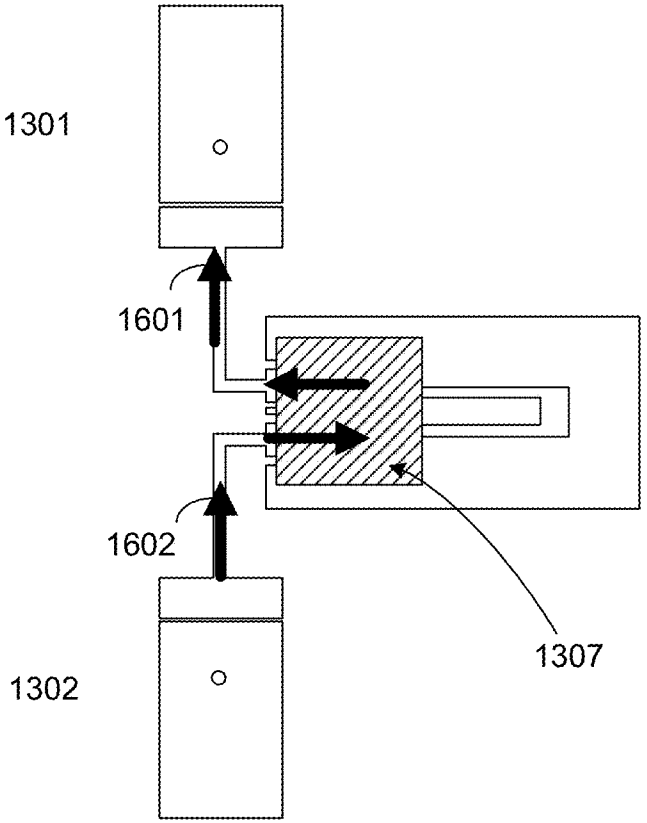

FIGS. 16A and 16B illustrate a current flow diagram of the top and bottom layers associated with the balanced MTM antenna device 1300 depicted in FIGS. 13A and 13B, respectively. In FIG. 16A, the dominant currents, I1 1601 and I2 1602, between each MTM antenna portion 1301 and 1302 are equal in magnitude but 180° out of phase due to the balun device 1307 which provides balanced antenna properties in this device.

Fundamental parameters of the balanced MTM antenna device 1300 which describe the performance characteristics of the antenna include, among other parameters, return loss, efficiency, polarization, impedance matching, and radiation patterns.

The return loss measurement can be loosely defined as a portion of a transmitted signal that cannot be absorbed at the end of a transmission line. Thus, two signals can appear on the transmission line and interfere with one another resulting in cancellation or addition of signals along various points of the transmission line.

Efficiency can be used as a metric to account for losses at an input terminal and within the structure of the antenna device.

Polarization, as it relates to the radiated wave, may be described as a property of an electromagnetic wave describing the time varying direction and relative magnitude of the electric-field vector.

Impedance matching is useful for determining optimum load and source impedance conditions for delivering the maximum or optimum transfer between the load and source.

Radiation patterns provide a graphical representation of the radiation properties of an antenna as a function of space coordinates (x, y, z). These patterns can take the form of isotropic, directional, and omnidirectional patterns. For example, in an isotropic radiator, the antenna can have equal radiation in all directions and thus appear uniformly distributed in all direction in the graph. In a directional radiator, the antenna may have radiating properties that is more effective in one direction than another direction, and thus appear to be dominant in some coordinate. In an omnidirectional radiator, the antenna can be directional in the (x, z) and the (y, z) planes, or elevation plane, and nondirectional in the (x, y) plane, or azimuth plane, and thus appear uniformly distributed in some planes but not others.

An analysis of the fundamental antenna parameters at various antenna conditions, such as grounding and antenna orientation, may provide one skilled in the art a better understanding and appreciation of the performance of the balanced MTM antenna device 1300 subjected to different applications. A summary of these conditions are provided in Table 1.

TABLE 1

Ground conditions and antenna orientation applied to balanced MTM antenna device

| Antenna Condition | Description | FIG. |
|---|---|---|
| Free Space (Reference) | Antenna device 1300 in free space; No ground plane; Attached directly to feed cable. | FIG. 17 |
| Case 1 | Antenna device 1300 mechanically attached to a ground plane, but not connected to the ground; Antenna device 1300 is oriented perpendicular to a ground plane. | FIG. 18 |
| Case 2 | Antenna device 1300 mechanically attached to a ground plane and connected to the ground; Antenna device 1300 is oriented perpendicular to a ground plane. | FIG. 23 |
| Case 3 | Antenna device 1300 mechanically attached to a ground plane, but not connected to the ground; Antenna device 1300 is oriented parallel to a ground plane. | FIG. 25 |
| Case 4 | Antenna device 1300 mechanically attached to a ground plane, but not connected to ground; Antenna device 1300 is oriented perpendicular to and facing a ground plane. | FIG. 27 |

Figure 17:
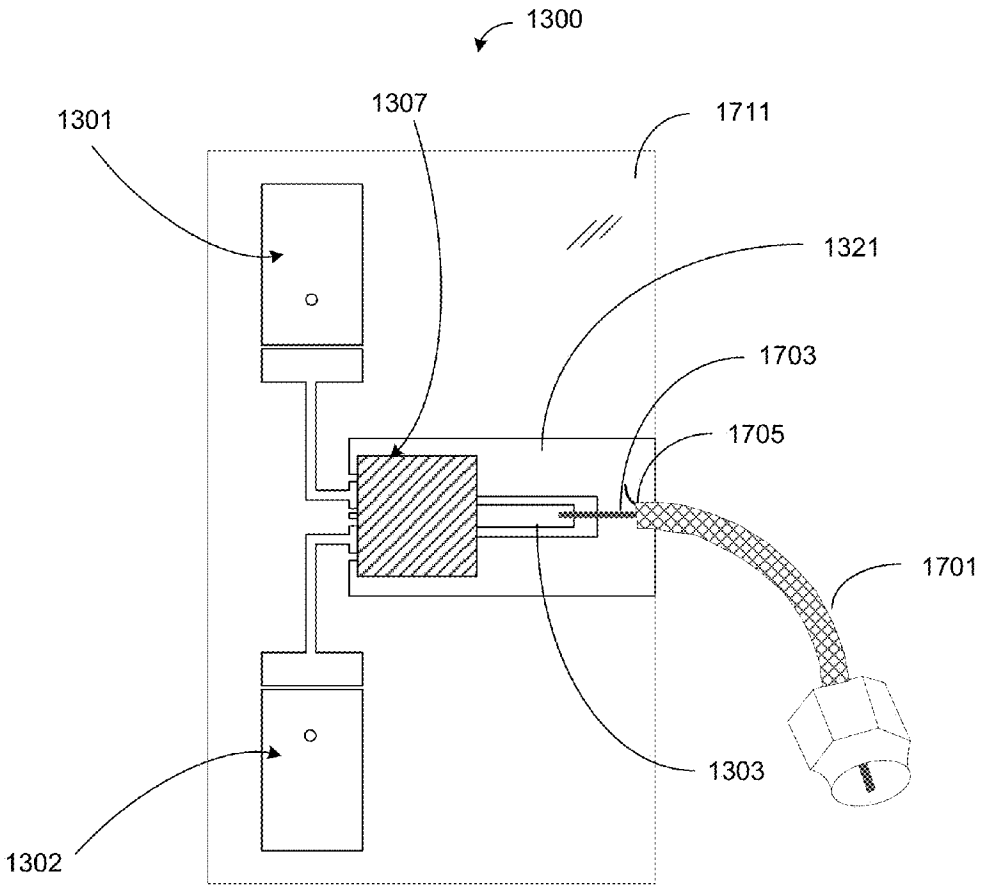
FIG. 17 illustrates a top view of a fabricated model of the balanced MTM antenna device depicted in FIGS. 13A-13B, according to an example embodiment.

FIG. 17 illustrates a top view of a fabricated model of the balanced MTM antenna device 1300 depicted in FIGS. 13A-13B. The top layer 1300-1 of the antenna device 1300 is depicted with the substrate 1711 in this fabricated antenna model. Structures on the bottom layer 1300-2 of the antenna are not visible through the substrate 1711 and thus are not depicted in FIG. 17. A conductive inner core 1703 and a conductive shield 1705 of a coaxial cable 1701 are respectively connected to the feed port 1303 and the ground 1321 of the balanced MTM antenna device 1300 for signal transmission. This fabricated model can be measured in free space and provide an initial reference measurement of the fundamental antenna parameters.

In one implementation, the design of this balanced MTM antenna device 1300 may be configured for single-band 2.44 GHz Wi-Fi™ applications. Wi-Fi is a trademark of the Wi-Fi Alliance and refers to a class of WLAN devices based on the IEEE 802.11 standards. Designs for higher frequency applications can be constructed by reducing the total size of the device while keeping the same basic configuration of the antenna elements.

Figure 18:
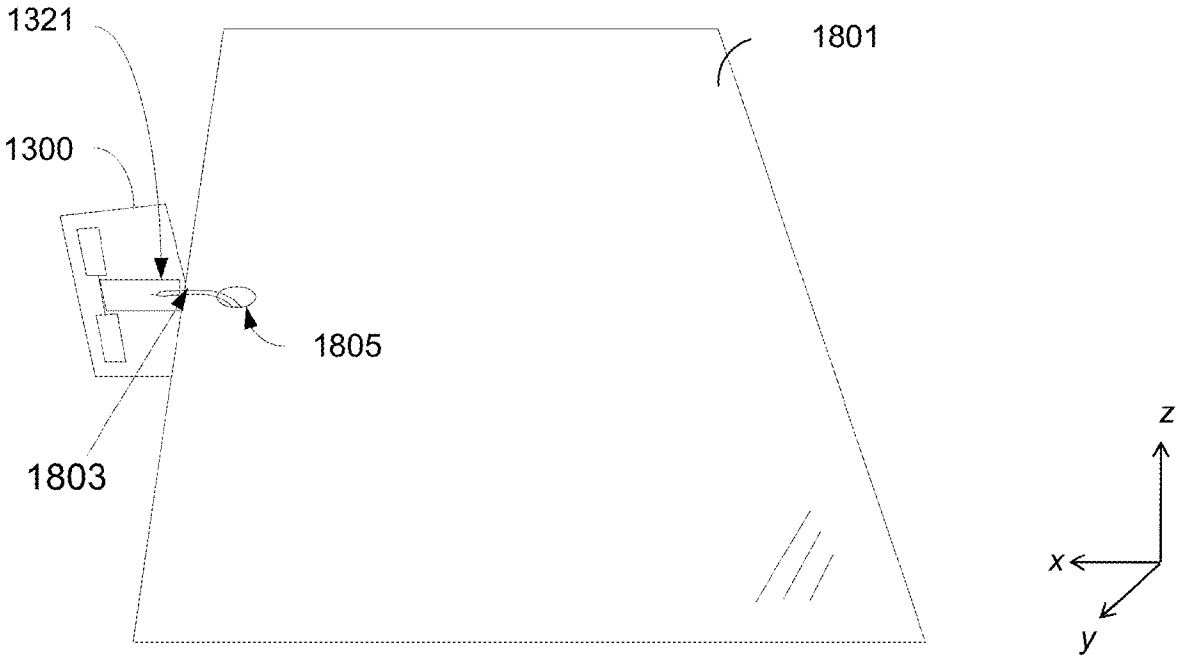
FIG. 18 illustrates a first ground scenario of the balanced MTM antenna device (Case 1), according to an example embodiment.

FIG. 18 illustrates a first ground scenario of the balanced MTM antenna device 1300 (Case 1). According to this embodiment, the substrate of the antenna device 1300 may be mechanically attached to a large ground plane (GND) 1801 that has a dimension of about 135 mm×205 mm. However, the ground 1321 of the antenna device 1300 is not electrically connected to GND 1801 in this arrangement, but instead connected to a conductive ground of a cable 1803, such as an cable, which is routed through an aperture 1805 that is formed in the GND 1801. Techniques for mechanically attaching the antenna device 1300 to the ground plane 1801 include, but are not limited to, gluing, soldering or tongue-and-groove fastening. The cable 1803 may also include an inner conductive core which is connected to the feed port of the antenna device 1300 for signal transmission. The antenna device 1300 may be configured to be mechanically attached to the GND 1801 so that the antenna device 1300 is positioned in a perpendicular orientation with respect to the plane of GND 1801 with the approximate center of the antenna device corresponding to the edge of GND 1801. Thus, the configuration of the antenna device 1300 is approximately symmetric with respect to the plane of GND 1801 with one antenna above the plane of GND 1801 and the other antenna below the plane of GND 1801. The (X, Y, Z) coordinates are also shown in this figure for clarity in the ensuing radiation pattern measurements.

Figure 19:
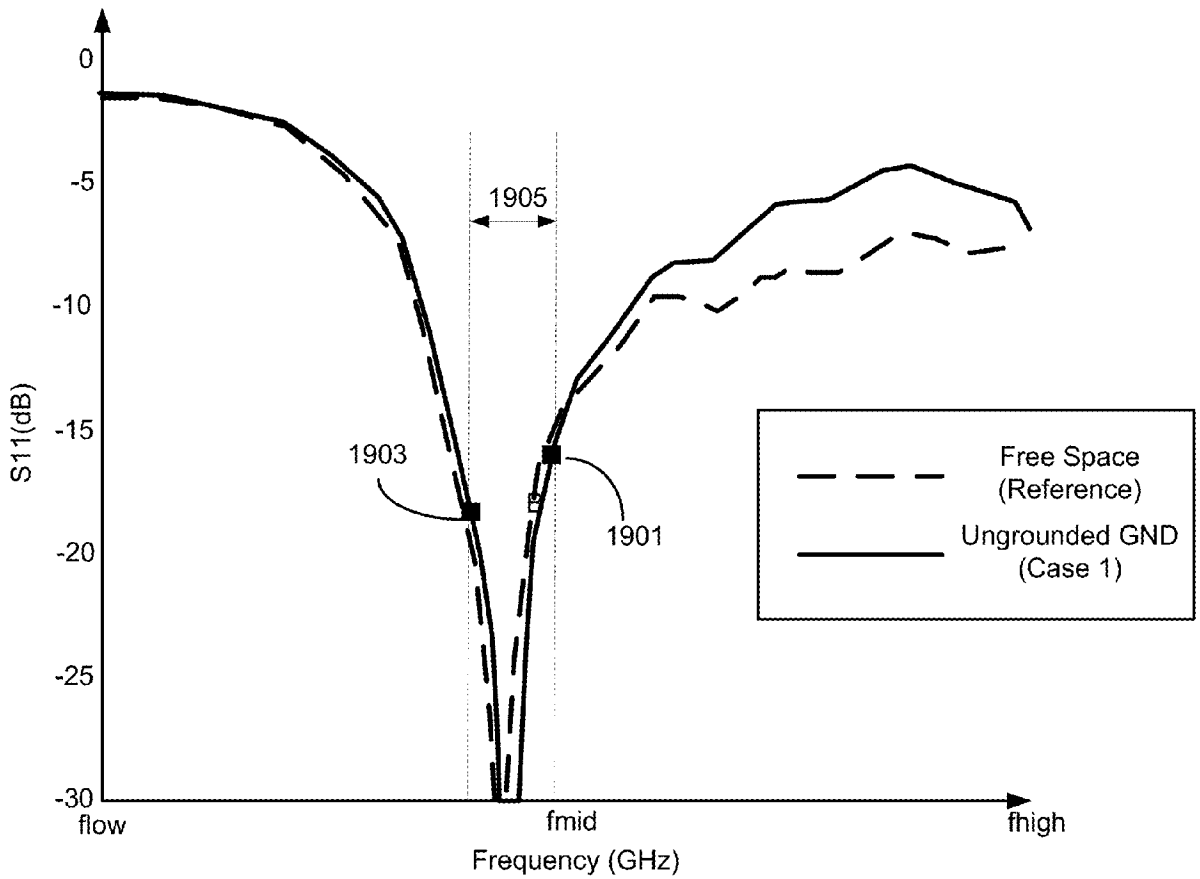
FIG. 19 illustrates a plot of the measured return loss for the case of free space (Reference), represented by a dashed line, and the case with the ungrounded GND (Case 1), according to an example embodiment.

FIG. 19 illustrates a plot of the measured return loss for the case of free space (Reference), represented by a dashed line, and the case with the unconnected GND (Case 1), represented by a solid line. The sharp inverted peaks near a frequency fmid, which may be attributed to an LH resonance associated with the antenna, represent good matching near a certain target frequency, such as 2.4 GHz, for both cases. The frequency band between points 1901 and 1903 represents the band 1905 of interest in this case. Thus, the similarities of measured return loss of the balanced antenna 1300 in the free space case (Reference) and ungrounded GND case (Case 1) indicate that the ground plane 1801 has negligible effects to the balanced antenna 1300.

Figure 20:
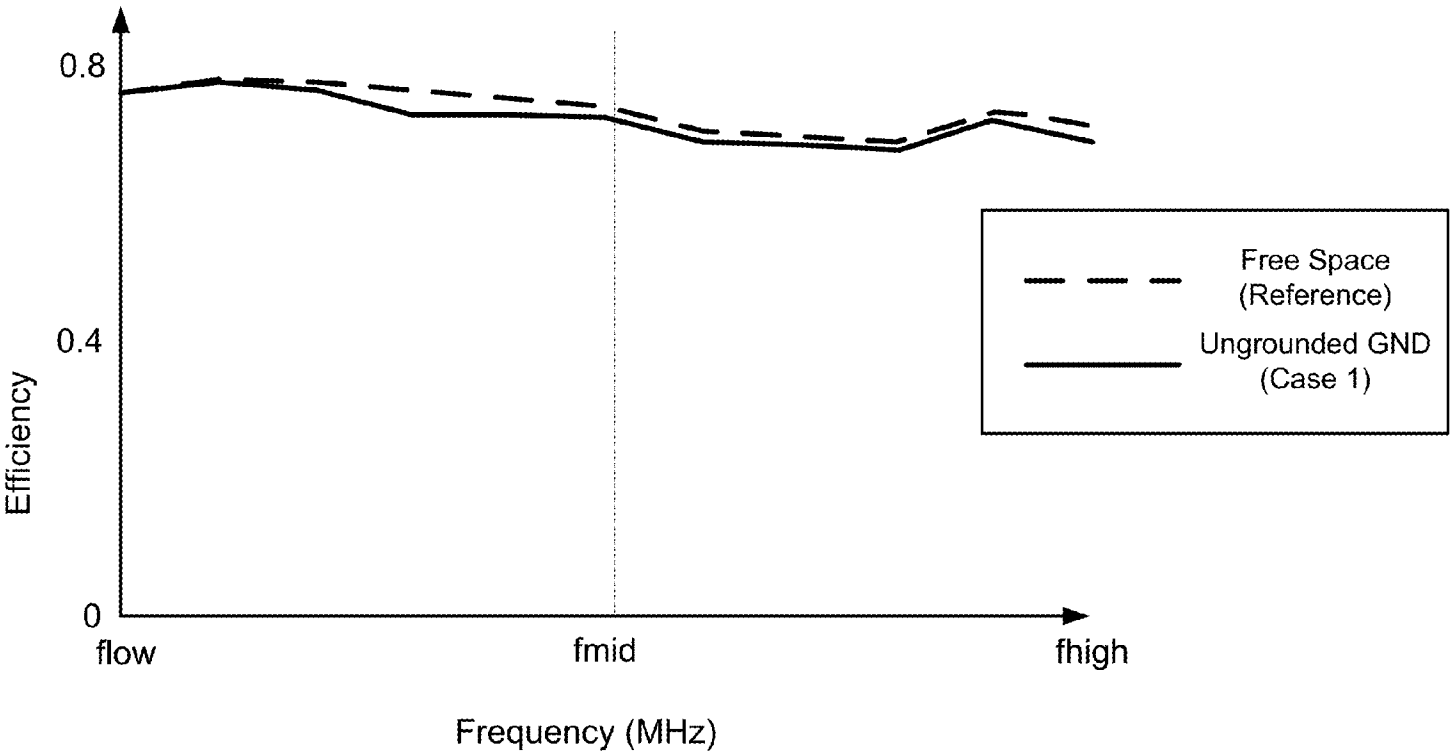
FIG. 20 illustrates a plot of the measured efficiency for the case of free space (Reference), according to an example embodiment.

FIG. 20 illustrates a plot of the measured efficiency for the case of free space (Reference), represented by a dashed line, and the case with the ungrounded GND (Case 1) represented by a solid line. The efficiency for both cases demonstrates a measured result better than 70% at various frequencies. Thus, these results further support previous indications of the negligible effects of the ground plane 1801 when positioned near the balanced antenna 1300.

Figure 21:
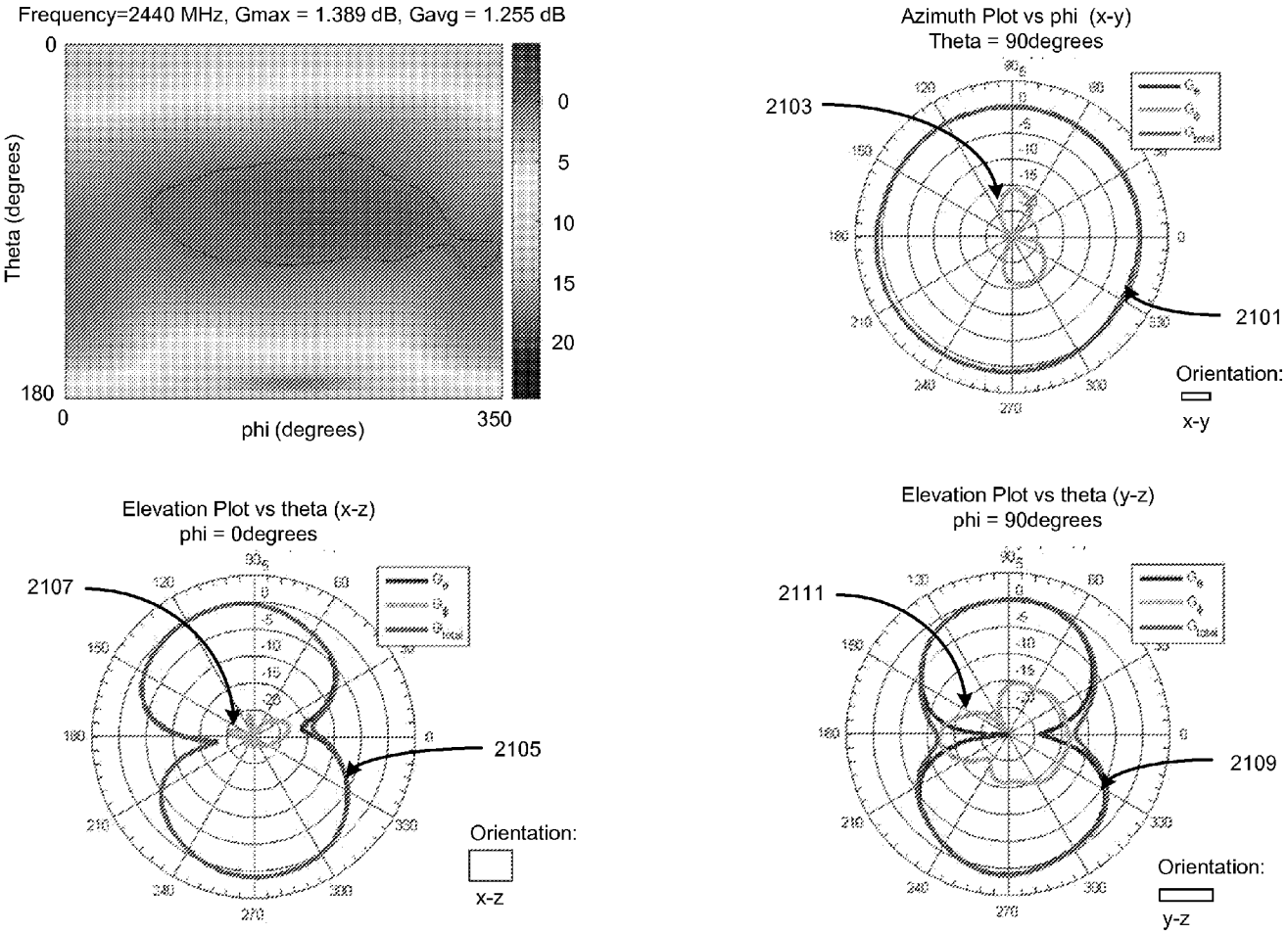
FIG. 21 illustrates a plot of the gain and radiation patterns at 2.44 GHz for the case of free space (Reference), according to an example embodiment.

FIG. 21 illustrates a plot of the gain and radiation patterns at 2.44 GHz for the case of free space (Reference). The orientation of the balanced MTM antenna device 1300 is schematically shown for each radiation pattern to indicate the coordinates corresponding to the antenna shown in FIG. 17. A substantially omnidirectional pattern 2101 with ripples less than 1 dB is achieved in the azimuthal plane (x-y). Furthermore, FIG. 21 indicates that the free space (Reference) antenna device 1300 produces cross polarizations 2103, 2107 and 2111 as measured in each of the three different planes, i.e., much smaller than corresponding co-polarizations 2101, 2105, and 2109, respectively.

Figure 22:
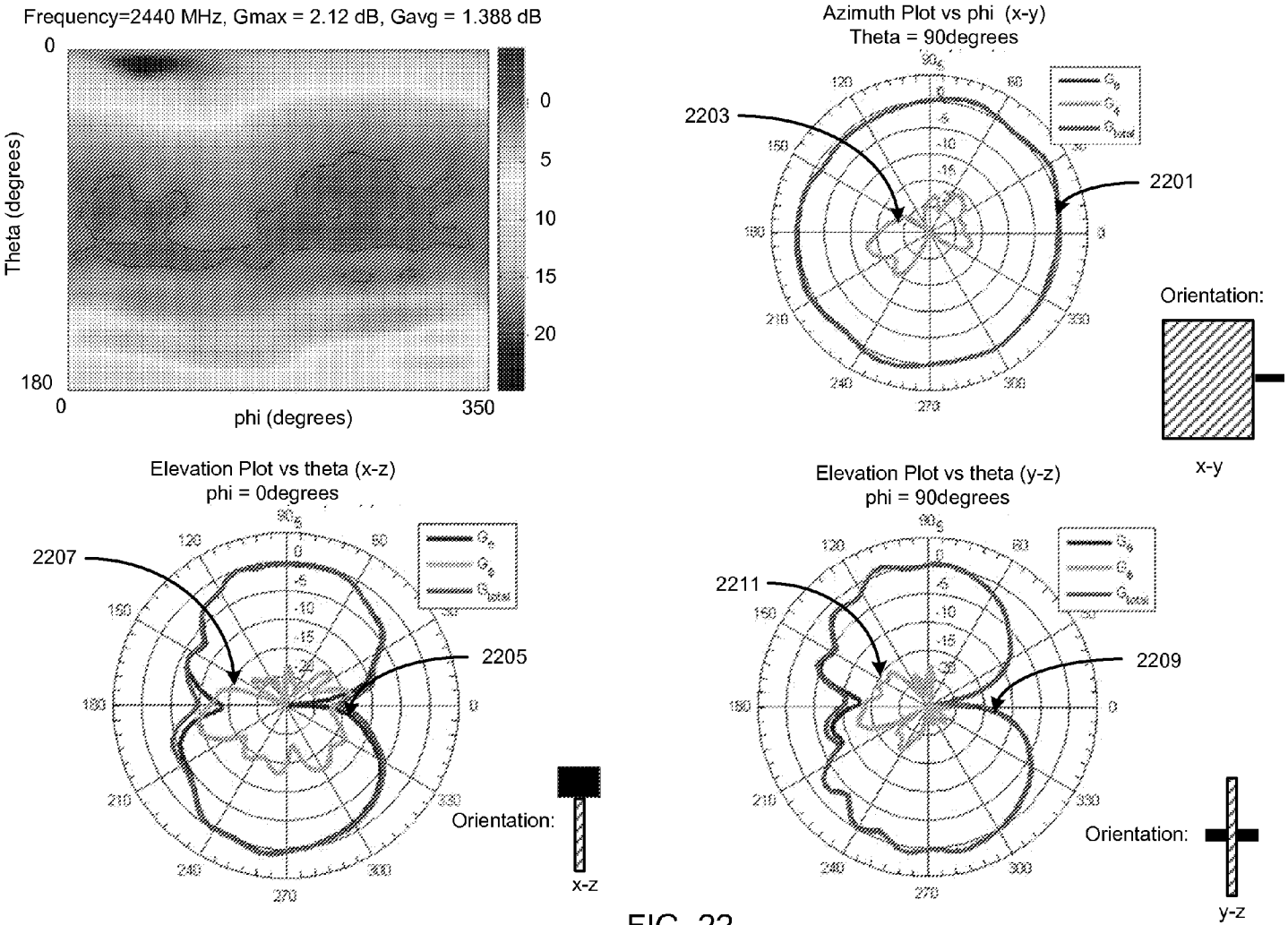
FIG. 22 illustrates the gain and radiation patterns at 2.44 GHz for Case 1 as shown in FIG. 18, according to an example embodiment.

FIG. 22 illustrates the gain and radiation patterns at 2.44 GHz for Case 1 as shown in FIG. 18. The orientation of the balanced MTM antenna device 1300 and the attached unconnected GND 1801 is schematically shown for each radiation pattern to indicate the coordinates. A substantially omnidirectional pattern 2201 with ripples less than 2 dB is achieved in the azimuthal plane. The cross polarizations of the antenna device 1300 for the ungrounded GND case (Case 1), as measured in the three different planes, are also negligibly small or smaller than corresponding co-polarizations 2201, 2205, and 2209. These radiation pattern results are comparable to the free space (Reference) case and thus provide further evidence of the robust operating features of the antenna device 1300 when mechanically attached the ground plane 1801.

Figure 23:
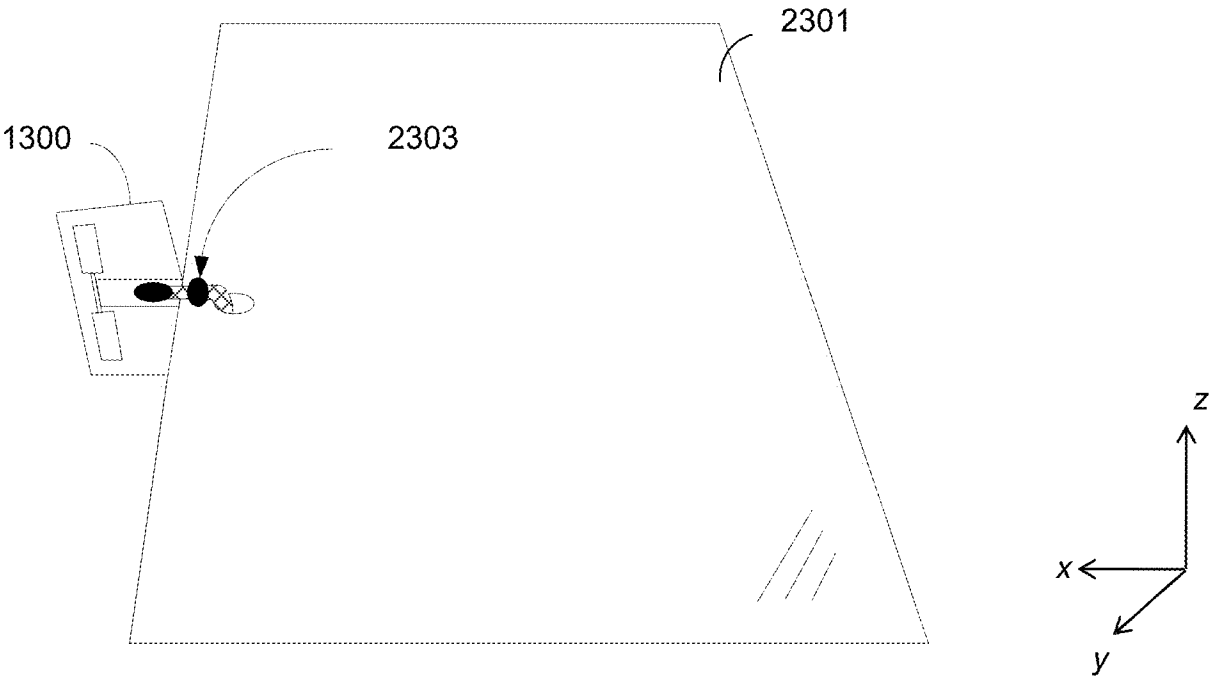
FIG. 23 illustrates another ground example of the antenna device (Case 2), according to an example embodiment.

FIG. 23 illustrates another ground example of the antenna device 1300 (Case 2). According to this example, the antenna device 1300 is mechanically attached to a large ground plane (GND) 2301, where a cable 2303 is also electrically connected to GND 2301 of the antenna device 1300. The mechanical arrangement of the antenna device 1300 with respect to the plane of GND 2301 is similar to the ungrounded GND case (Case 1) shown in FIG. 18. The (X, Y, Z) coordinates are also shown for clarity in radiation pattern measurements.

Figure 24:
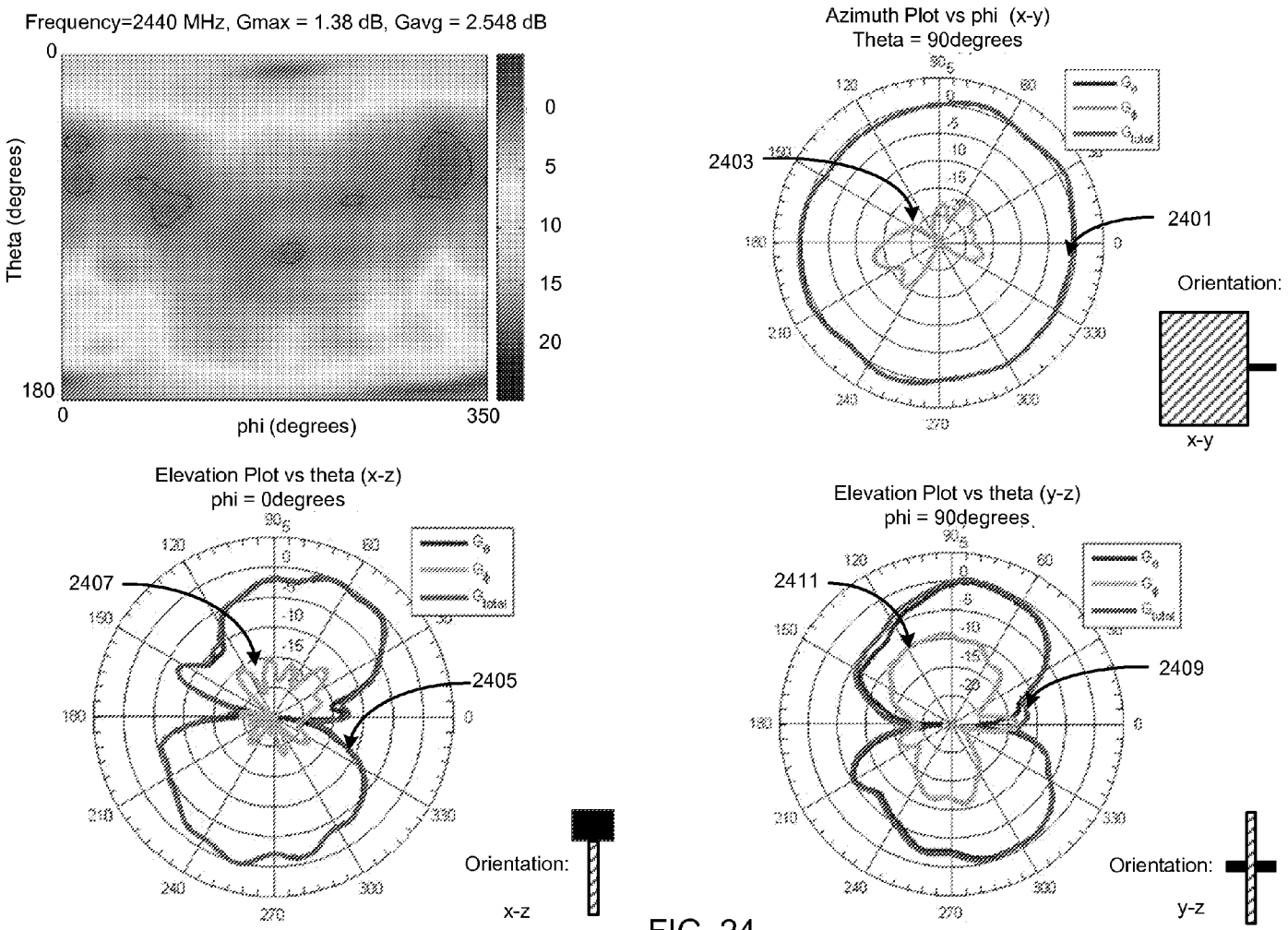
FIG. 24 illustrates the gain and radiation patterns at 2.44 GHz of the antenna device for Case 2 as shown in FIG. 23, according to an example embodiment.

FIG. 24 shows the gain and radiation patterns at 2.44 GHz of the antenna device 1300 for Case 2 as shown in FIG. 23. The orientation of the balanced MTM antenna device 1300 and the grounded GND 2301 is schematically shown for each radiation pattern to indicate the coordinates. In FIG. 24, the radiation pattern of the antenna device 1300 for Case 2 has a substantially omnidirectional pattern 2401 in the azimuthal plane with ripples less than 2.5 dB. Examination of the cross polarizations 2403, 2407, and 2411, as measured in the three different planes, depicts small radiation patterns, i.e., much smaller than corresponding co-polarizations 2401, 2405, and 2409, respectively. These radiation pattern results are comparable to the free space (Reference) case and thus provide additional support of the robust operating features of the antenna device 1300 when mechanically attached and electrically connected to the ground plane 1801.

Figure 25:
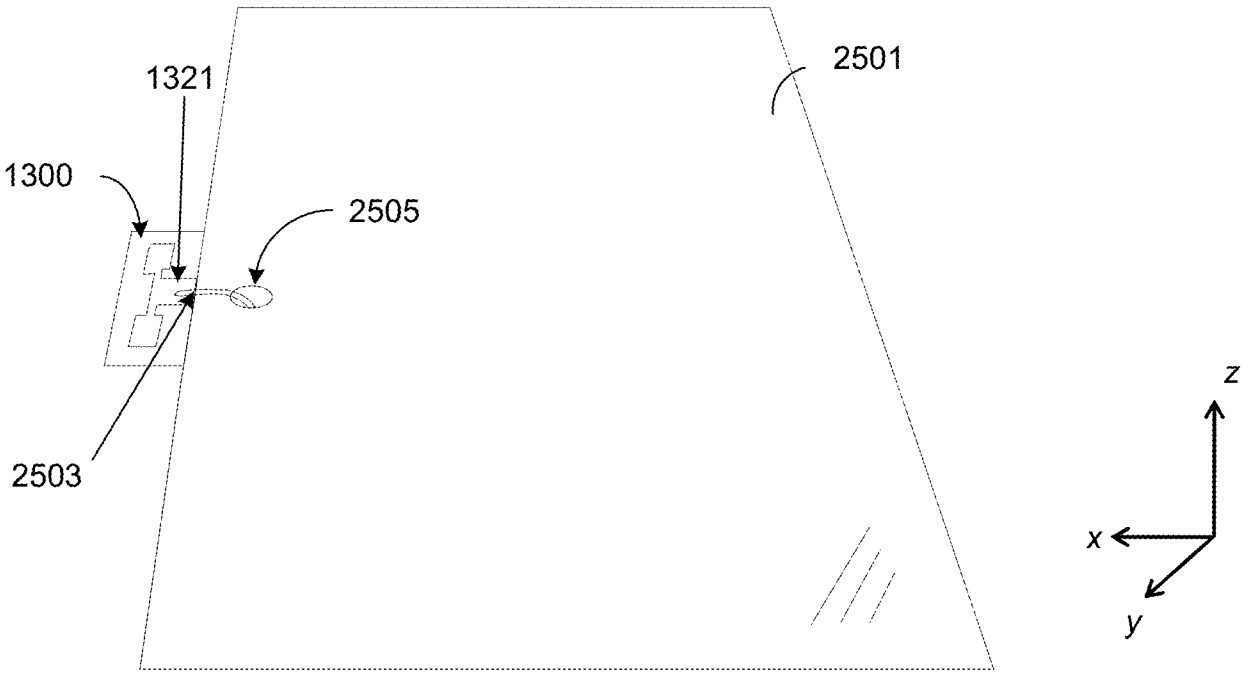
FIG. 25 illustrates yet another ground example of the antenna device (Case 3), according to an example embodiment.

FIG. 25 illustrates yet another ground example of the antenna device 1300 (Case 3). According to this example, the antenna device 1300 is mechanically attached to a large ground plane (GND) 2501 and placed in parallel with respect to the plane of GND 2501 with the longitudinal edge of the antenna device 1300 aligned with the edge of the plane of GND 2501. However, the ground 1321 of the antenna device 1300 is not electrically connected to GND 2501 in this arrangement, but instead connected to a conductive ground of a cable 2503, such as an IPEX cable, which is routed through an aperture 2505 that is formed in the GND 2501. A cable 2503 is electrically connected to GND 2501. The (X, Y, Z) coordinates are also shown for clarity in radiation pattern measurements.

Figure 26:
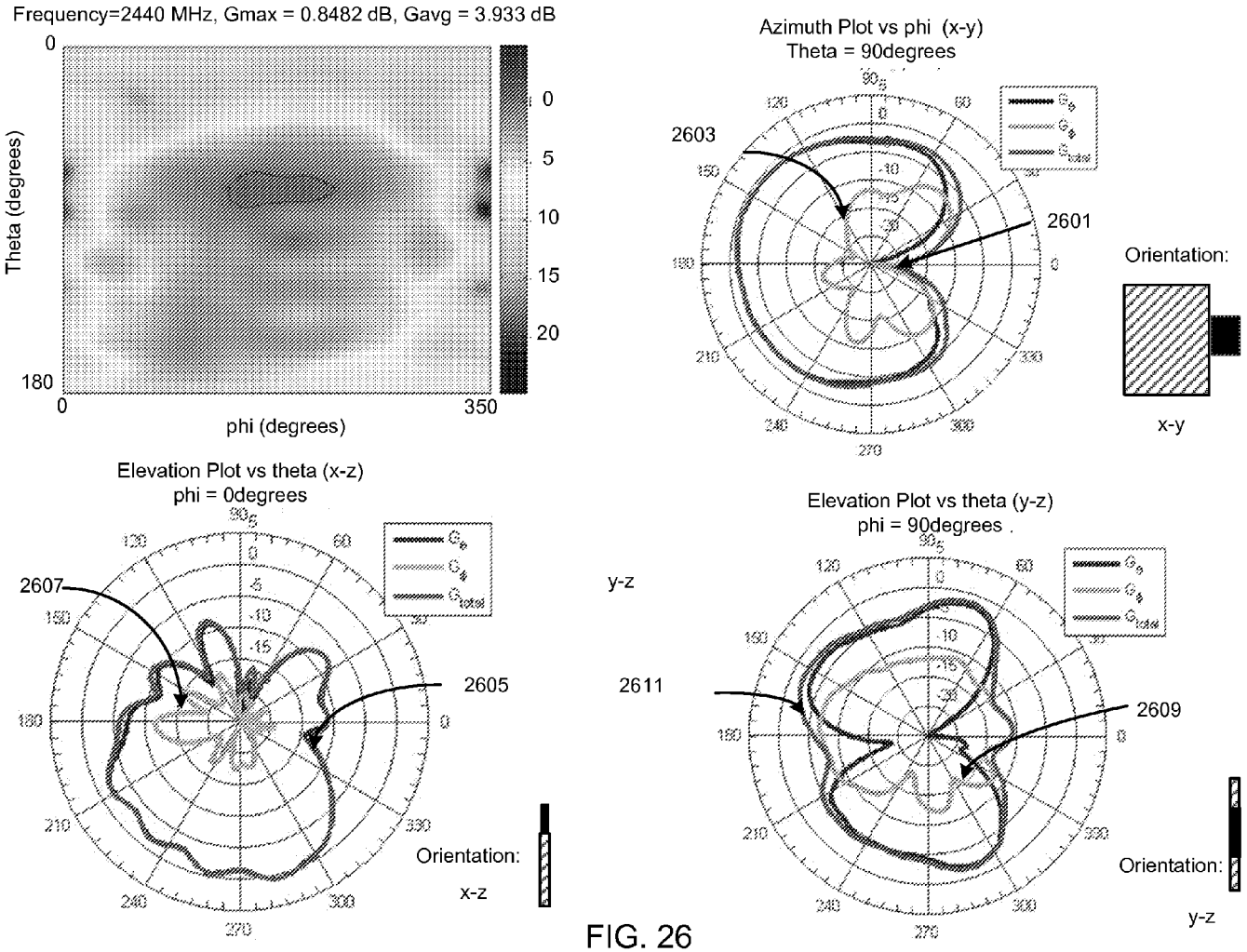
FIG. 26 illustrates the gain and radiation patterns at 2.44 GHz of the antenna device for Case 3 as shown in FIG. 25, according to an example embodiment.

FIG. 26 illustrates the gain and radiation patterns at 2.44 GHz of the antenna device 1300 for Case 3 as shown in FIG. 25. The orientation of the balanced MTM antenna device 1300 and the grounded GND 2501 is schematically shown for each radiation pattern to indicate the coordinates. In the azimuthal plane, the radiation pattern of the antenna device 1300 for Case 3 has a null 2601 in the direction where the antenna device is located. The null may be indicative of interference caused by the position and orientation of the antenna with respect to the GND plane 2501. It also can be noticed that even though the nulls exist due to ground plane placement, a very broad beamwidth is still exhibited for this antenna configuration. The cross polarizations 2603, 2607, and 2611 measured in the three different planes are less dominant than the co-polarization 2601, 2605, 2609, respectively.

Figure 27B:
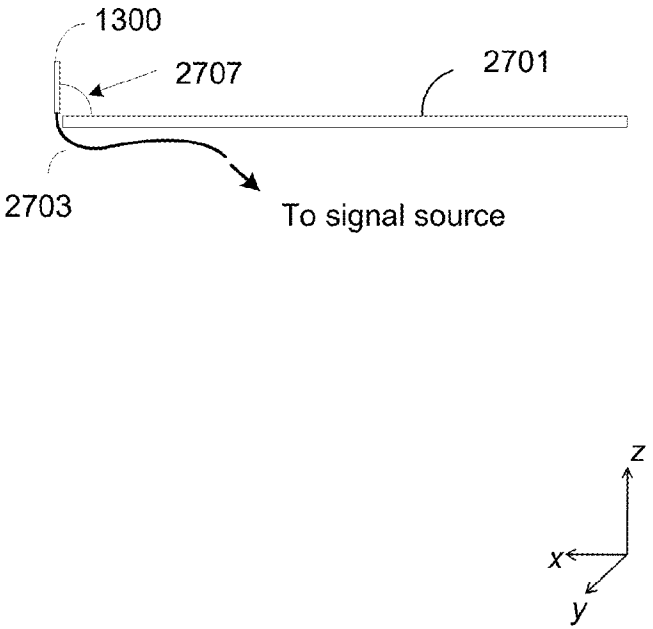
FIGS. 27A-27B illustrate another ground example of the antenna device (Case 4), according to an example embodiment.
Figure 27A:
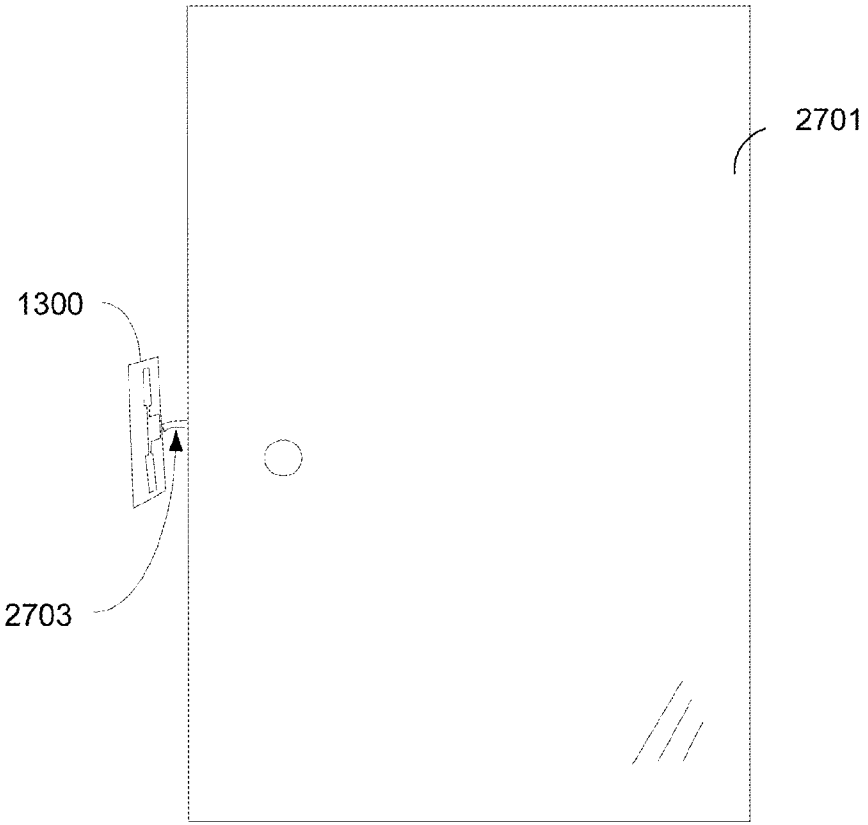

FIGS. 27A-27B illustrate another ground example of the antenna device 1300 (Case 4). In this example, the antenna device 1300 is positioned approximately perpendicular 2707 to a large GND plane 2701 and not mechanically secured to the GND plane 2701 as shown in FIG. 27B. Unlike the perpendicular and symmetric arrangement in FIG. 18, the entire antenna device 1300 is positioned above the plane of GND 2701 with the antenna side facing the plane of GND 2701. A cable 2703 is not electrically connected to GND 2701 in this arrangement, but instead connects the antenna device 1300 directly to a source signal as shown in FIG. 27B. Thus, the antenna device 1300 is electrically ungrounded with respect to the GND plane 2701. The (X, Y, Z) coordinates are also shown for clarity in radiation pattern measurements.

Figure 28:
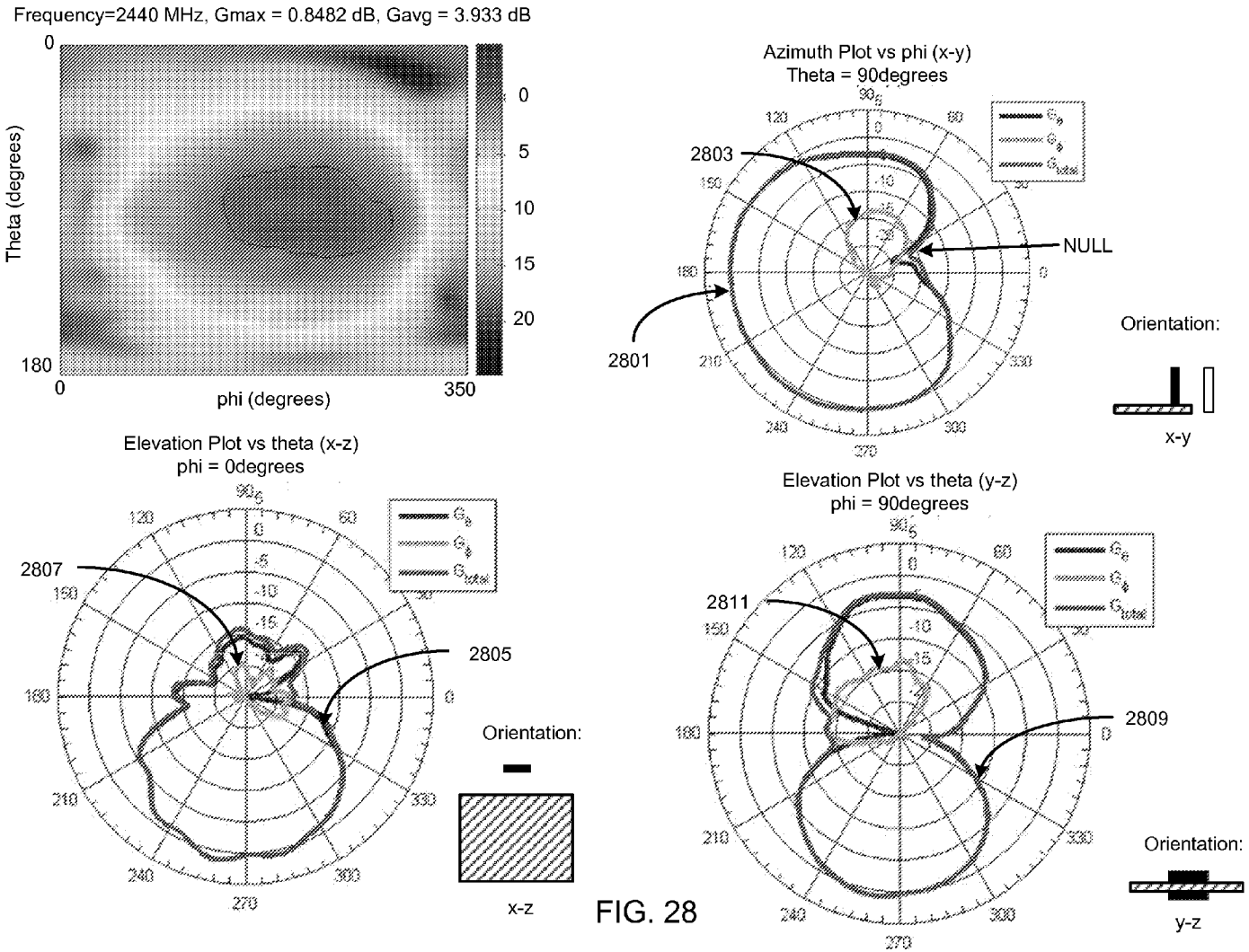
FIG. 28 illustrates the gain and radiation patterns at 2.44 GHz of the antenna device for Case 4 as shown in FIGS. 27A-27B, according to an example embodiment.

FIG. 28 shows the gain and radiation patterns at 2.44 GHz of the antenna device 1300 for Case 4 as shown in FIGS. 27A-27B. The orientation of the antenna device 1300 and the grounded GND 2701 is schematically shown for each radiation pattern to indicate the coordinates. In the azimuthal plane, the radiation pattern of the antenna device 1300 for Case 4 has a null 2801 in the direction where the antenna device is located. The null may be indicative of interference caused by the position and orientation of the antenna with respect to the GND plane 2801. It also can be noticed that even though the nulls exist due to ground plane placement, a very broad beamwidth is still exhibited for this antenna configuration. The cross polarizations 2803, 2807, and 2811 measured in the three different planes are less dominant than the co-polarization 2801, 2805, 2809, respectively.

By comparing the various performance parameters of the balanced MTM antenna device 1300 in the free space case (Reference) to the different grounded cases (Case 1 to Case 4), the fundamental performance of the balanced MTM antenna device 1300 remains substantially the same for various antenna orientations and grounding conditions. These results suggest that the dominant currents in the balanced MTM antenna device 1300 are generally unaffected by the presence of a large ground plane, which can be mechanically connected or situated in proximity to the antenna, as evidenced in the radiation plots. In contrast, when a large ground plane is in proximity to a conventional dipole or monopole antenna, the currents from either of these antennas to the ground plane are dominant, and mismatching and efficiency are reduced.

For each of the grounded examples (Case 1 to Case 4) presented, impedance matching is generally independent of the size of the ground plane with respect to the balanced antennas due the balun. Thus, for design applications having a limited foot print area, balanced antennas can be implemented with a small ground plane and not affect impedance matching.

Comparative analysis of the radiation patterns for each grounded case suggests that substantially omnidirectional patterns may be obtained under the various ground conditions and antenna orientations by using smaller, yet robust, antenna structures such as the balanced MTM antenna device 1300. This is achieved while maintaining substantially small cross polarizations, thereby providing advantages over the use of the conventional dipole or monopole antennas.

Single Band Balanced MTM Antenna with a Via Line Having a Virtual Ground

Figures 29A, 29B:
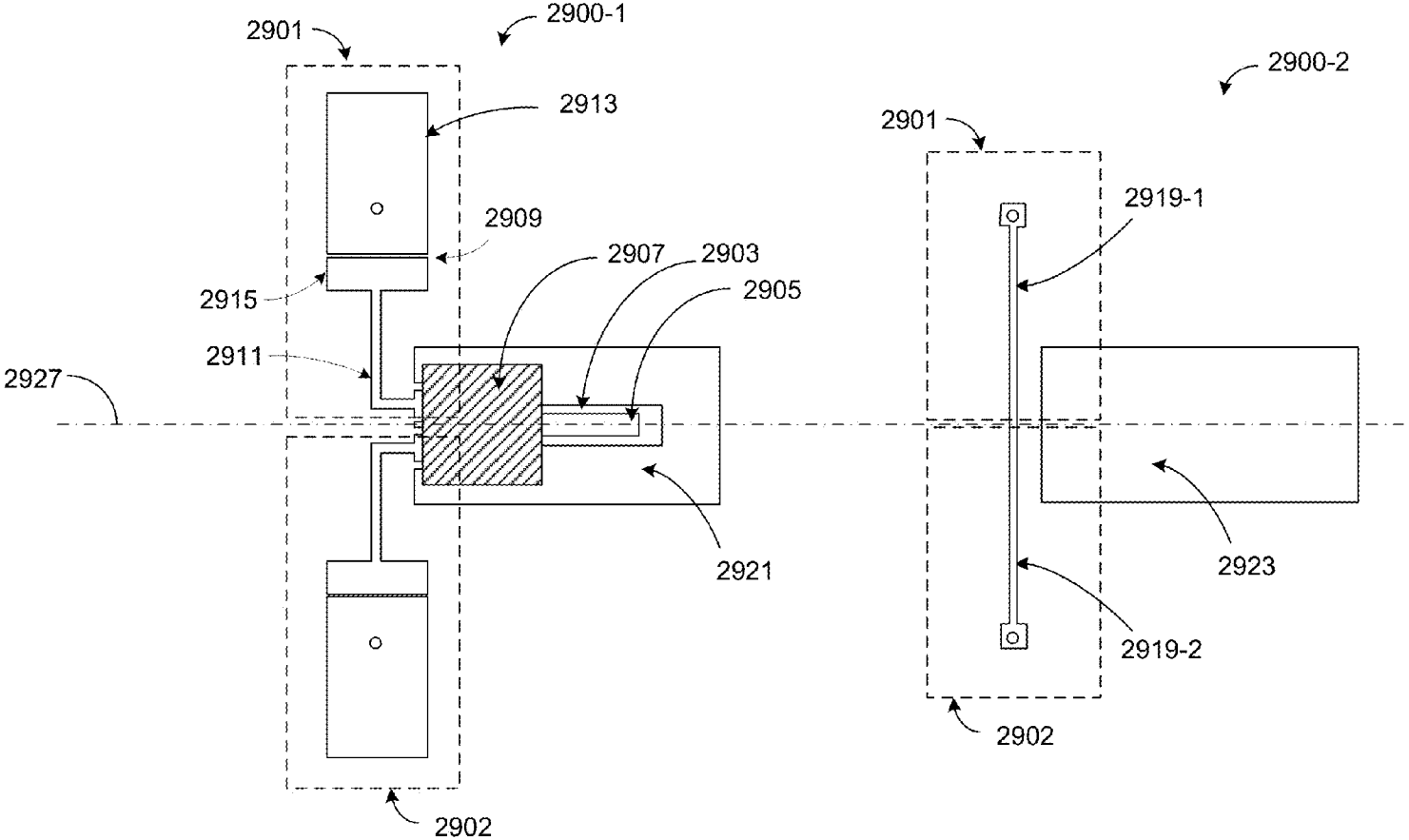
FIGS. 29A-29B illustrate a top view of a top layer and a top view of a bottom layer of the balanced antenna device with a disconnected ground, according to an example embodiment.

Another technique for reducing the size of the balanced MTM antenna device 1300 shown in FIGS. 13A-13B may be possible by reducing or eliminating portions of the ground elements 1321 and 1323 and structuring the via line 1319 so that it is electrically configured to include a virtual ground at or near the line of symmetry 1327. The two radiating CRLH antenna portions 1301 and 1302 may be configured such that the two via lines are designed to retain the 180° phase offset provided by the balun 1307. Structurally, the ground element 1323 on the bottom layer 1300-2 of the balanced antenna device 1300 may be disconnected and essentially removed from the antenna device 1300 as shown in FIG. 29A (top view of top layer) and FIG. 29B (top view of bottom layer). Reducing the size of the ground element 1321 on the top layer 1300-1 may also be possible as provided in other examples in this document.

FIGS. 29A and 29B illustrates an antenna device as in FIGS. 13A and 13B which implements this technique for reducing the size of the antenna device. The antenna device 2900 implements a virtual ground concept, wherein the via line 2919 is not directly coupled to ground, but rather the symmetry of the antenna device 2900 provides a reference point within the antenna device 2900. This reference point acts as a virtual ground. The antenna device 1900 includes two portions 2901 and 2902. In the illustrated example, the portions 2901 and 2902 are symmetric and form a balanced antenna similar to antenna device 1300. As shown in FIG. 29, the antenna device 2900 is symmetric about an axis 2927. The top layer 2900-1 includes a ground element 2921 and a balun 2907. The ground element 2921 may be designed to be a smaller size and take up less area than ground element 1321. The bottom layer 2900-2 includes a via line 2919, which includes portion 2919-1 and 2919-2 to form a common conductive line between the two antenna portions 1301 and 1302. In contrast to the antenna device 1300 of FIGS. 13A and 13B, the design and layout of antenna device 2900 separates the via line 2919 from a ground element 2923 of the bottom layer 2900-2, wherein via line 2919 and ground element 2923 are not connected in the bottom layer 2900-2. In another implementation, the ground element 2923 may be removed from the antenna device 2900 and thus allow further size reduction possibilities to the overall antenna design.

The equivalent circuit for the balanced CRLH antenna device 2900 for the virtual ground case is similar to the circuit schematic shown in FIG. 15 for the balanced MTM antenna device 1300. For example, each CRLH antenna portion may include a series inductor $L_R$, series capacitor $C_L$, shunt inductor $L_L$ and shunt capacitor $C_R$ where $L_L$ and $C_L$ determine the LH mode propagation properties and $L_R$ and $C_R$ determine the RH mode propagation properties. For each CRLH antenna portion, certain structural elements contribute to forming $L_R$, $C_R$, $L_L$, and $C_L$ that govern the RH and LH modes, respectively. For example, coupling between the launch pad 2915 and the cell patch 2913 may generate the series capacitance $C_L$, the via line 2911 may produce the shunt inductor $L_L$, while the $L_R$ may be attributed to the feed line 2919 and the cell patch 2913 on the substrate, and $C_R$ is due to the substrate 2904 being sandwiched between the cell patch 2913 and the via line 2919 forming the virtual ground.

Figure 29C:
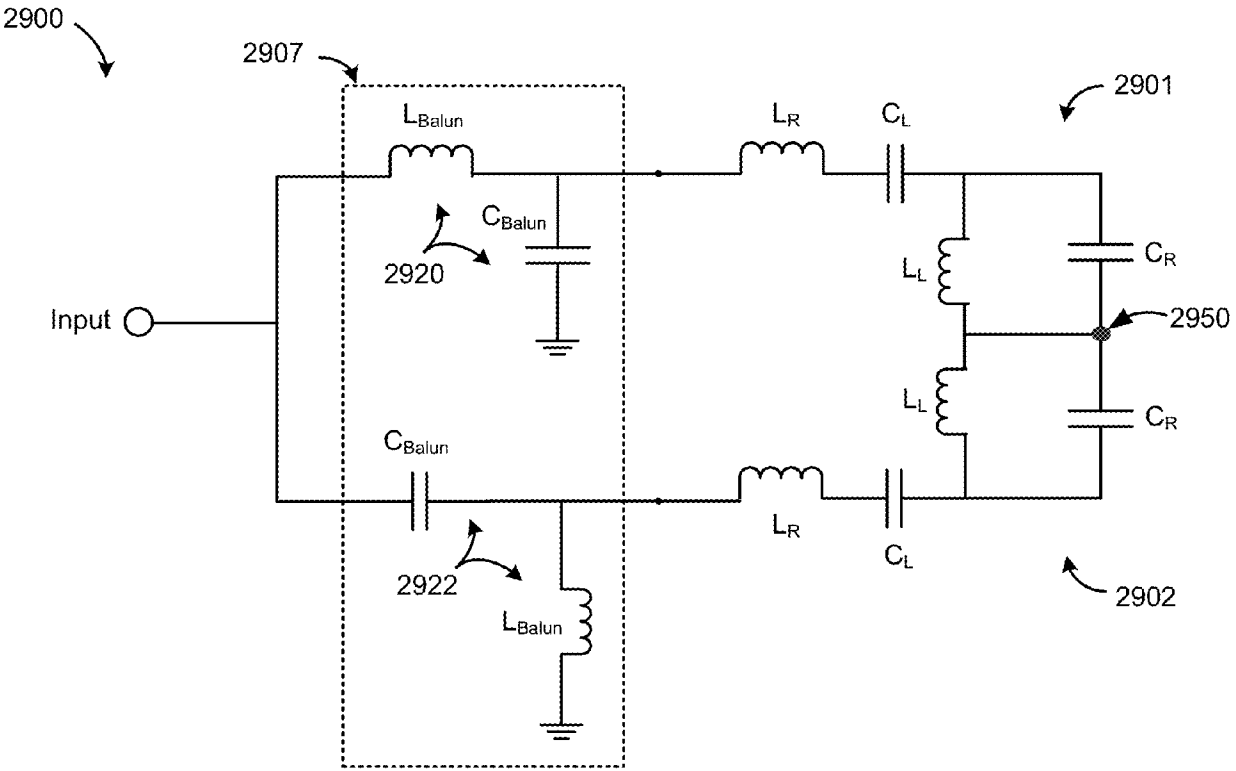
FIG. 29C illustrates an equivalent circuit schematic of the balanced MTM antenna device shown in FIGS. 29A-29B, according to an example embodiment.

As illustrated in FIG. 29C, the equivalent circuit for the antenna device 2900 is similar to the equivalent circuit for the antenna device 1300 as illustrated in FIG. 13. The balun 2907 is identified by the dashed box and may be represented by an upper branch 2920 and a lower branch 2922, each branch having an inductor $L_{Balun}$ and a capacitor $C_{Balun}$. The upper branch 2920 may be configured to form a low pass filter providing a −90° phase shift, whereas the lower branch 2922 forms a high pass filter providing a +90° phase shift, in which the upper branch 2920 and the lower branch 2922 are respectively connected to portions 2901 and 2902. Due to the equal and opposite phase shift provided by each filter, the balun device 2907 can provide a resulting phase shift of 180° and serve to cancel reflection between portions 1301 and 1302, and thus improve the overall radiation performance of the balanced antenna device 2900.

The schematic of the CRLH antenna portions 2901 and 2902 are also depicted in FIG. 29C. Each CRLH antenna portion may include a series inductor $L_R$, series capacitor $C_L$, shunt inductor $L_L$ and shunt capacitor $C_R$ where $L_L$ and $C_L$ determine the LH mode propagation properties and the $L_R$ and $C_R$ determine the RH mode propagation properties. For each CRLH antenna portion, certain structural elements contribute to forming the electrical characteristics $L_R$, $C_R$, $L_L$, and $C_L$ that govern the LH and RH modes. For example, capacitive coupling through the gap between the launch pad 2915 and the cell patch 2913 may generate the series capacitance $C_L$; the via line 2911 may produce the shunt inductance $L_L$, while the series inductance $L_R$ may be attributed to the cell patch 2913 and the feed line on the substrate, and $C_R$ is due to the substrate being sandwiched between the cell patch 2913 and the virtual ground formed between the two via lines 2919-1 and 2919-2.

Figure 30:
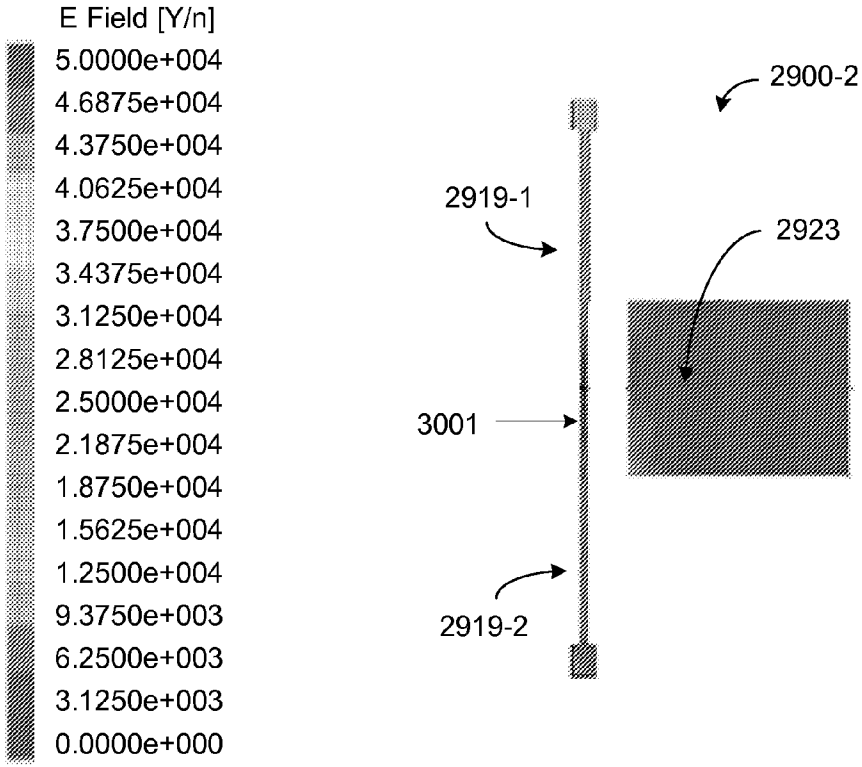
FIG. 30 illustrates an E-field distribution plot of a bottom layer of the balanced antenna device shown in FIG. 29B, according to an example embodiment.

FIG. 30 illustrates an E-field distribution plot of the via line 2919 and the disconnected ground element 2923 on the bottom layer 2900-2 of the balanced antenna device 2900 shown in FIG. 29B. With the ground element 2923 disconnected from the via line 2919, the approximate magnitude values of the E-field distribution of the via line 2919 near or at its center 3001, which may coincide with the line of symmetry 2927, match the E-field magnitude values of the ground element 2923. Thus, the via line 2919 at or near the line of symmetry 2927 may effectively act as a virtual ground.

Figure 31:
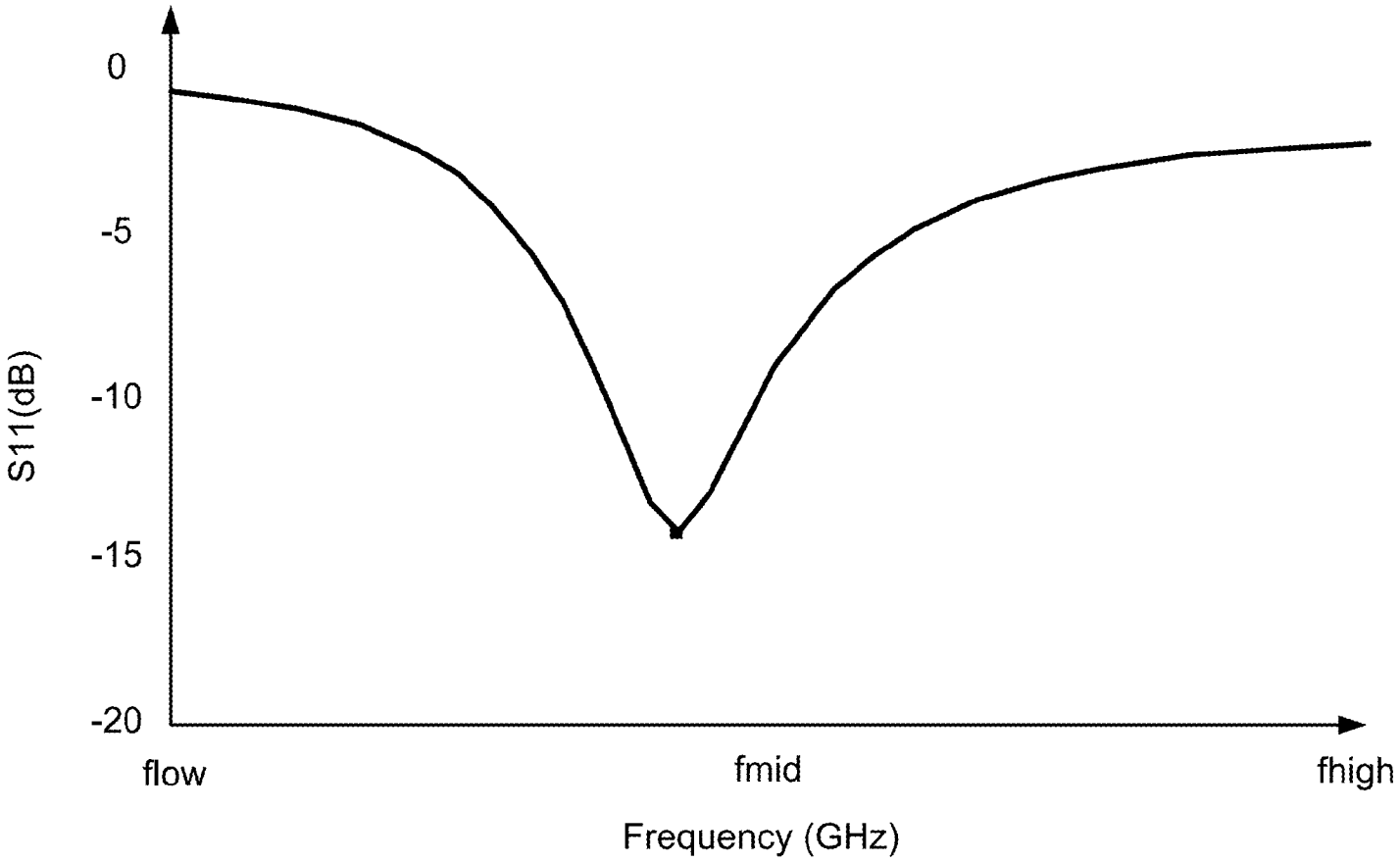
FIGS. 31 and 32 respectively illustrate a simulated return loss and radiation pattern results at 2.44 GHz for the virtual ground case shown in FIGS. 29A-29B, according to an example embodiment.
Figure 32:
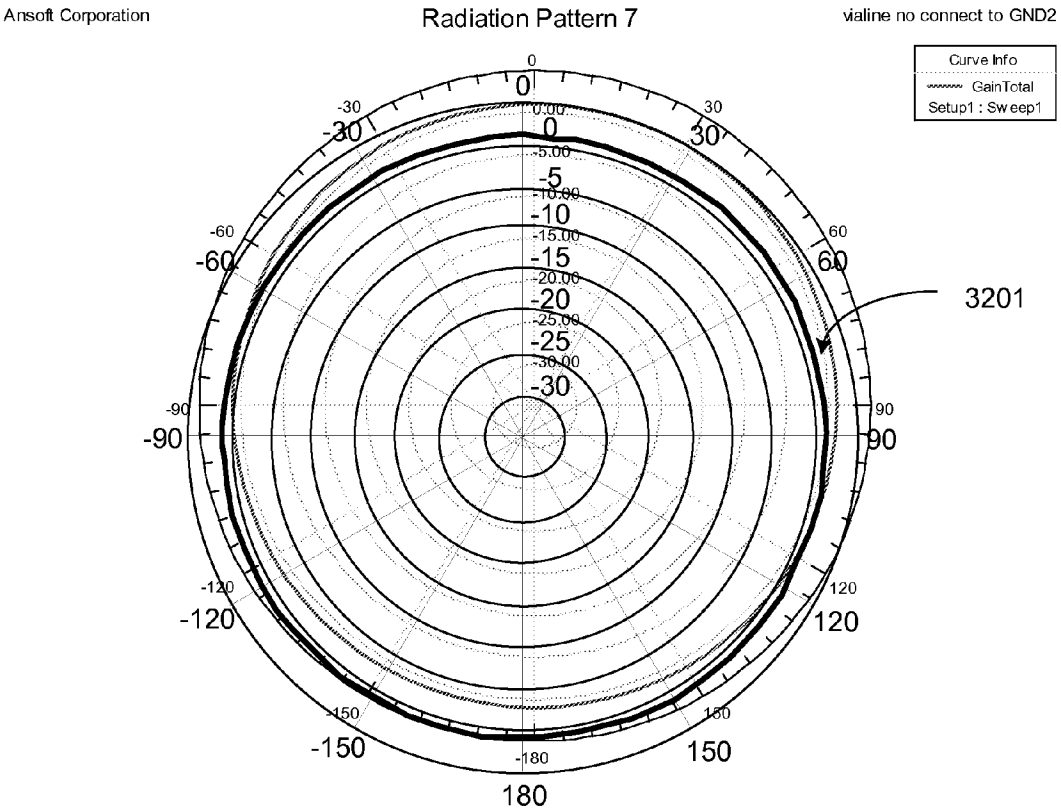

Simulated return loss and radiation pattern results at 2.44 GHz for the virtual ground case shown in FIGS. 29A-29B are provided in FIGS. 31 and 32, respectively, as to compare the fundamental performance parameters with the free space case shown in FIG. 17. A comparison of the return loss between the virtual ground case and the free space case shows similar matching results (compare dashed line of FIG. 19 to FIG. 31). The peak band can be attributed to an LH resonance of the MTM antenna. The radiation pattern produced in the virtual ground case shows an omnidirectional pattern 3201 with ripples less than 2 dB is achieved in the azimuthal plane (x-y), which matches the radiation pattern produced by the free space case. These results indicate that the virtual ground may be used in place of the ground element 2923, and thus make it possible to reduce the size of the balanced MTM antenna device 1300.

Virtual Ground Balanced MTM Antenna (Dual Band)

Figures 33A, 33B:
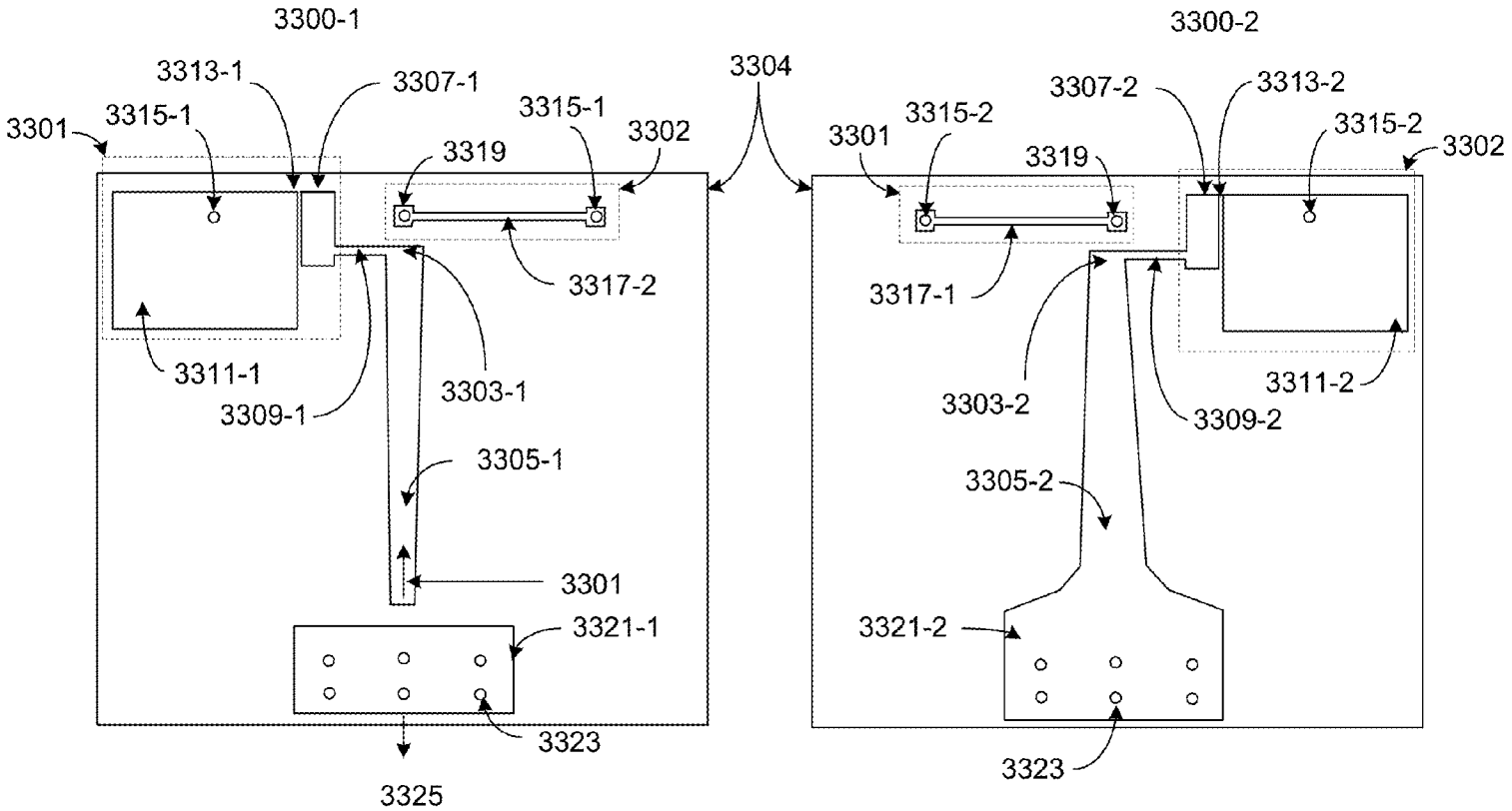
FIGS. 33A-33C illustrate structural details of virtually grounded dual band antenna device including a top view of a top layer, a top view of a bottom layer, and a perspective view of both layers, respectively, according to an example embodiment.
Figure 33C:
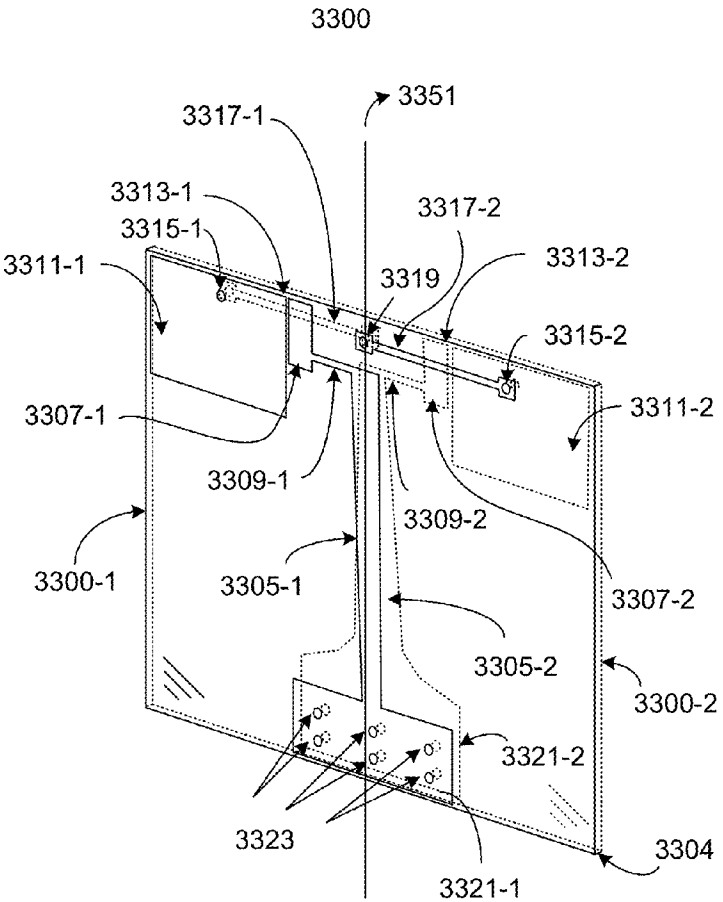

FIGS. 33A-33C illustrate a virtually grounded, dual band, balanced CRLH antenna device 3300. The balanced MTM antenna device 3300 may be structured to include a balanced pair of CRLH antenna portions having a virtually grounded via line and a balun which are formed on a substrate, such as FR-4, to achieve a substantially omnidirectional radiation pattern covering 2.4 and 5.0 GHz frequency bands.

FIGS. 33A, 33B, and 33C provide structural details of the antenna device 3300 and illustrate a top view of a top layer 3300-1, a top view of a bottom layer 3300-2, and a perspective view of both layers, respectively.

The MTM balanced antenna device 3300 includes two radiating CRLH antenna portions 3301 and 3302, which are configured to be balanced, and a balun 3305 which acts to couple the two balanced CRLH antenna portions to an unbalanced RF source such as a coax cable. The coax cable, for example, may include a conductive inner core and a conductive shield to communicate a signal transmission.

In FIGS. 33A-33B, the MTM antenna device 3300 includes a first CRLH antenna portion 3301 and second CRLH antenna portion 3302, each CRLH antenna portion having conductive elements formed on a top layer 3300-1 and a bottom layer 3300-2. Both first CRLH antenna portion 3301 and second CRLH antenna portion 3302 are physically symmetrical and balanced. Conductive elements in the top layer 3300-1 are constructed on the top surface of a substrate 3304, such as FR-4, and conductive elements in the bottom layer 3300-2 are constructed on the bottom surface of the substrate 3304. Each CRLH antenna portion 3301 and 3302 may further be configured to include a feed port 3303; a feed line 3309 connected to the feed port 3303; a launch pad 3307 connected to the feed line 3309, wherein the cell patch 3311 is capacitively coupled to the top launch pad 3307; a via 3315 formed in the substrate and connected to the cell patch 3311; a via line 3317 connected the via 3315; and a center via 3319 connected to the via line 3317, in which the center via 3319 is centrally positioned between and connects the first CRLH antenna portion to the second CRLH antenna portion. Thus, the via line 3317 forms a common conductive line between the two antenna portions 3301 and 3302. During operation, the bottom feed port 3303-2 communicates a signal which is 180° out of phase from another signal communicated by the top feed port 3303-1. The center of the via 3319, which is formed along a line of symmetry 3351 dividing the two MTM antenna portions as shown in FIG. 33C, is structured and engineered to behave effectively as a virtual ground having a zero potential and thereby eliminating the need for a physical ground used to terminate the top and bottom via lines 3317. Thus, one aspect of the balanced property of the MTM antenna device 3300 is achieved by feeding the top and bottom CRLH antenna portions with a 180° offset and forming antenna elements that are symmetrical along the virtual ground.

The balun 3305 includes a top balun portion 3305-1 formed on the top layer 3300-1 and bottom balun portion 3305-2 formed on the bottom layer 3300-2 for adapting the balanced CRLH antenna portions to an unbalanced RF source such as a coax cable. The balun 3305 has a first shape for the top balun portion 3305-1 and a different shape for the bottom balun portion 3305-2. The shapes in the example embodiment illustrated in FIGS. 33A and 33B are not symmetric alone or in combination, but rather provide complementary portions, one coupled to the antenna portion 3301 and the other to the antenna portion 3302. In this embodiment, the antenna elements 3301 and 3302 are in different substrate layers. This spatial configuration allows for the distributed balun structure, wherein the balun portions 3305-1 and 3305-2 are also in different substrate layers. The balun portions 3305-1 and 3305-2 are not directly connected through the dielectric of substrate 3304.

Referring to FIG. 33A, one end of the top balun portion 3305-1 is connected to the feed port 3303-1 associated with the first CRLH antenna portion 3301 formed on a top layer 3300-1. The other end of the top balun portion 3305-1 provides a feed port 3301 to connect the top balun portion 3305-1 to a first signal line of the RF source, such as the inductive inner core of the coax cable.

In FIG. 33B, one end of the bottom balun portion 3305-2 is connected to the feed port 3303-2 associated with the second CRLH antenna portion 3302 formed on a bottom layer 3300-

2. The other end of the bottom balun portion 3305-2 may be connected to a portion of a bottom ground 3321-2 formed on the bottom layer 3300-2. The area and size of the ground may be increased by using an array of vias 3323 that are formed in the substrate for connecting the bottom ground 3321-2 to a top ground 3321-1 formed on the top layer 3300-1. Subsequently, the ground 3321 may be connected to a second signal line of the RF source, such as the conductive shield of the coax cable for communicating an unbalanced RF signal to the balanced antenna device 3300.

Figure 34:
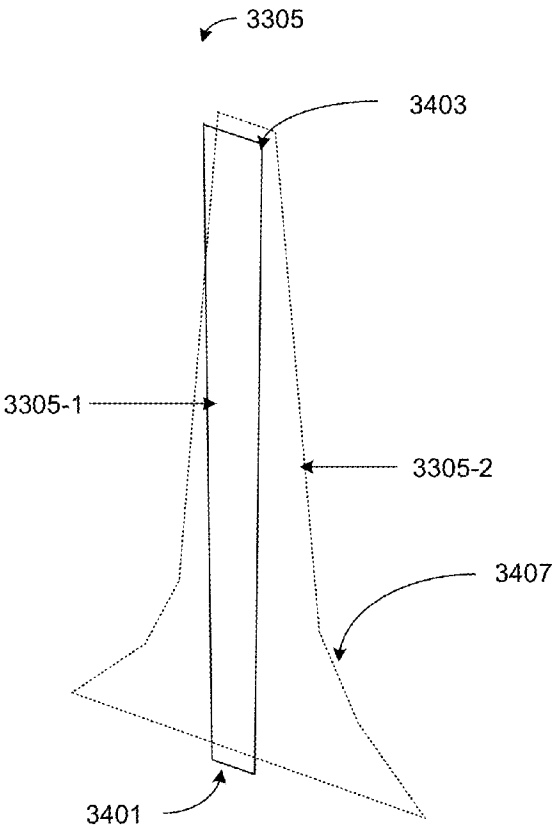
FIG. 34 illustrates a tapered design associated with the balanced MTM antenna device shown in FIGS. 33A-33B balanced MTM antenna device, according to an example embodiment.

The balun, as described in the previous examples, may be designed in a variety of ways for adapting an unbalanced signal to a balanced signal and vice versa, such as, for example, a 50 ohm unbalanced signal to a 50 ohm balanced signal. The balun may be configured to support broadband frequencies such as from 2.0 GHz to 6.0 GHz, for example. Some balun designs are described by Mark A. Campbell, M. Okoniewski, Elise C. Fear "Ultra-Wideband Microstrip to Parallel Strip Balun with Constant Characteristic Impedance", Department of Electrical and Computer Engineering, University of Calgary. FIGS. 33A-33C illustrate an example of a tapered balun design. The tapered design, as illustrated in FIG. 34, for example, includes a top balun 3305-1 having a profile that gradually changes from a first dimensions, to a second dimension. As illustrated the first dimension may be similar to a 1.17 mm microstrip 3401, while the second dimension may be similar to a 1.6 mm parallel strip 3403. The balun 3305 also includes a bottom balun 3305-2 having a hyperbolic 3407 profile that gradually changes from a third dimension to a fourth dimension, having a fan shape. In one example, the third dimension is 10 mm, while the fourth dimension is 1.6 mm. At each cross-sectional point along its length, the hyperbolic profile 3407 of the bottom balun 3305-2 provides characteristic impedance that is held constant, such as at 50 ohm.

Other balun designs can be implemented to provide the constant characteristic impendence as input to the balanced antenna structure. These balun designs may include, for example, planar configurations such as a log-periodic balun and marchand balun which are described in "Wideband, Planar, Log-Periodic Balun" by Mahmoud Basraoui and "Design of improved marchand balun using patterned ground plane" by S. N. Prasad, Senior Member, IEEE Department of ECE, Bradley University, Peoria, Ill. and N S Sreeram, I ME Microelectronics, SR. No: 04892, respectively. Furthermore, in other implementations, baluns can be formed using lumped or distributed type elements.

Dual band characteristics of the balanced MTM antenna device 3300 include conductive elements that influence the 2.4 GHz and 5 GHz frequency bands. For the 2.4 GHz band, these conductive elements include, for example, the top cell patch, top launch pad, top feed line, top via line, first via, the second via, the bottom cell patch, bottom launch pad, bottom feed line, bottom via line, and third via. Conductive elements that affect the 5 GHz band include, for example, the top and bottom launch pad and top and bottom feed line. The 2.4 GHz and 5 GHz bands result from an LH resonance and an RH resonance associated with the MTM antenna portion, respectively.

Figure 35:
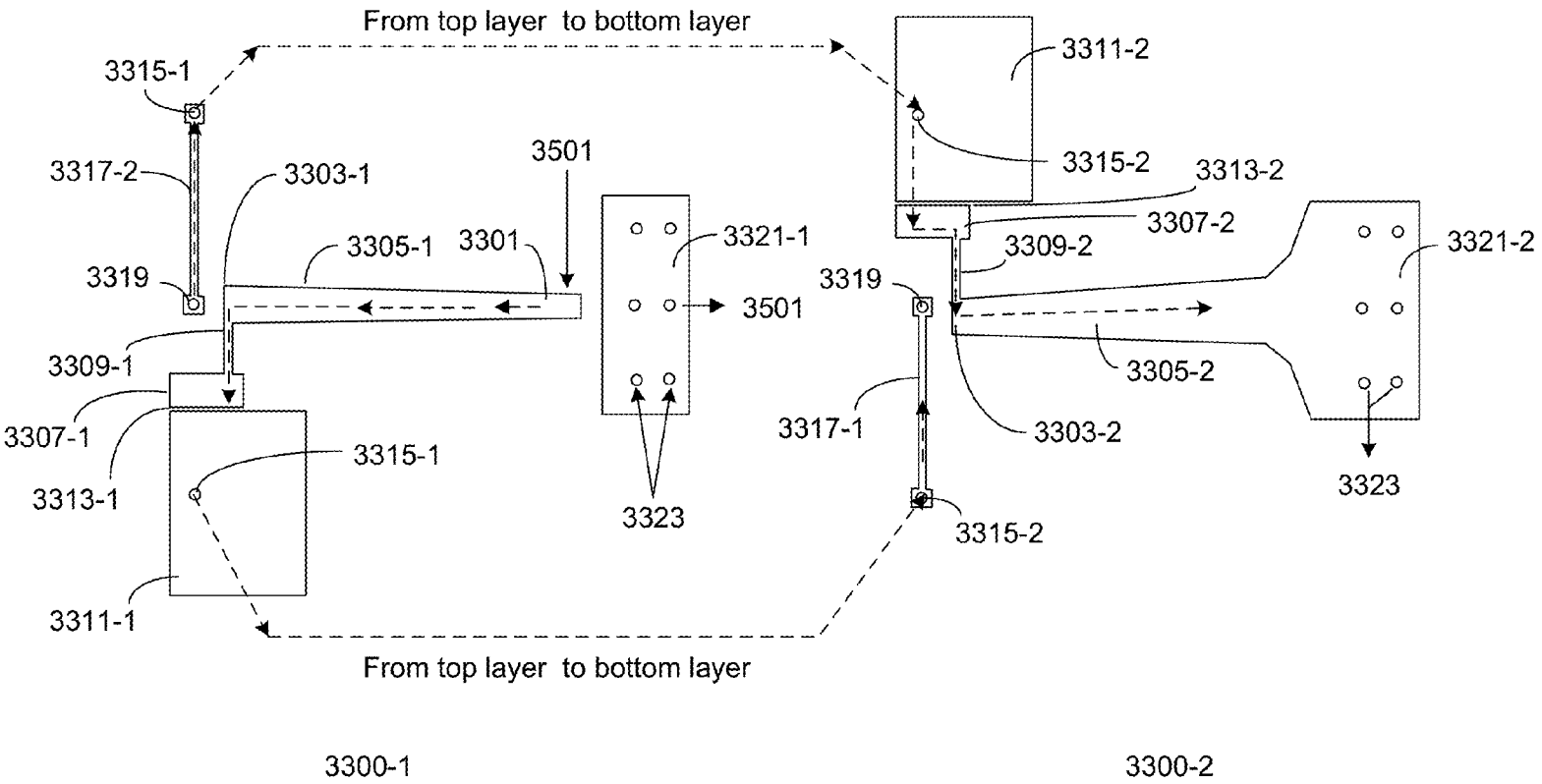
FIG. 35 illustrates a schematic of the current flow in the balanced MTM antenna device presented in FIGS. 33A-33C, according to an example embodiment.

FIG. 35 illustrates a schematic of the current flow in the balanced MTM antenna device 3300 presented in FIGS. 33A-33C. The dominant current (dashed lines) is maintained to be 180 degrees out of phase to provide balanced antenna properties in this structure. Polarizations are generally in the same plane as the dominant current. Thus, the cross polarization component is small in this structure because other current components cancel each other as can be seen from this figure.

As shown in FIG. 35, current (dashed lines) from an external source 3501, such as a coaxial cable, enters the MTM balanced antenna from the feed port 3301 to the top balun 3305-1. The current from the top balun 3305-1 flows to the top launch pad 3307-1 via the top feed line 3309-1. Current from the top launch pad 3307-1 is passed to the top cell patch 3311-1 due to the capacitive coupling formed between the top launch pad 3307-1 and the top cell patch 3311-1. The via 3315-1, which is formed in the substrate and connected to the top cell patch 3311-1, provides a conductive path from the top cell patch 3311-1 to the bottom via line 3317-1 which is connected to the center via 3319. The center via 3319, which is formed in the substrate and located at the distal end of the bottom via line 3317-1, provides a conductive pathway between the bottom via line 3317-1 and the top via line 3317-2. Current from the top via line 3317-2 flows to another via 3315-1, which is formed in the substrate and projected above and conductively connected to the bottom cell patch 3311-2. The bottom cell patch 3311-2 is capacitively coupled to the bottom launch pad 3307-2 and provides a conductive path for the current to flow to the bottom feed line 3309-2 which is connected to the bottom ground 3321-2 via the bottom balun 3305-2. The current proceeds to the top ground 3321-1 which provides a connection to the external source 3501.

Figure 36B:
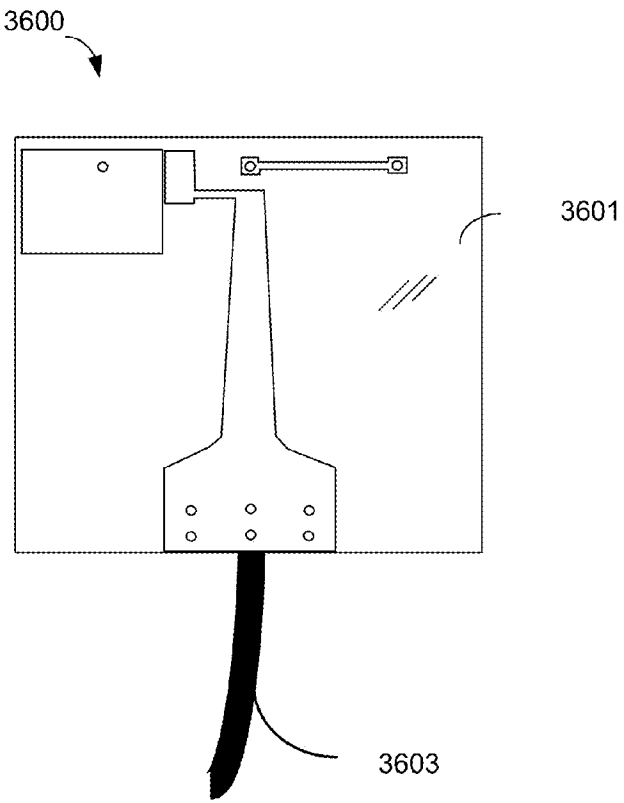
FIGS. 36A-36B illustrate top and bottom drawings, respectively, of a fabricated model of the balanced MTM antenna device, according to an example embodiment.
Figure 36A:
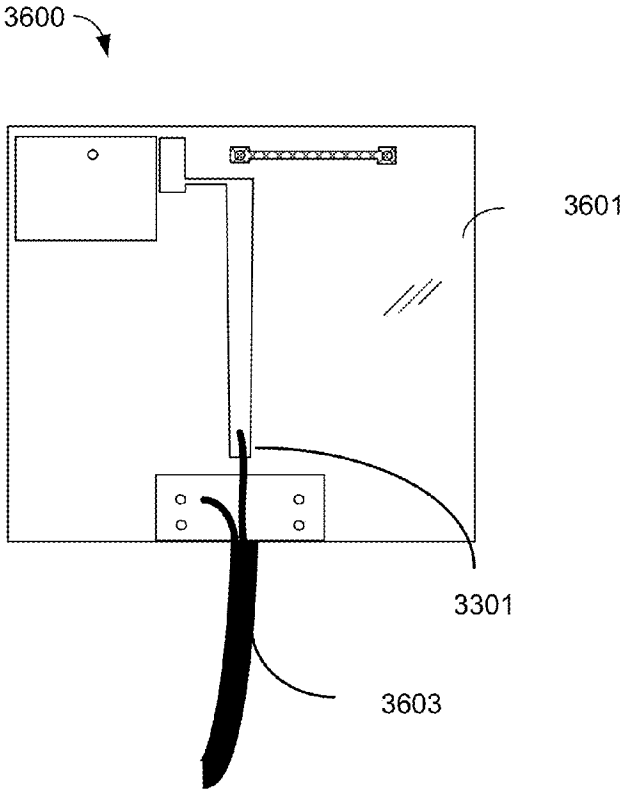

FIGS. 36A-36B illustrate top and bottom drawings, respectively, of a fabricated model 3600 of the balanced MTM antenna device 3300 according to an example embodiment in which a coaxial cable 3603 is connected to the feed port 3301. The fabricated model 3600 is constructed on an FR-4 substrate 3601, which measures approximately 28 mm×25 mm. The design of the balanced MTM antenna device 3300 provided in this example is made for certain dual-band applications such as 2.4 GHz and 5 GHz Wi-Fi. However, designs for other frequency applications, e.g., lower or higher frequencies, can be made by modifying the total size of selective elements while keeping the same basic configuration of the elements.

Performance of the dual band balanced MTM antenna device 3300 can be measured and evaluated based on the fundamental antenna parameters for each frequency band, i.e., 2.4 GHz and 5 GHz, which are provided in FIGS. 37-40 and FIGS. 41-44, respectively.

Figure 37:
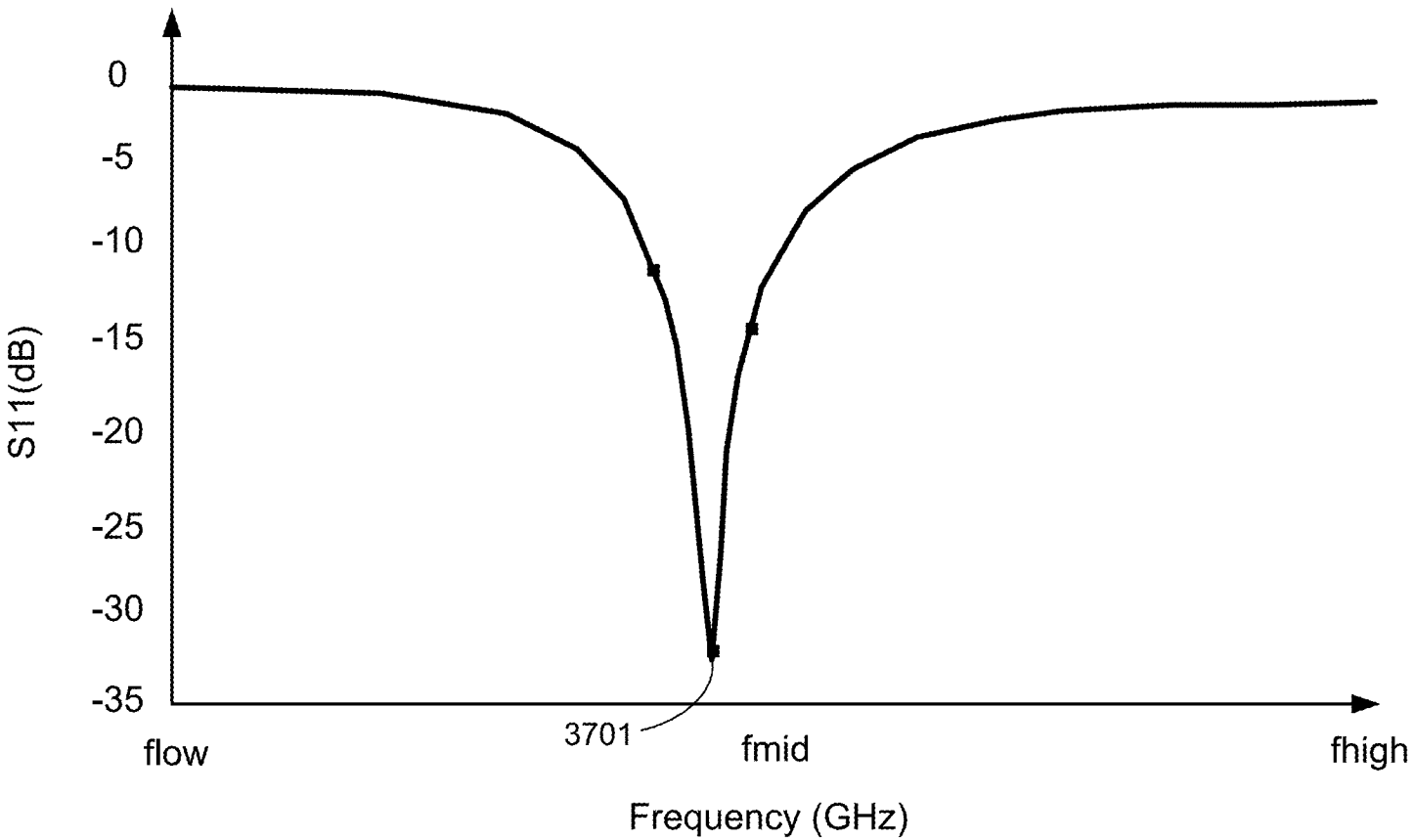
FIG. 37 illustrates a measured return loss plot for the 2.4 GHz frequency band, according to an example embodiment.

Based on the measured return loss plot for the 2.4 GHz frequency band, as illustrated in FIG. 37, the magnitude and steepness of the inverted peak near or at a target frequency 3701 suggests that the dual band balanced MTM antenna device 3300 is capable of supporting good matching in the 2.4 GHz frequency band.

Figure 38:
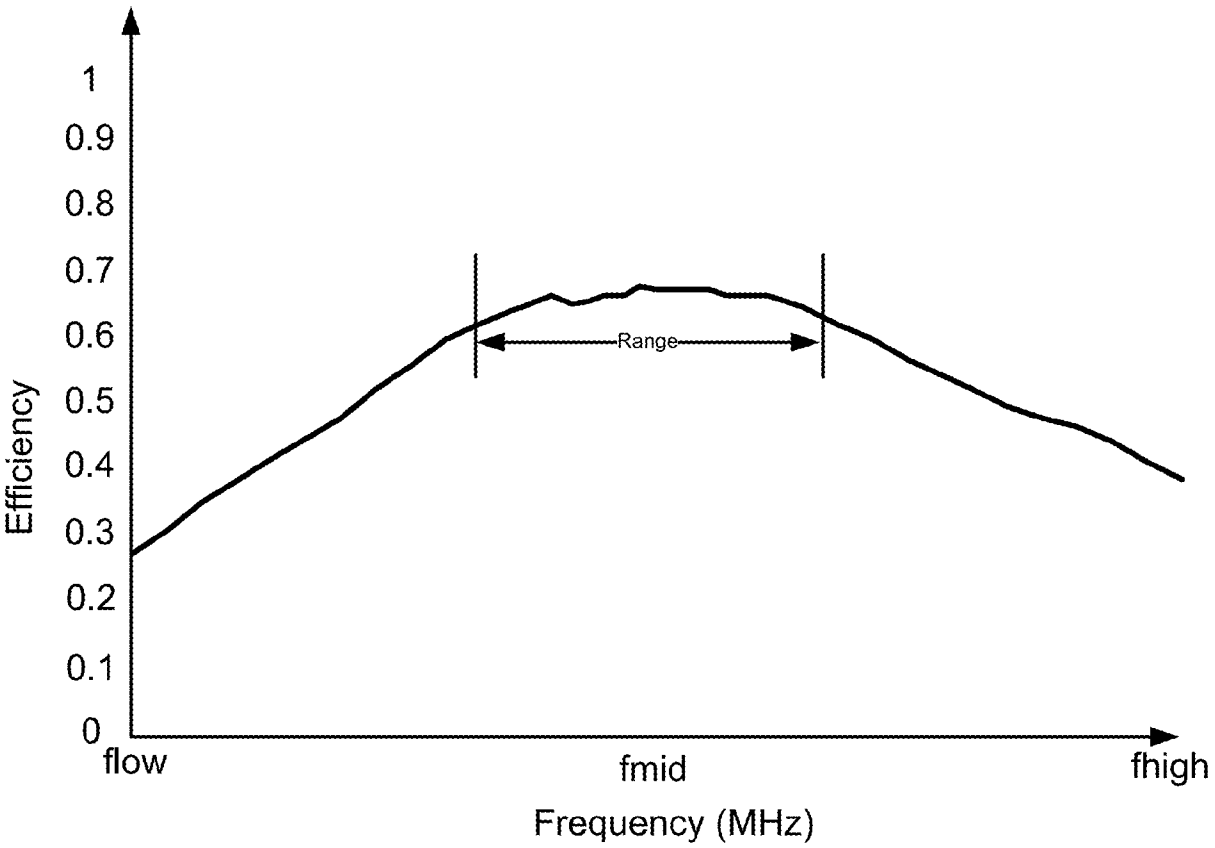
FIG. 38 illustrates a measured efficiency for the 2.4 GHz frequency band of the dual band balanced MTM antenna device, according to an example embodiment.

FIG. 38 illustrates measured efficiency for the 2.4 GHz frequency band of the dual band balanced MTM antenna device 3300. This result indicates that the antenna device 3300 is capable of achieving an average efficiency, over a given range of frequencies, which is equal or better than 60%.

Figure 39:
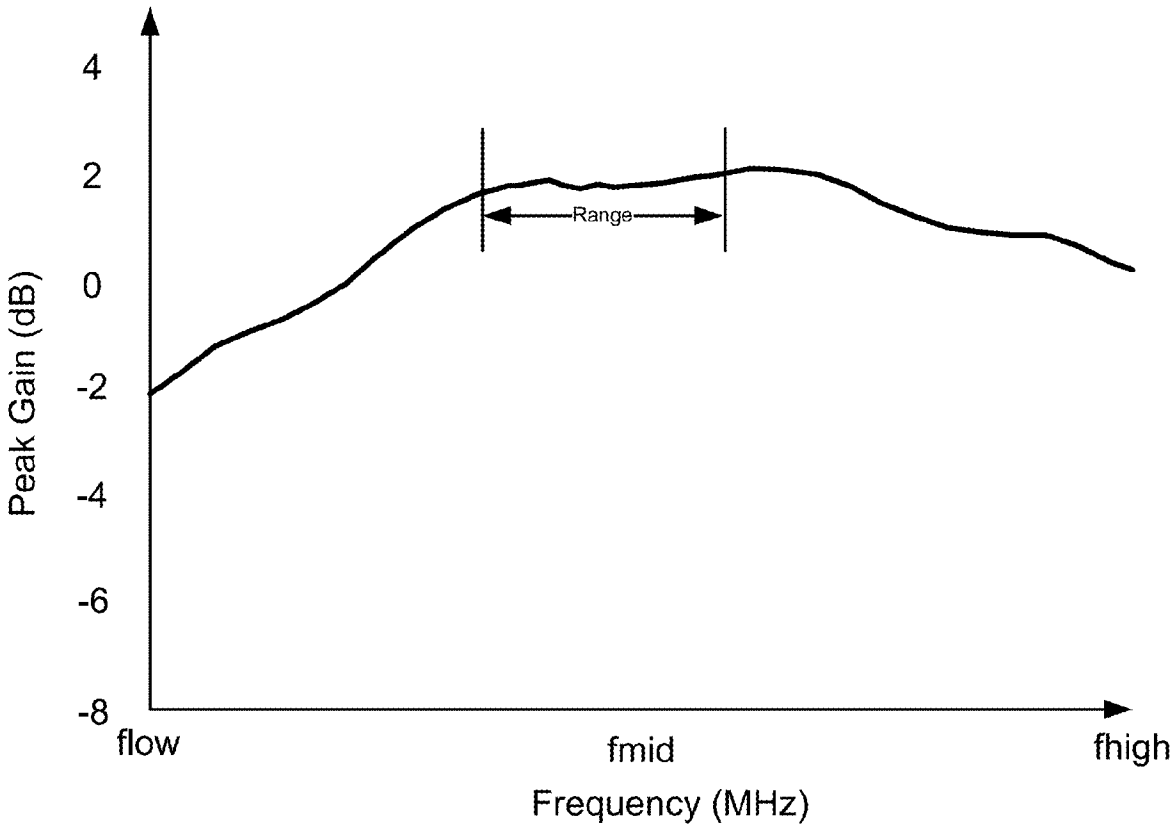
FIG. 39 illustrates measured peak gain for the 2.4 GHz frequency band of the balanced MTM antenna device, according to an example embodiment.

FIG. 39 illustrates measured peak gain for the 2.4 GHz frequency band of the balanced MTM antenna device 3300. The peak gain may be defined as the ratio of surface power radiated by the measured antenna to the surface power radiated by a hypothetical isotropic antenna and can serve as a useful antenna metric for comparing the measured antenna gain to a gain of reference antenna, such as the isotropic antenna. For example, in FIG. 39, a 2 dBi peak gain within the bandwidth of the antenna suggests that the balanced MTM antenna device 3300 has more than a 2 dB gain over the reference isotropic antenna.

Figure 40:
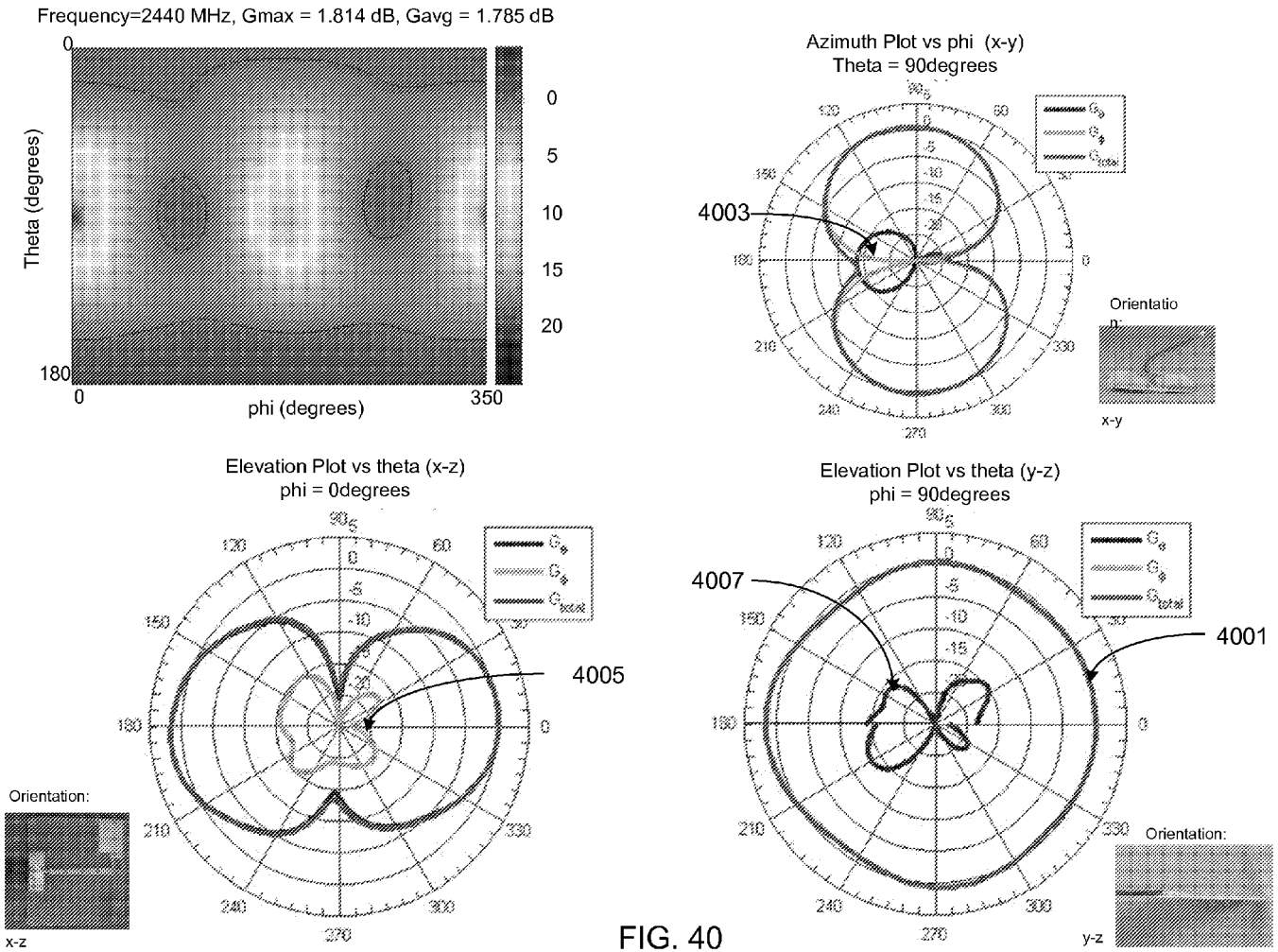
FIG. 40 illustrates the gain and radiation patterns at 2.4 GHz for the case of free space, according to an example embodiment.

FIG. 40 illustrates the measured gain and radiation patterns at 2.4 GHz for the case of free space. The orientation of the balanced MTM antenna device 3300 is shown in a drawing for each radiation pattern to indicate the coordinates. A substantially omnidirectional pattern 4001 with ripples less than 1 dB is achieved in the y-z plane. Furthermore, it can also be seen that the cross polarizations 4003, 4005, and 4007 measured in the three different planes are negligible.

Figure 41:
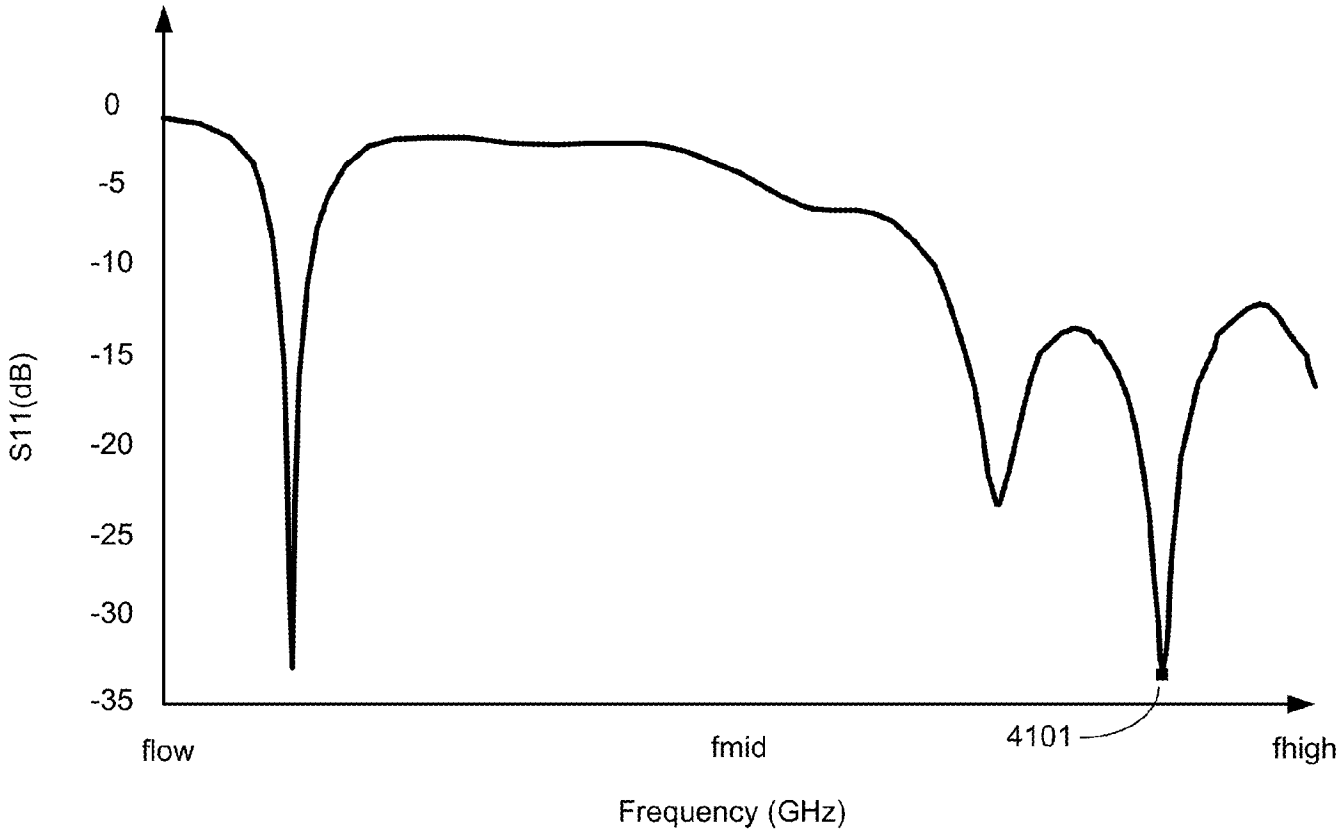
FIG. 41 illustrates measured return loss for the 5 GHz frequency band of the balanced MTM antenna device, according to an example embodiment.

FIG. 41 illustrates measured return loss for the 5 GHz frequency band of the balanced MTM antenna device 3300. Based on the measured return loss plot for the 5 GHz frequency band, the magnitude and steepness of the inverted peak near or at a target frequency 4101 suggests that the dual band balanced MTM antenna device 3300 is capable of supporting good matching in the 5 GHz frequency band.

Figure 42:
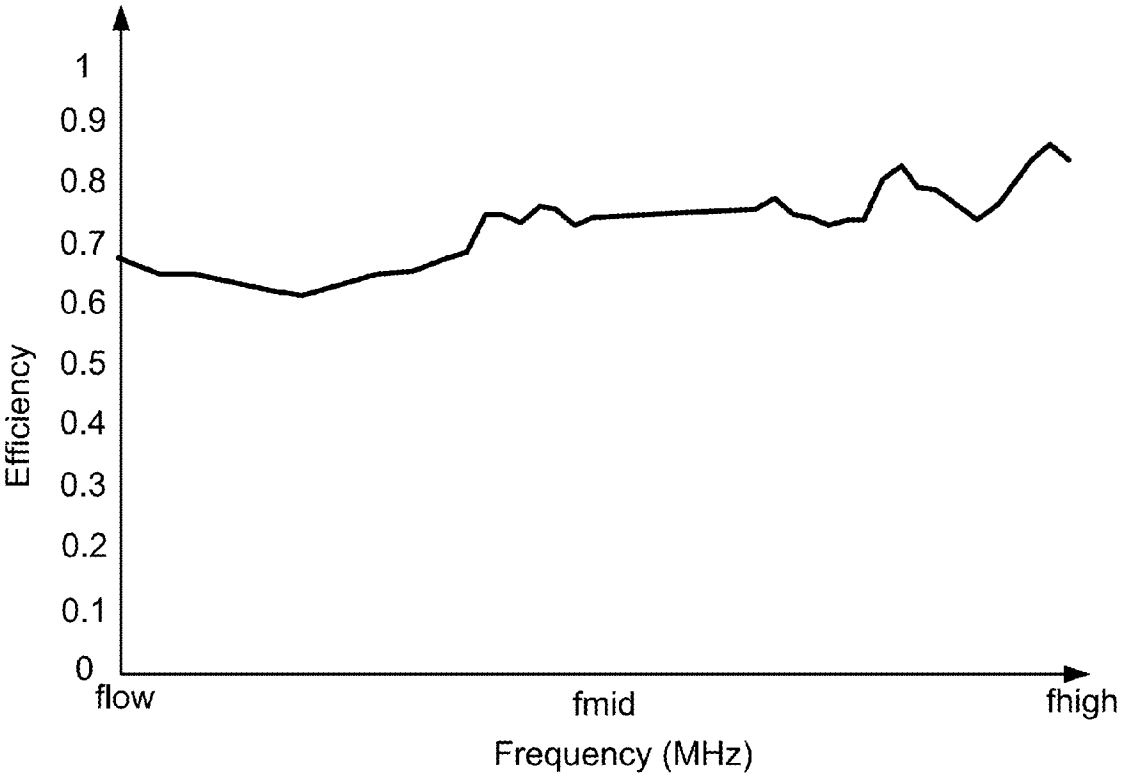
FIG. 42 illustrates measured efficiency for the 5 GHz frequency band of the dual band balanced MTM antenna device, according to an example embodiment.

FIG. 42 illustrates measured efficiency for the 5 GHz frequency band of the dual band balanced MTM antenna device 3300. This result indicates that the antenna device 3300 is capable of achieving an average efficiency, over a given range of frequency, which is equal or better than 70%.

Figure 43:
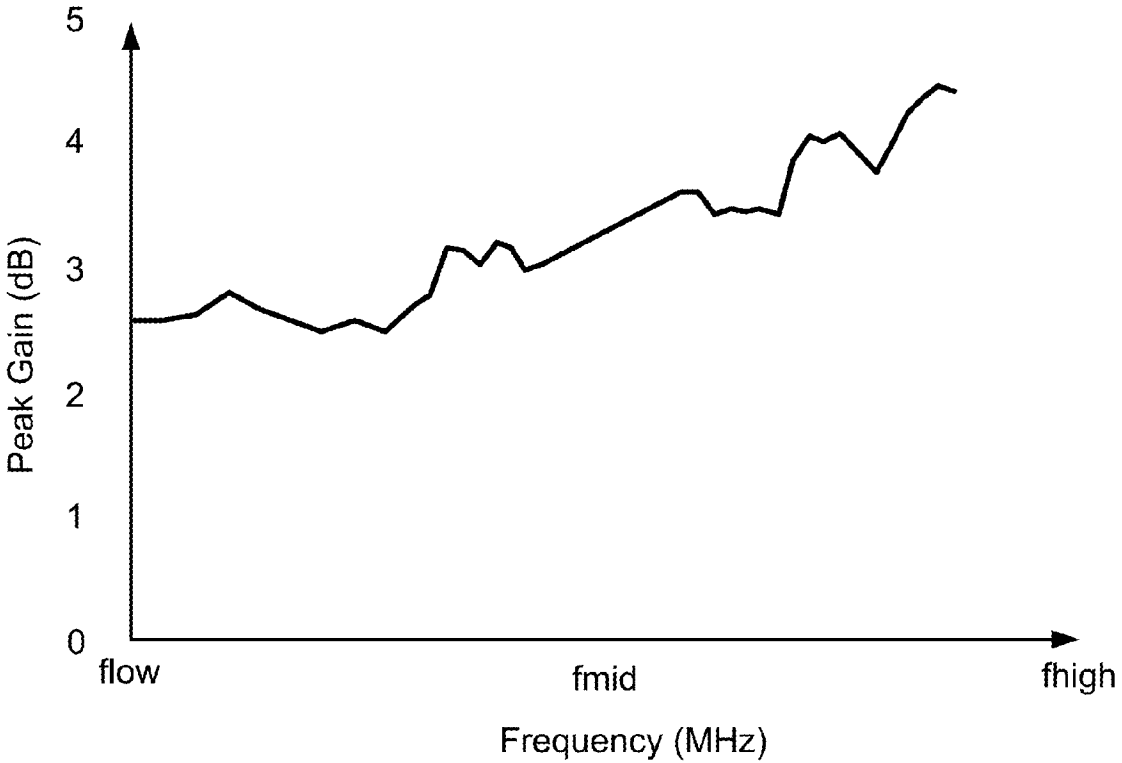
FIG. 43 illustrates a measured peak gain for the 5 GHz frequency band, according to an example embodiment.

FIG. 43 illustrates a measured peak gain for the 5 GHz frequency band. In FIG. 43, a 2.5 dBi peak gain within the bandwidth of the antenna suggests that the balanced MTM antenna device 3300 has more than a 2.5 dB gain than the reference isotropic antenna.

Figure 44:
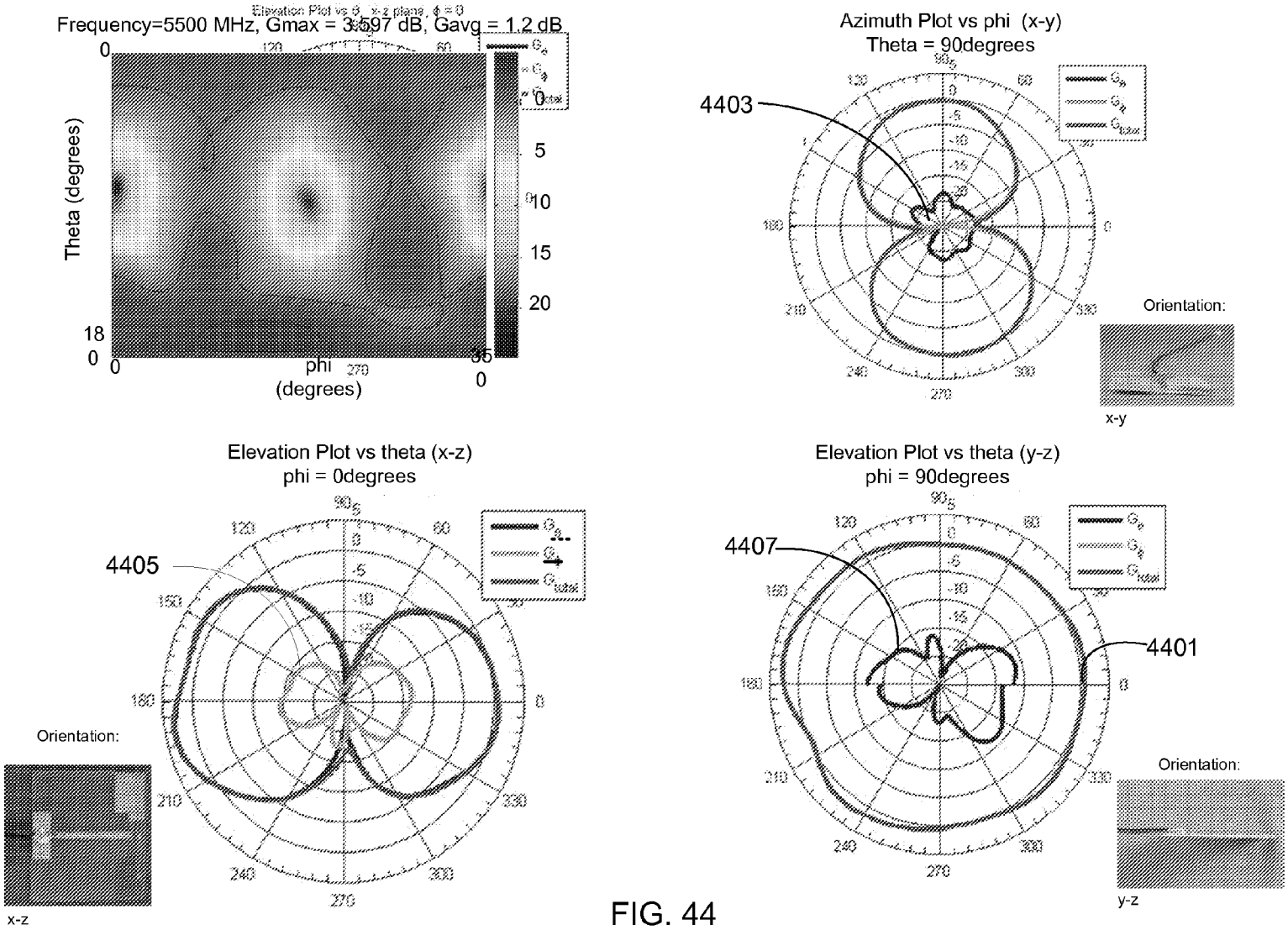
FIG. 44 illustrates the gain and radiation patterns at 5 GHz for the case of free space, according to an example embodiment.

FIG. 44 shows the gain and radiation patterns at 5 GHz for the case of free space. The orientation of the balanced MTM antenna device 3300 is shown in a drawing for each radiation pattern to indicate the coordinates. A substantially omnidirectional pattern 4401 with ripples less than 1 dB is achieved in the y-z plane. Furthermore, it can also be seen that the cross polarizations 4403, 4405, and 4407 measured in three different planes, having different orientations, are negligible.

High Gain and Wide Bandwidth Balanced MTM Antenna (with Virtual Ground)

Figures 45A, 45B:
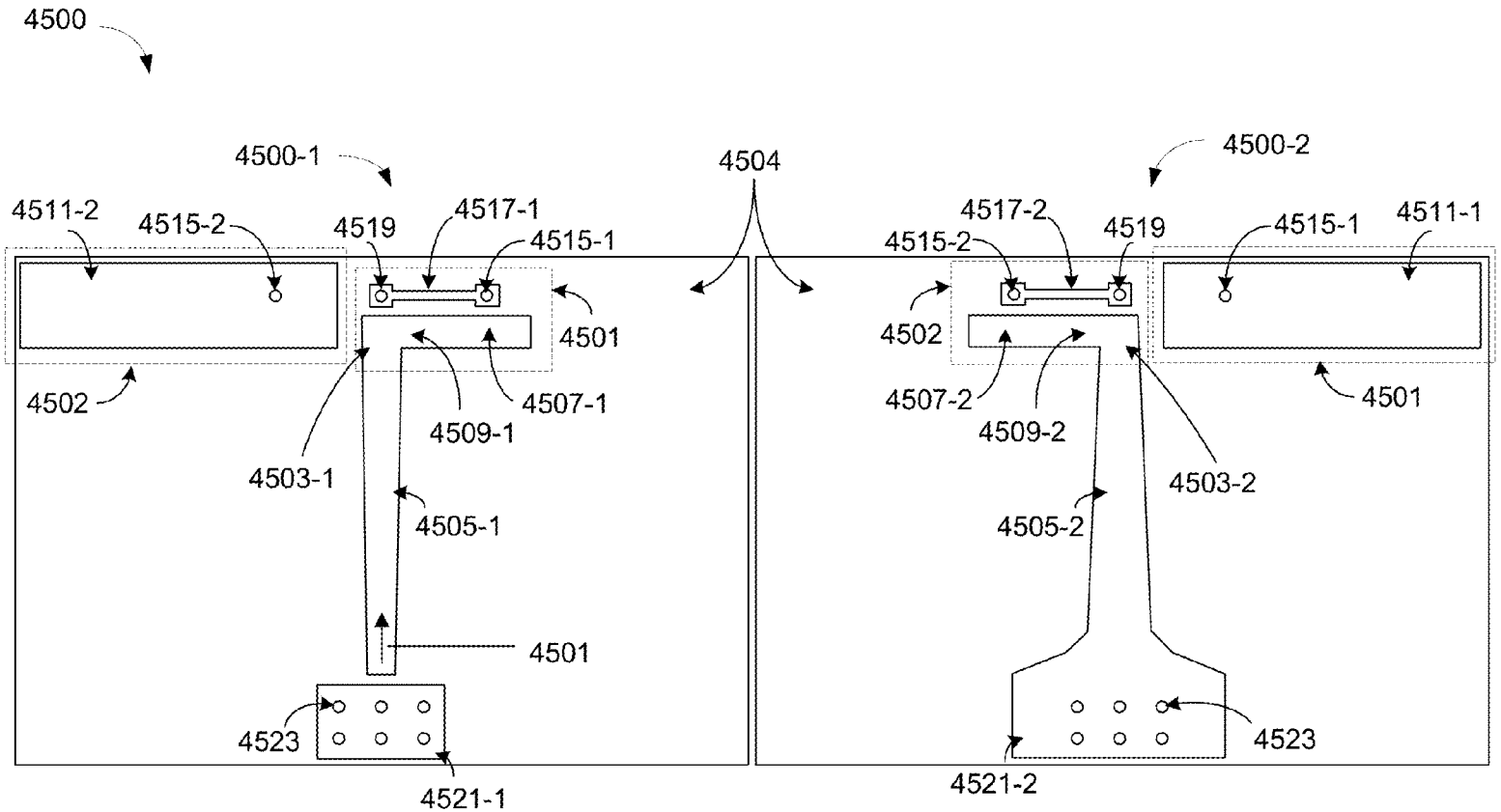
FIGS. 45A-45C illustrate a virtually grounded, high gain, wide bandwidth, balanced MTM antenna device, according to an example embodiment.
Figure 45C:
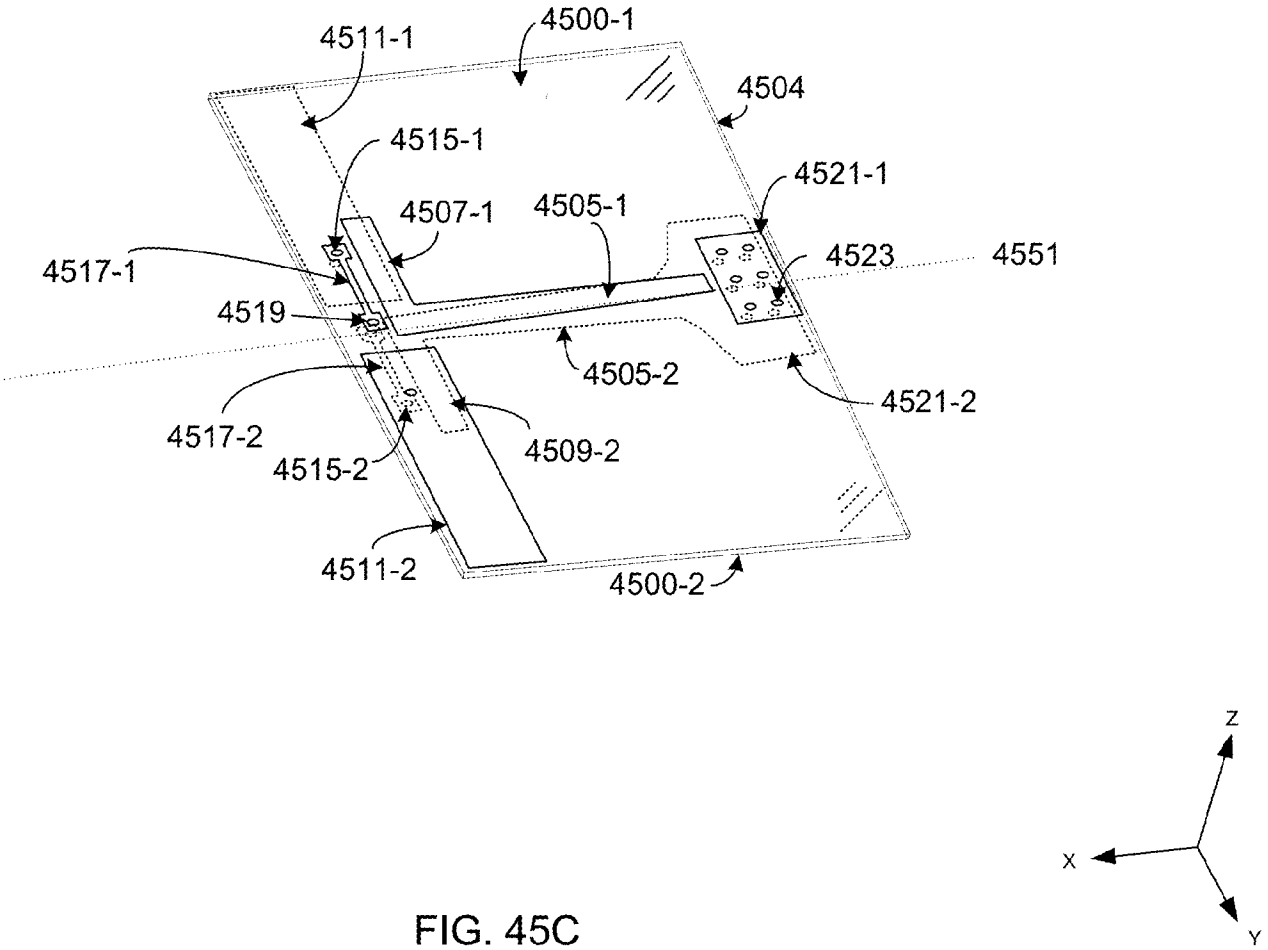

FIGS. 45A-45C illustrates an embodiment of a virtually grounded, high gain, wide bandwidth, balanced MTM antenna device 4500. The balanced MTM antenna device 4500, as in the previous balanced antenna examples, may be structured to include a balanced pair of CRLH antenna portions having a virtually grounded via line and a balun which are formed on a substrate, such as FR-4, to achieve a substantially omnidirectional radiation pattern. However, the antenna device 4500, according to this embodiment, differs from the previous examples in that it may be constructed and optimized for a wide band operation rather than for the single or dual band operations described in the previous designs.

In FIGS. 45A-45B, the MTM antenna device 4500 includes a first CRLH antenna portion 4501 and second CRLH antenna portion 4502, each CRLH antenna portion having at least one conductive element formed on a top layer 4500-1 and a bottom layer 4500-2. The first CRLH antenna portion 4501 and second CRLH antenna portion 4502 are symmetrical and balanced. Conductive elements in the top layer 4500-1 are constructed on the top surface of a substrate 4504, such as FR-4, and conductive elements in the bottom layer 4500-2 are constructed on the bottom surface of the substrate 4504. Each CRLH antenna portion is configured to include a cell patch, and to interact with a feed port 4503. A feed line 4509 connected to the feed port 4503, a launch pad 4507 connected to the feed line 4509, wherein the cell patch 4511 is formed on the opposing layer of the substrate 4504, and capacitively and vertically coupled to the top launch pad 4507. A via 4515 is formed in the substrate 4504 and connected to the cell patch 4511; and a via line 4517 connects to the via 4515; and a center via 4519 connected to the via line 4517, in which the center via 4519 is centrally positioned between and connects the first CRLH antenna portion 4501 to the second CRLH antenna portion 4502. Thus, the via line 4517 forms a common conductive line between the two antenna portions 4501 and 4502. During operation, the bottom feed port 4503-2 communicates a signal which is 180° out of phase from another signal communicated by the top feed port 4503-1. The center of the via 4519, which is formed along a line of symmetry 4551 dividing the two radiating CRLH antenna portions as shown in FIG. 45C, is structured and engineered to behave effectively as a virtual ground having a zero potential and thereby eliminating the need for a physical ground used to terminate the top and bottom via lines 4517-1 and 4517-2. Thus, one aspect of the balanced property of the MTM antenna device 4500 is achieved by forming symmetric antenna elements with respect to a virtual ground point and feeding top and bottom CRLH antenna portions 4501 and 4502 with signals which are 180° offset from each other.

The balun 4505 includes a top balun portion 4505-1 formed on the top layer 4500-1 and bottom balun portion 4505-2 formed on the bottom layer 4500-2 for adapting the balanced CRLH antenna portions 4501 and 4502 to an unbalanced RF source such as an coax cable.

Referring to FIG. 45A, one end of the top balun portion 4505-1 is connected to the feed port 4503-1 associated with the first CRLH antenna portion formed on a top layer 4500-1. The other end of the top balun portion 4505-1 provides a feed port 4501 to connect the top balun portion 4505-1 to a first signal line of the RF source, such as the inductive inner core of the coax cable.

In FIG. 45B, one end of the bottom balun portion 4505-2 is connected to the feed port 4503-2 associated with the second CRLH antenna portion formed on a bottom layer 4500-2. The other end of the bottom balun portion 4505-2 may be connected to a portion of a bottom ground 4521-2 formed on the bottom layer 4500-2. The area and size of the ground may be increased by using an array of vias 4523 that are formed in the substrate for connecting the bottom ground 4521-2 to a top ground 4521-1 formed on the top layer 4500-1. Subsequently, the ground 4521 may be connected to a second signal line of the RF source, such as the conductive shield of the coax cable for communicating an unbalanced RF signal to the balanced antenna device 4500.

Several advantages may be realized in this high gain, wide bandwidth, antenna device 4500 of some embodiments. For example, for each CRLH antenna portion 4511-1, the cell patch 4511 and launch pad 4507 are formed on opposite sides of the substrate 4504 and vertically coupled and structured to overlap to one another, freeing up additional space for the cell patch 4511 which may be designed larger and, in turn, increase the efficiency of the antenna 4500.

Another advantage may be realized during the fabrication process of this antenna device. For example, the high gain, wide bandwidth, antenna device 4500, the coupling between the launch pad and the cell is accomplished through the dielectric, i.e., substrate 4504, which is made independent of the gap width and thus avoids certain production issues including possible over-etching or under-etching.

Figure 46:
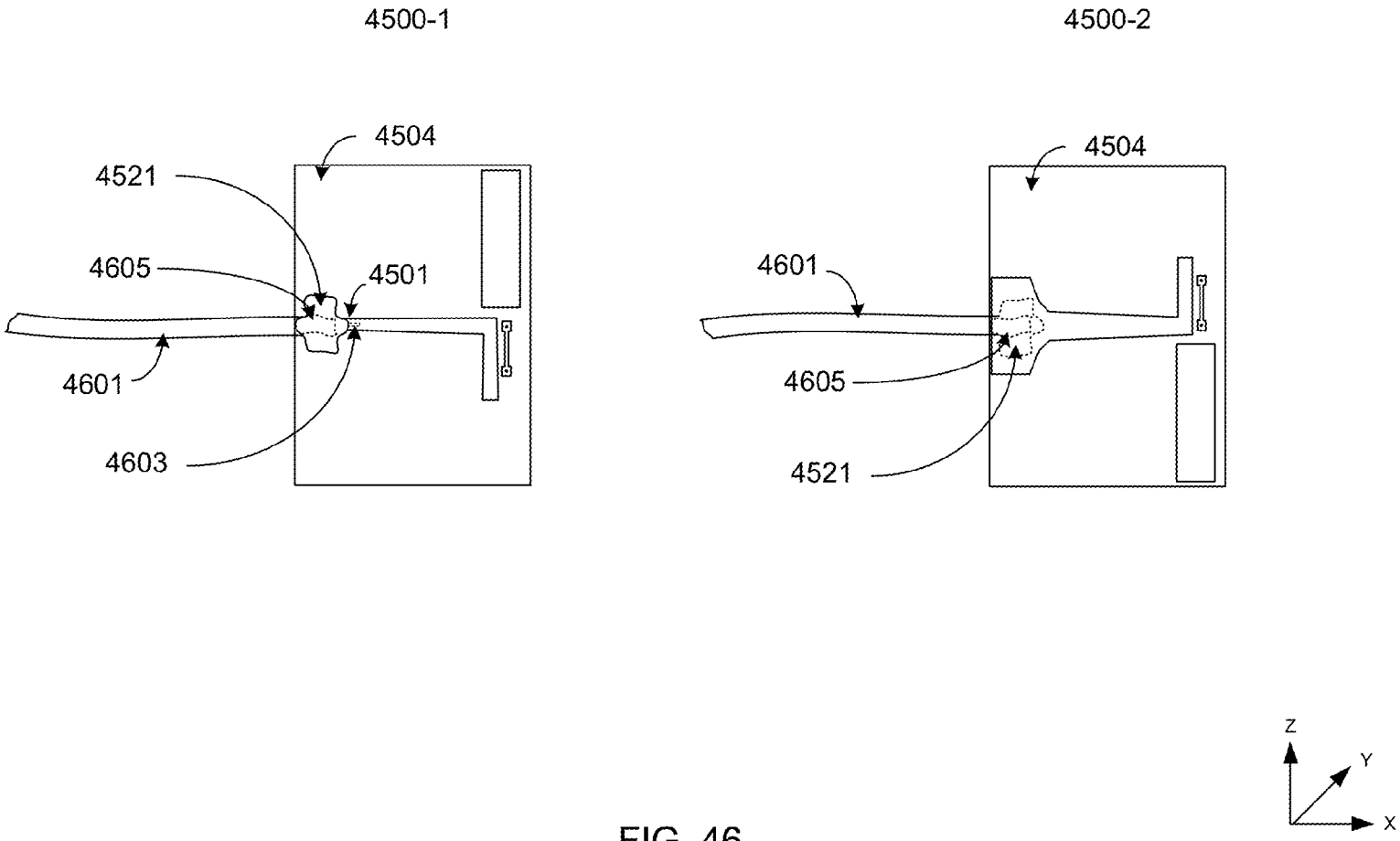
FIG. 46 illustrates a fabricated model of the balanced MTM antenna device depicted in FIGS. 45A-45C, according to an example embodiment.

FIG. 46 illustrates a fabricated model of the balanced MTM antenna device 4500 depicted in FIGS. 45A-45C. The top layer 4500-1 and bottom layer 4500-2 of the antenna device 4500 are connected to a coax cable 4601 in this fabricated antenna model. A conductive inner core 4603 and a conductive shield 1605 of the coaxial cable 4601 are respectively connected to the feed port 4501 and the ground 4521 of the balanced MTM antenna device 4500 for signal transmission.

The fabricated model shown in FIG. 46 may be tested and measured in free space to characterize and evaluate the antenna performance of this high gain, wide bandwidth, balanced MTM antenna device 4500. Some performance metrics provided in this antenna design evaluation include efficiency, return loss, peak gain and radiation properties.

Figure 47:
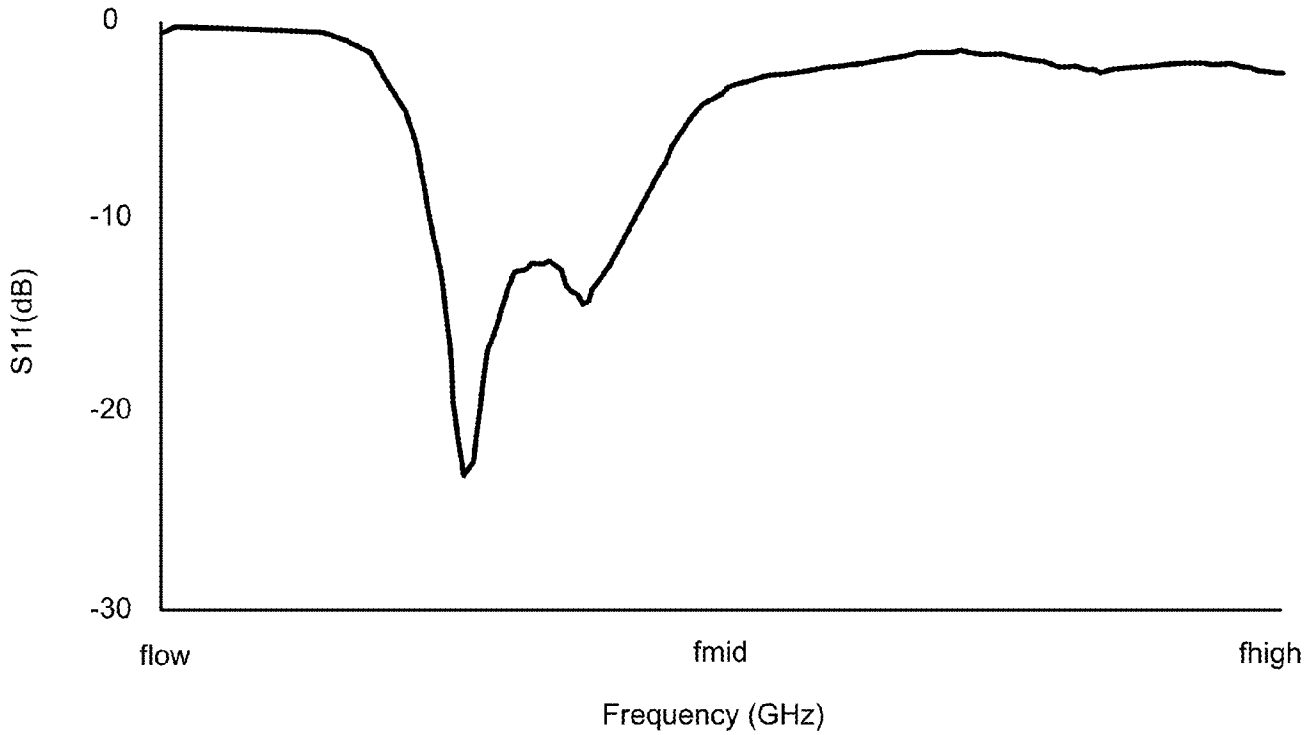
FIG. 47 illustrates a measured return loss plot of the balanced MTM antenna device depicted in FIGS. 45A-45C, according to an example embodiment.

FIG. 47 illustrates a measured return loss plot of the balanced MTM antenna device 4500. The measured return loss suggests an antenna that operates in a wide bandwidth as evidenced by a return loss result that is better than −10 dB between 2.3 to 3.2 GHz, for example.

Figure 48:
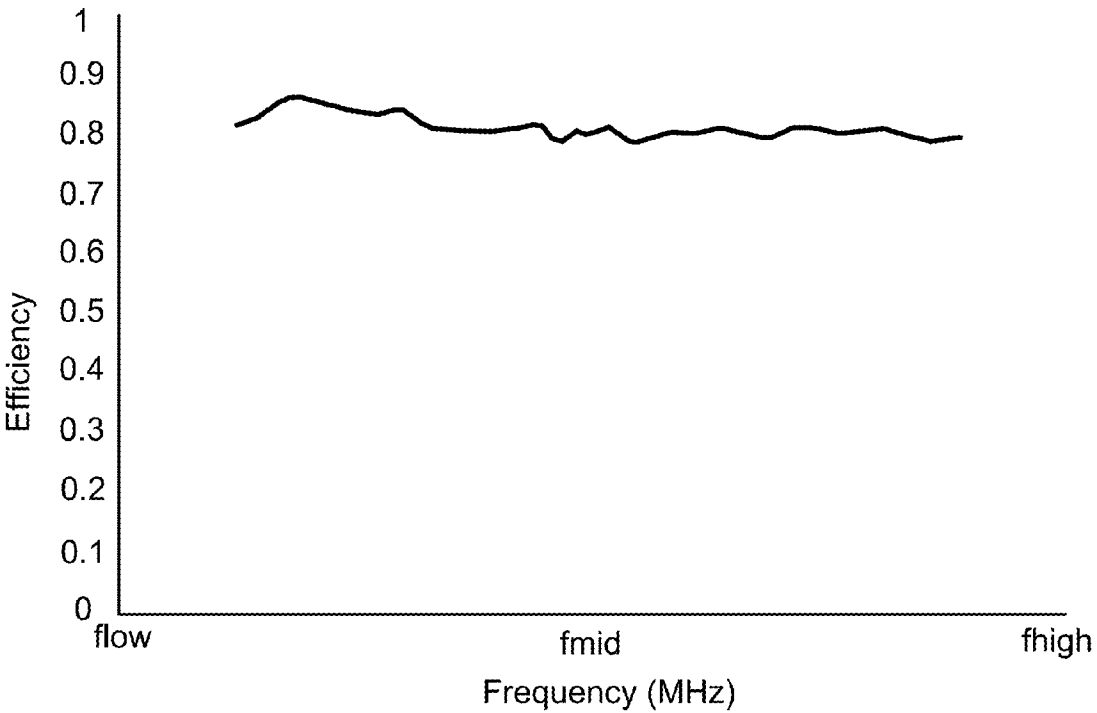
FIG. 48 illustrates a measured efficiency for the balanced MTM antenna device depicted in FIGS. 45A-45C, according to an example embodiment.

FIG. 48 illustrates a measured efficiency for the balanced MTM antenna device 4500. This result indicates that the antenna device 4500 may be capable of achieving an average efficiency, over a given range of frequency, which is equal or better than 80%.

Figure 49:
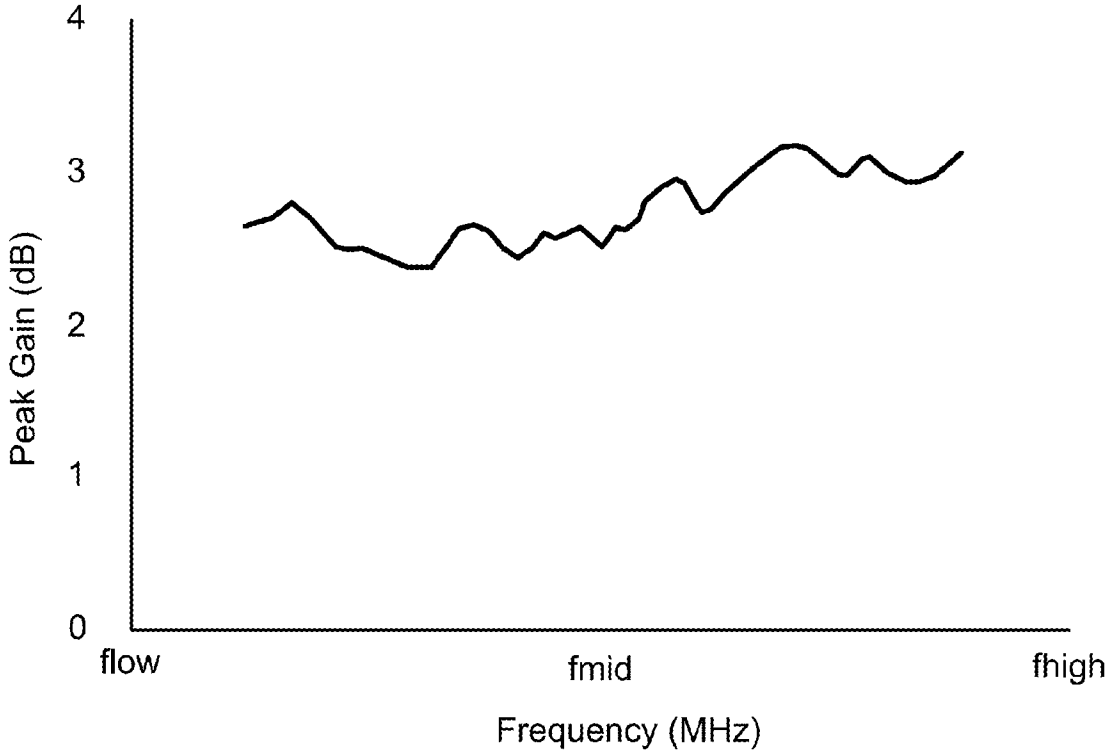
FIG. 49 illustrates a measured peak gain for the balanced MTM antenna device depicted in FIGS. 45A-45C, according to an example embodiment.

FIG. 49 illustrates a measured peak gain of better than 2.5-3 dBi for the balanced MTM antenna device 4500.

Figure 50:
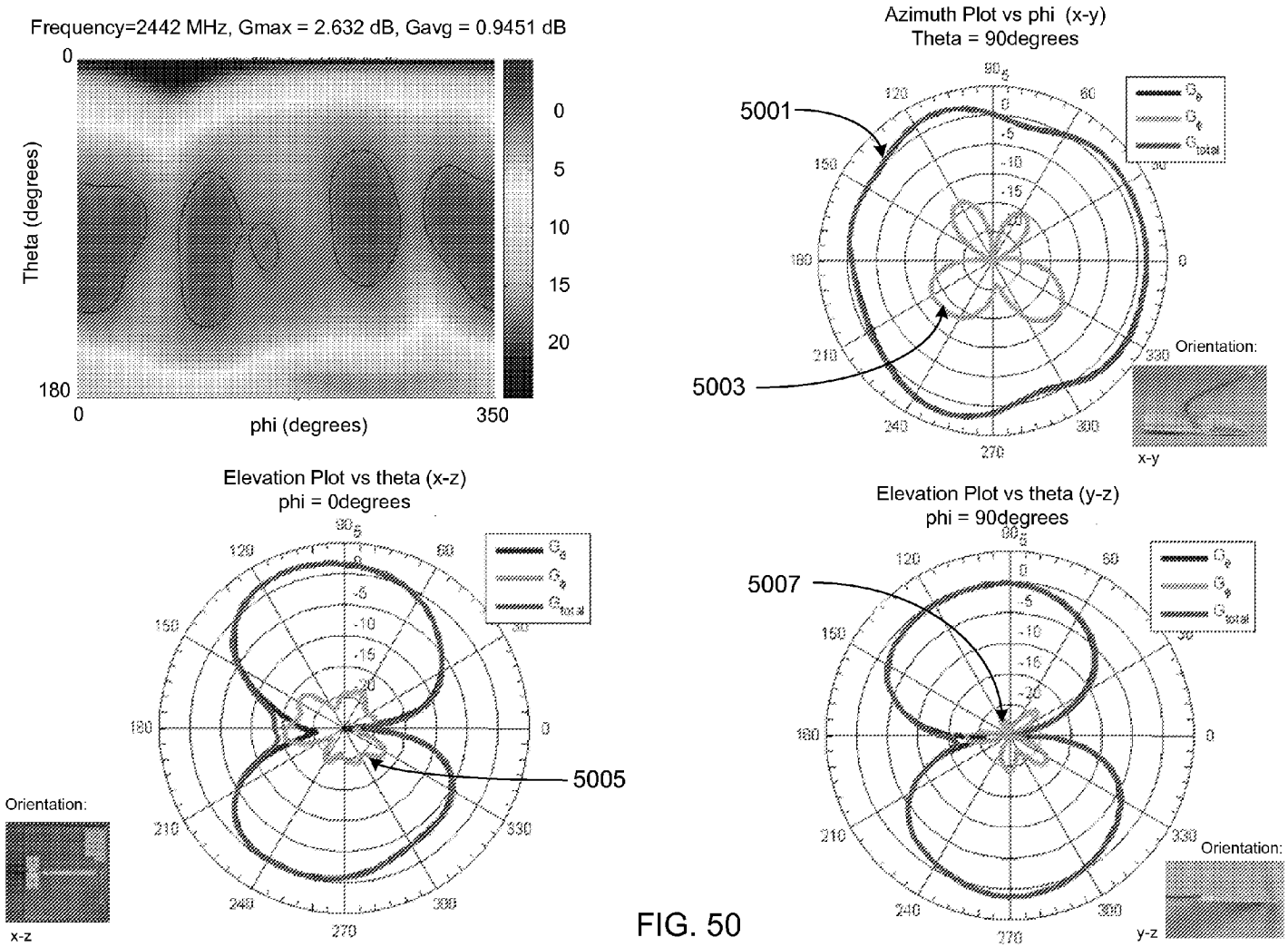
FIG. 50 illustrates gain and radiation patterns for the balanced MTM antenna device depicted in FIGS. 45A-45C in the case of free space, according to an example embodiment.

FIG. 50 shows the gain and radiation patterns for the balanced MTM antenna device 4500 in the case of free space. The orientation of the balanced MTM antenna device 4500 is shown in a drawing for each radiation pattern to indicate the coordinates in free space. A substantially omnidirectional pattern 5001 with ripples less than 2.5 dB is achieved in the y-z plane. Furthermore, it can also be seen that the cross polarizations 5003, 5005, and 5007 measured in the three different planes are negligible.

The return loss, efficiency and peak gain plots for this antenna device 4500 suggest a broader and larger contiguous bandwidth than in the dual-band balanced antenna device 3300 shown in FIGS. 33A-33C. By way of comparison, for example, the covered bandwidth for the antenna device 4500 is 2.3 to 2.6 GHz for the efficiency and peak gain. This is approximately a 12% increase in bandwidth than the dual-band balanced antenna device 3300. Also, in the previous antenna device 3300 the bandwidth at the 2.4 GHz frequency covered 2.39 to 2.52 GHz, or around 5%. In the wide bandwidth balanced antenna device 4500, frequency bands include multiple bands such as WiBRO at 2.3 GHz, Wi-Fi at 2.4-2.48 GHz and WiMAX at 2.5 to 2.7 GHz. Compare this to the dual-band design was Wi-Fi which covers 2.4-2.48 GHz and 5 GHz. Furthermore, the efficiency (80%) and peak gain range (2.5-3 dBi) of the new design are also show an improvement over the previous antenna device 3300. These results and other benefits, which include possible size reduction capability and robust fabrication, provide several advantageous features realized in this balanced antenna device 4500 implementation.

Other Balanced MTM Antenna Configurations

Examples of other balanced MTM antenna devices are provided in FIGS. 51A-51B, FIGS. 52A-52B, and FIGS. 53A-53B. These examples include a pair of balanced CRLH antenna structures that employ a combination of asymmetric and symmetric balun structures, grounded and virtually grounded via lines, and discrete and printed structures.

Figure 51B:
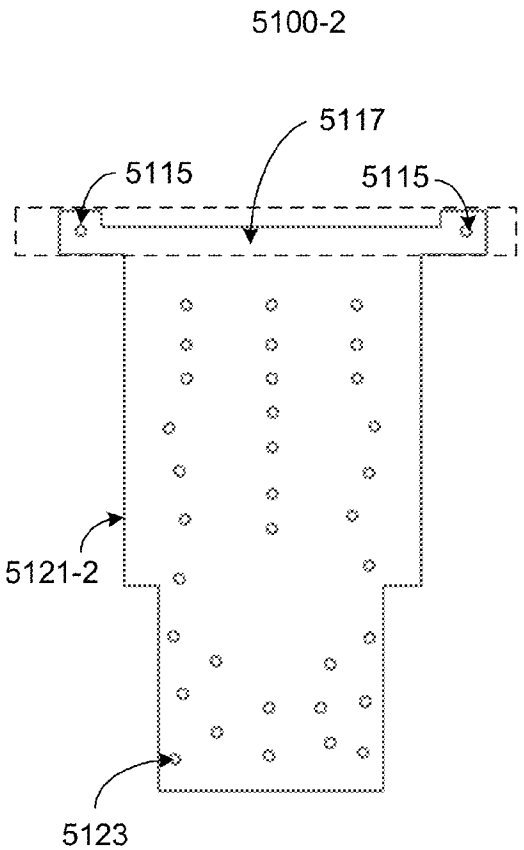
FIGS. 51A-51B illustrate a top view of a top layer and a top view a bottom layer, respectively, of a balanced MTM antenna device, according to an example embodiment.
Figure 51A:
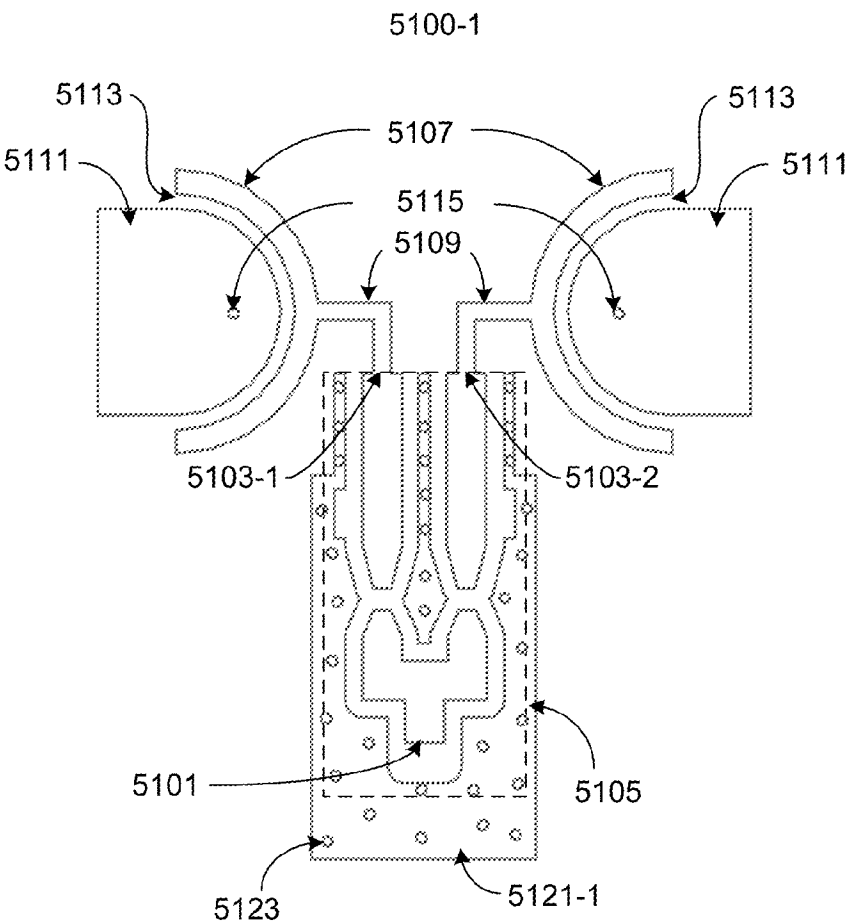

FIGS. 51A and 51B illustrate a top view of a top layer 5100-1 and a top view a bottom layer 5100-2, respectively, of a balanced MTM antenna device 5100 formed on a substrate (not shown). The MTM balanced antenna device 5100 includes two radiating CRLH antenna portions, which are configured to be balanced, and a balun coupling the two balanced CRLH antennas to an unbalanced RF source such as a coax cable. The coax cable, for example, may include a conductive inner core and a conductive shield to communicate a signal transmission.

In FIGS. 51A-51B, the CRLH antenna portions of the MTM balanced antenna device 5100 include a first CRLH antenna portion and second CRLH antenna portion which have conductive elements that are formed on the top layer 5100-1 and the bottom layer 5100-2. The first CRLH antenna portion is structurally symmetrical and balanced to the second CRLH antenna portion. Each CRLH antenna portion is configured to include a feed port 5103, a feed line 5109 connected to the feed port 5103; a launch pad 5107, having a curved conductive strip line connected to the feed line 5109; a cell patch 5111 having at least one side in the shape of a semicircle and capacitively coupled to the top launch pad 5107; a via 5115 formed in the substrate and connected to the cell patch 5111; and a via line 5117 connected to the via 5115, the via line 5117 structured to form a common conductive line between the first CRLH antenna portion and the second CRLH antenna portion, wherein the via line 5117 is also connected to a ground 5121. The ground 5121 may include a top ground 5121-1 and a bottom ground 5121-2. The via line 5117 associated with the first antenna portion and the via line 5117 associated with the second antenna portion together form a 180° line to maintain structurally symmetric and electrically balanced properties, including current flows, of the antenna device 5100.

The balun 5105 of the MTM balanced antenna device 5100 includes a conductive portion formed on the top layer 5100-1 adapting the balanced CRLH antenna portions to an unbalanced RF source such as a coax cable. In this example, the balun 5105 may constructed to include discrete elements such as lumped components which form a low pass and high pass filter as described in the previous example and shown in FIG. 15. The low pass filter provides a −90° phase shift at the feed port 5103-1 of the first CRLH antenna portion, whereas the high pass filter provides a +90° phase shift at the feed port 5103-2 of the second CRLH antenna portion. Due to the symmetric property of this antenna device, the low pass filter and high pass filter may be swapped at the feed ports 5103 and yet provide the appropriate phase shift to each CRLH antenna portion. Due to the equal and opposite phase shift provided by each filter, the balun device 5105 may provide a resulting phase shift of 180° and serve to cancel reflection between the first and second CRLH antenna portions, and thus improve the overall radiation performance of the balanced antenna device 5100. Therefore, the 180° via line 5117 and the balun 5105 may be configured to provide a current flow between each CRLH antenna portion that are equal in magnitude but 180° out of phase which, among other factors, define the balanced properties in this antenna device.

Connecting the balun 5105 to the unbalanced RF source is described as follows. Referring to FIG. 51A, one end of the balun 5105 may be connected to the feed port 5103 associated with the first and second CRLH antenna portions. The other end of the balun 5105 provides a feed port 5101 to connect the balun 5105 to a first signal line of the RF source, such as the inductive inner core of the coax cable. Referring to FIG. 51B, the bottom ground 5121-2 is connected to the top ground 5121-1 through an array of vias 5123 formed in the substrate. Subsequently, the ground 5121 may be connected to a second signal line of the RF source, such as the conductive shield of the coax cable for communicating an unbalanced RF signal to the balanced antenna device 5100.

Figure 52B:
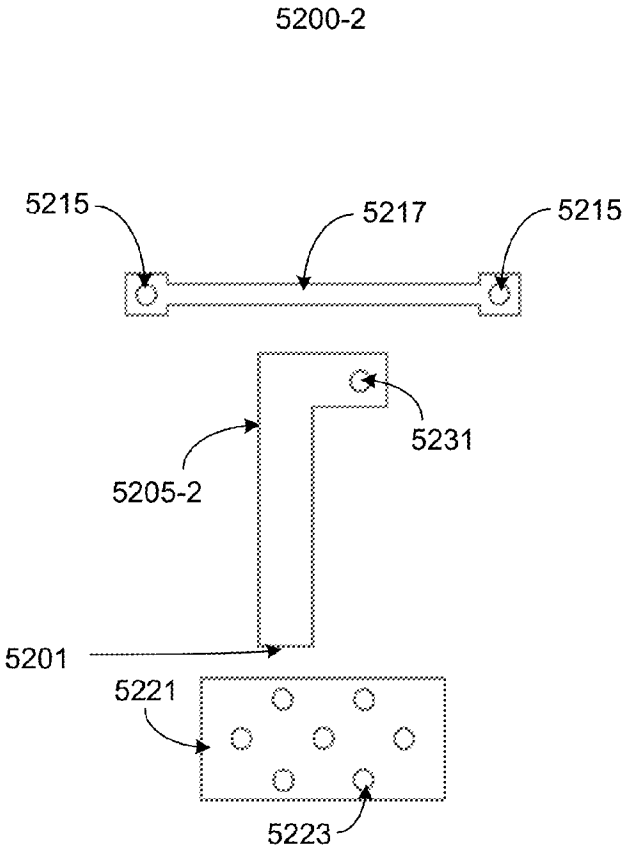
FIGS. 52A-52B illustrate another example of balanced MTM antenna device having MTM antenna structures that employ a virtual ground, according to an example embodiment.
Figure 52A:
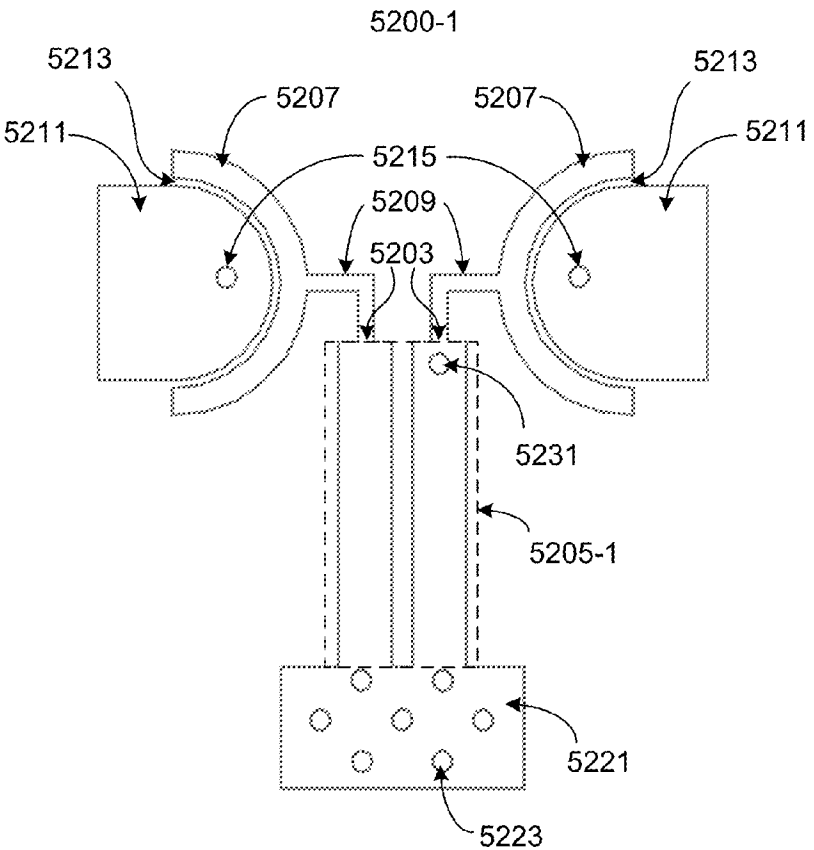

FIGS. 52A-52B illustrates another example of balanced MTM antenna device 5200 having CRLH antenna structures that employ a virtual ground. The CRLH antennas in this antenna device 5200 include a first CRLH antenna portion and second CRLH antenna portion which have conductive elements that are structurally similar to the MTM antenna device 5100 previously presented. The first CRLH antenna portion is structurally symmetrical and balanced to the second CRLH antenna portion. Each CRLH antenna portion is configured to include a feed port 5203; a feed line 5209 connected to the feed port 5203; a launch pad 5207, having a curved conductive strip line connected to the feed line 5209; a cell patch 5211 having at least one side approximately in the shape of a semi-circle and capacitively coupled to the top launch pad 5207; a via 5215 formed in the substrate and connected to the cell patch 5211; and a via line 5217 connected the via 5215, the via line 5217 structured to form a common conductive line between the first CRLH antenna portion and the second CRLH antenna portion. In this embodiment, the via line 5217 is structured to form a 180° line to maintain structurally symmetric and electrically balanced properties, including current flows, of the antenna device 5200. In addition, the via line 5217 may be engineered to behave effectively as a virtual ground having a zero potential at the center of the via line 5217 and thereby eliminating the need for a physical ground used to terminate via lines 5217.

The balun 5205 of the MTM balanced antenna device 5200 includes a conductive balun portion 5205-1 formed on the top layer 5200-1 and a conductive balun portion 5205-2 formed bottom layer 5200-2, the conductive balun portions connected by a via 5231. In this example, the balun 5205 may be constructed to include printed elements using similar printed circuit techniques used to fabricate the antenna elements. In operation, the balun 5205 may be used to adapt the balanced CRLH antenna portions to an unbalanced RF source, such as a coax cable, by providing a resulting phase shift of 180° to cancel reflected signals between the balanced CRLH antenna portions.

Connecting the balun 5205 to the unbalanced RF source is described as follows. Referring to FIG. 52A, one end of the balun 5205 may be connected to the feed port 5203 associated with the first and second CRLH antenna portions. The other end of the balun 5205 provides a feed port 5201 to connect the balun 5205 to a first signal line of the RF source, such as the inductive inner core of the coax cable. Referring to FIG. 52B, the bottom ground 5221-2 is connected to the top ground 5221-1 through an array of vias 5223 formed in the substrate. Subsequently, the ground 5221 may be connected to a second signal line of the RF source, such as the conductive shield of the coax cable for communicating an unbalanced RF signal to the balanced antenna device 5200.

Figure 53B:
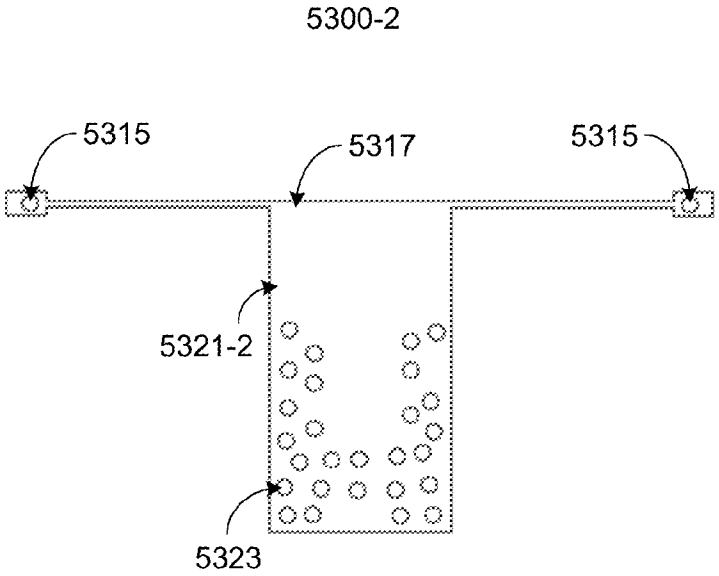
FIGS. 53A-53B illustrate yet another example of an MTM balanced antenna device, according to an example embodiment.
Figure 53A:
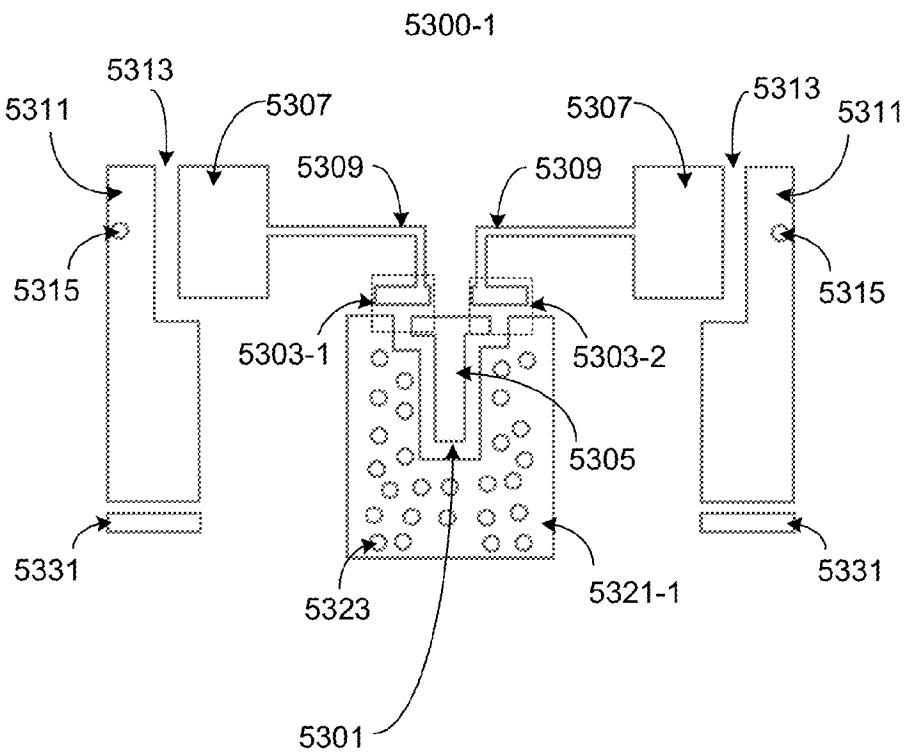

FIGS. 53A-53B illustrates yet another example of an MTM balanced antenna device 5300. A pair of balanced CRLH antenna portions of the antenna device 5300 may each include a first CRLH antenna portion and a second CRLH antenna portion which have conductive elements that are formed on the top layer 5300-1 and the bottom layer 5300-2. The first CRLH antenna portion is structurally symmetrical and balanced to the second CRLH antenna portion. Each CRLH antenna portion is configured to include a feed port 5303; a feed line 5309 connected to the feed port 5303; a launch pad 5307 connected to the feed line 5309; a cell patch 5311 capacitively coupled to the top launch pad 5307; a via 5315 formed in the substrate and connected to the cell patch 5311; a parasitic conductive patch 5331 capacitively coupled to the cell patch 5311; and a via line 5317 connected the via 5315; the via line 5317 structured to form a common conductive line between the first CRLH antenna portion and the second CRLH antenna portion and connected to a ground 5321, which includes a top ground 5321-1 and a bottom ground 5321-2. The via line 5317 associated with the first antenna portion and the via line 5317 associated with the second antenna portion together form a 180° line to maintain structurally symmetric and electrically balanced properties, including current flows, of the antenna device 5300.

The balun 5305 of the MTM balanced antenna device 5300 includes a conductive portion formed on the top layer 5300-1 adapting the balanced CRLH antenna portions to an unbalanced RF source such as a coax cable. In this example, the balun 5305 may constructed to include discrete elements such as lumped components which form a low pass and high pass filter as described in the previous example and shown in FIG. 15. The low pass filter provides a −90° phase shift at the feed port 5303-1 of the first CRLH antenna portion, whereas the high pass filter provides a +90° phase shift at the feed port 5303-2 of the second CRLH antenna portion. Due to the symmetric property of this antenna device, the low pass filter and high pass filter may be swapped at the feed ports 5303 and yet provide the appropriate phase shift to each CRLH antenna portion. Due to the equal and opposite phase shift provided by each filter, the balun device 5305 may provide a resulting phase shift of 180° and serve to cancel reflection between the first and second CRLH antenna portions, and thus improve the overall radiation performance of the balanced antenna device 5300. Therefore, the 180° via line 5317 and the balun 5305 may be configured to provide a current flow between each CRLH antenna portion that are equal in magnitude but 180° out of phase which, among other factors, define the balanced properties in this antenna device.

Connecting the balun 5305 to the unbalanced RF source is described as follows. Referring to FIG. 53A, one end of the balun 5305 may be connected to the feed port 5303 associated with the first and second CRLH antenna portions. The other end of the balun 5305 provides a feed port 5301 to connect the balun 5305 to a first signal line of the RF source, such as the inductive inner core of the coax cable. Referring to FIG. 53B, the bottom ground 5321-2 is connected to the top ground 5321-1 through an array of vias 5323 formed in the substrate. Subsequently, the ground 5321 may be connected to a second signal line of the RF source, such as the conductive shield of the coax cable for communicating an unbalanced RF signal to the balanced antenna device 5300.

Other techniques and structures for reducing the size of the balanced MTM antenna may be possible, for example, by modifying the size and shape of the cell patches into other shapes, such as circles, triangles, diamonds, and so forth, to be structurally smaller, reducing the length or modify the shape of the feed-line, reducing the distance between the two via lines, etc. Other modified antenna designs are provided in U.S. patent application Ser. No. 12/536,422 entitled "Metamaterial Antennas for Wideband Operations," filed on Aug. 5, 2009. A single-layer structure can also be designed by placing the via lines in the top layer to connect the cell patches to the top ground instead of the bottom ground. Also, the balanced MTM antenna device 3300 may employ various balun structures such as the lumped elements, distributed types, or tapered baluns presented hereinabove. A structure with one CRLH antenna in the top layer and the other in the bottom layer can also be employed by keeping the balance and symmetry of the two CRLH antennas. Furthermore, the two MTM antennas can be configured asymmetrically provided that the two via lines are designed to retain the 180° phase offset provided by the balun. The design can also be extended for multi-band applications by using multi-band CRLH antennas with a multi-band MTM balun. In the above examples, each CRLH antenna may be constructed as a single layer via-less metamaterial antenna structure or a multilayer metamaterial antenna structure (with more than two layers).

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, it is understood that variations and enhancements may be made.

What is claimed is what is described and illustrated, including:

1. An antenna apparatus, comprising:

a first radiating element comprising a CRLH structure;

a second radiating element comprising a second CRLH structure; and a common conductive line connected to the first and second radiating elements;

a feed port for providing an unbalanced signal; and a balun coupled to the first and second radiating elements, the feed port and the common conductive line, the balun adapting the unbalanced signal from the feed port to a balanced signal for the first and second radiating elements or adapting a balanced signal from the first and second radiating elements to an unbalanced signal for the feed port;

wherein each of the first and second radiating elements provide a left-handed (LH) mode resonance and a right-handed (RH) mode resonance.

2. The antenna apparatus as in claim 1, wherein the first radiating element is substantially symmetric to the second radiating element.

3. The antenna apparatus as in claim 2, wherein the balun comprises:

a low pass filter providing a −90° phase shift to a received signal for the first radiating element; and a high pass filter providing a +90° phase shift to a received signal for the second radiating element, wherein the resultant 180° phase difference cancels a reflection condition between the first and second radiating elements.

4. The antenna apparatus as in claim 3, wherein the balun comprises a top conductive element having a tapered geometrical shape; and a bottom conductive element having a hyperbolic geometrical shape, wherein the bottom conductive element provides a characteristic impedance that is substantially held at a constant.

5. The antenna apparatus as in claim 4, wherein the balun is configured to support broadband frequencies.

6. The antenna apparatus as in claim 3, wherein the balun is comprised of a first conductor on the first surface and a second conductor on the second surface, wherein the body of the first and second conductors are tapered.

7. The antenna apparatus as in claim 3, wherein the balun has at least one end of the second tapered conductor having a hyperbolic profile.

8. The antenna apparatus as in claim 3, wherein the balun comprises lumped components or printed elements.

9. A device, comprising:

a substrate;

a first antenna portion formed on the substrate;

a second antenna portion formed on the substrate and coupled to the first antenna portion, wherein the first antenna portion is substantially symmetric to the second antenna portion;

a feed port for providing an unbalanced signal;

a ground electrode formed on the substrate and electrically coupled to the first and second portions; and a balun coupled to the first and second antenna portions, the feed port and the ground electrode, the balun adapting the unbalanced signal from the feed port to a balanced signal for the first and second antenna portions or adapting a balanced signal from the first and second antenna portions to a unbalanced signal for the feed port, wherein the substrate, the first and second antenna portions, and the ground electrode are configured to form a CRLH structure providing a left-handed (LH) mode and resonance right-handed (RH) mode resonance.

10. The device as in claim 9, wherein each antenna portion comprises:

a feed line having one end that is connected to the balun;

a launch pad connected to another end of the fee line;

a cell patch capacitively coupled to the launch pad by a coupling gap;

a via formed in the substrate and connected to the cell patch; and a via line having a one end connected to the via and another end connecting the first antenna portion to the second antenna portion.

11. The device as in claim 10, wherein a distal end of each via line is connected to the ground electrode.

12. The device as in claim 10, wherein the cell patch is semicircular in shape and the launch is a curved conductive strip line adjacent to part of the cell patch.

13. The device as in claim 10, wherein the cell patch is rectangular, triangular, or polygonal in shape.

14. The device as in claim 10, wherein an angle span determined by the via line of the first antenna portion and via line of the second antenna portion is substantially 180 degrees.

15. The device as in claim 10, wherein the via line of the first antenna portion and the via line of the second antenna portion are substantially symmetric, each via line configured to produce an effective current that is substantially equivalent.

16. The device as in claim 10, wherein the via line of the first antenna portion and the via line of the second antenna portion are substantially asymmetric, each via line configured to produce an effective current that is substantially equivalent.

17. The device as in claim 10, wherein the via line is structured in the form of zig-zag, meandered, or other non-linear shapes.

18. The device as in claim 9, wherein the first and second antennas are configured to generate substantially omnidirectional radiation patterns.

19. The device as in claim 9, wherein the first and second antenna portions are configured to generate substantially small cross polarizations.

20. The device as in claim 9, wherein each antenna portion is configured to support single band or multi-band frequencies.

21. The device as in claim 9, wherein the balun comprises a low pass filter providing a −90° phase shift to the first antenna portion; and the high pass filter providing a +90° phase shift to the second antenna portion, wherein the combined phase shift of 180° cancels a reflection between the first and second antenna portions.

22. The device as in claim 9, wherein the balun comprises a top conductive element having a tapered geometrical shape; and a bottom conductive element having a hyperbolic geometrical shape, wherein the bottom conductive element provides a characteristic impedance that is substantially held at a constant.

23. The device as in claim 9, wherein the balun is comprised of a first conductor on the first surface and a second conductor on the second surface, wherein the body of the first and second conductors are tapered.

24. The device as in claim 9, wherein the balun has at least one end of the second tapered conductor having a hyperbolic profile.

25. The device as in claim 9, wherein the balun is comprised lumped components or printed elements.

26. The device as in claim 9, wherein the balun is configured to support broadband frequencies.

27. A device, comprising:

a substrate;

a first antenna portion supported by the substrate;

a second antenna portion supported by the substrate and coupled to the first antenna portion, herein the first antenna portion is substantially symmetric to the second antenna portion;

a feed port for providing an unbalanced signal; and a balun coupled to the first and second antenna portions, the feed port and a ground electrode, the balun adapting the unbalanced signal from the feed port to a balanced signal for the first and second antenna portions or adapting a balanced signal from the first and second antenna portions to a unbalanced signal for the feed port, wherein the substrate, and the first and second antenna portions are configured to form a CRLH structure providing a left-handed (LH) mode resonance and a right-handed (RH) mode resonance.

28. The device as in claim 27, wherein each antenna portion comprises a feed line having one end that is connected to the balun;

a launch pad connected to the other end of the feed line;

a cell patch capacitively coupled to the launch pad by a coupling gap;

a via formed in the substrate and connected to the cell patch; and a via line having a one end connected to the via and the other end connecting the first antenna portion to the second antenna portion at a central point.

29. The device as in claim 28, wherein the first antenna portion and the second antenna portion are symmetric about the central point.

30. The device as in claim 29, wherein, a voltage potential at the central point is substantially zero.

31. The device as in claim 27, wherein the balun comprises a low pass filter providing a −90° phase shift to the first antenna portion; and a high pass filter providing a +90° phase shift to the second antenna portion, wherein the combined phase shift of 180° cancels a reflection between the first and second antenna portions.

32. The device as in claim 27, wherein the balun comprises a top conductive element having a tapered geometrical shape; and a bottom conductive element having a hyperbolic geometrical shape, wherein the bottom conductive element provides a characteristic impedance that is substantially held at a constant.

33. The device as in claim 27, wherein the balun is comprised of a first conductor on the first surface and a second conductor on the second surface, wherein the body of the first and second conductors are tapered.

34. The device as in claim 27, wherein the balun has at least one end of the second tapered conductor having a hyperbolic profile.

35. The device as in claim 27, wherein the balun is comprised lumped components or printed elements.

36. The device as in claim 27, wherein the feed line, the launch pad and the cell patch of the first antenna portion are formed on a first surface of the substrate;

the feed line, launch pad, and the cell patch of the second antenna portion are formed on the second surface of the substrate;

the via line of the first and second antenna portions are formed on the second and first surfaces of the substrate respectively;

the via of the first antenna portion connects the cell patch to the via line of the first antenna portion;

the via of the second antenna portion connects the cell patch to the via line of the second antenna portion;

a central via formed in the substrate to connect the via line of the first antenna portion to the via line of the second antenna portion, wherein the first and second antenna portions are symmetric about the central via, and the voltage potential in proximity to the central via is substantially zero;

a first feed port communicating a first signal and a second feed port communicating a second signal, wherein the first signal and the second signal are 180 degrees out of phase; and a balun coupled to the first and second feed port for adapting an unbalanced signal at the feed port to a balanced signal or adapting a balanced signal at the feed port to a unbalanced signal.

37. The device as in claim 36, wherein the first and second antenna portions are configured to support multi-band frequencies.

38. The device as in claim 27, wherein the feed line, the launch pad, and the via line of the first antenna portion are formed on a first surface of the substrate;

the feed line, the launch pad, and the via line of the second antenna portion are formed on a second surface of the substrate;

the cell patch of the first and second antenna portions are formed on the second and first surfaces of the substrate, respectively;

the via of the first antenna portion connects the cell path to the via line of the first antenna portion;

the via of the second antenna portion connects the cell patch to the via line of the second antenna portion;

the central via formed in the substrate to connect the via line of the first antenna portion to the via line of the second antenna portion, wherein the first and second antenna portions are symmetric about the central via, and the voltage potential in proximity to the central via is substantially zero;

a first feed port communicating a first signal and a second feed port communicating a second signal, wherein the first signal and second signal are 180 degrees out of phase and a balun coupled to the first and second feed port for adapting an unbalanced signal at the feed port to a balanced signal or adapting a balanced signal at the feed port to a unbalanced signal.

39. The device as in claim 38, wherein the first and second antenna portions are configured to support high gain and wide bandwidth radiation properties.

40. A device, comprising:

a CRLH dipole antenna structure, comprising;

a first antenna portion;

a second antenna portion electrically coupled to the first antenna portion, the second antenna portion is substantially symmetric to the first antenna portion;

a feed port; and a ground electrode electrically coupled to the first and second antenna portions; and a balun coupled to the first and second antenna portions, the feed port and the ground electrode, the balun adapted to:

phase shift a signal communicated at the feed port to form a first signal for the first antenna portion and a second signal for the second antenna portion;

wherein the CRLH dipole antenna structure provides a left-handed (LH) mode resonance and a right-handed (RH) mode resonance.

41. The device as in claim 40, wherein the first and second signals are 180° out of phase with each other.

42. A method, comprising:

forming a first CRLH radiating element on a substrate;

forming a second CRLH radiating element on a substrate; and forming a common conductive line connected to the first and second radiating elements;

forming a feed port for providing an unbalanced signal; and forming a balun coupled to the first and second CRLH radiating elements, the feed port and the common conductive line, the balun adapting the unbalanced signal from the feed port to a balanced signal for the first and second CRLH radiating elements or adapting a balanced signal from the first and second CRLH radiating elements to an unbalanced signal for the feed port;

wherein each of the first and second radiating elements provide a left-handed (LH) mode resonance and a right-handed (RH) mode resonance.

43. The method as in claim 42, wherein the first CRLH radiating element is substantially symmetric to the second CRLH radiating element.

* * * * *

UNITED STATES PATENT AND TRADEMARK OFFICE

CERTIFICATE OF CORRECTION

PATENT NO. : 8,610,635 B2
APPLICATION NO. : 12/716852
DATED : December 17, 2013
INVENTOR(S) : Huang et al.

It is certified that error appears in the above-identified patent and that said Letters Patent is hereby corrected as shown below:

In the Claims

In column 39, line 44, in claim 28, delete “comprises” and insert --comprises:--, therefor Signed and Sealed this
Second Day of December, 2014

Michelle K. Lee

Michelle K. Lee
*Deputy Director of the United States Patent and Trademark Office*